US007127076B2

(12) United States Patent
Roeck et al.

(10) Patent No.: US 7,127,076 B2
(45) Date of Patent: Oct. 24, 2006

(54) METHOD FOR MANUFACTURING ACOUSTICAL DEVICES AND FOR REDUCING ESPECIALLY WIND DISTURBANCES

(75) Inventors: Hans-Ueli Roeck, Hombrechtikon (CH); Silvia Allegro, Hombrechtikon (CH); Franziska Pfisterer, Birmensdorf (CH)

(73) Assignee: Phonak AG, Stafa (CH)

( * ) Notice: Subject to any disclaimer, the term of this patent is extended or adjusted under 35 U.S.C. 154(b) by 403 days.

(21) Appl. No.: 10/378,453

(22) Filed: Mar. 3, 2003

(65) Prior Publication Data

US 2004/0175012 A1 Sep. 9, 2004

(51) Int. Cl.
*H04R 25/00* (2006.01)

(52) U.S. Cl. ..... 381/312; 381/316; 381/317

(58) Field of Classification Search ..... 381/60, 381/312, 314–318, 320–321; 29/896.21; 600/25; 607/55–57
See application file for complete search history.

(56) References Cited

U.S. PATENT DOCUMENTS

| | | | |
|---|---|---|---|
| 4,783,807 A | 11/1988 | Marley et al. | |
| 5,483,617 A | 1/1996 | Patterson et al. | |
| 5,511,128 A | 4/1996 | Lindemann et al. | |
| 5,666,433 A | 9/1997 | Wehner et al. | |
| 5,793,875 A | 8/1998 | Lehr et al. | |
| 5,838,274 A | 11/1998 | Johnson et al. | |
| 6,882,736 B1 * | 4/2005 | Dickel et al. | 381/317 |
| 2002/0037088 A1 | 3/2002 | Dickel et al. | |
| 2002/0057808 A1 | 5/2002 | Goldstein | |
| 2002/0150264 A1 | 10/2002 | Allegro et al. | |

FOREIGN PATENT DOCUMENTS

| | | |
|---|---|---|
| DE | 37 33 983 A | 4/1989 |
| EP | 0 588 526 A | 3/1994 |
| EP | 0 843 427 A | 5/1998 |
| EP | 1 351 544 A | 10/2003 |
| WO | 87/00366 A | 1/1987 |
| WO | 97/10586 A | 3/1997 |
| WO | 01/31972 A | 3/2001 |
| WO | 03/015460 A | 2/2003 |

* cited by examiner

*Primary Examiner*—Suhan Ni
(74) *Attorney, Agent, or Firm*—Pearne & Gordon LLP

(57) ABSTRACT

A method for manufacturing an acoustical device, especially a hearing device. A device casing is provided with an acoustical/electrical input converter arrangement with an electric output. An audio signal processing unit establishes audio signal processing of the device according to individual needs and/or purpose of the device. At least one electrical/mechanical output converter is provided. A filter arrangement with adjustable high-pass characteristic has a control input for the characteristic. The following operational connections are established: between the output of the input converter arrangement and the input of the filter arrangement, between the output of the filter arrangement and the control input, between said output of the filter arrangement and the input of the processing unit, between the output of the processing unit and the input of the at least one output converter.

10 Claims, 10 Drawing Sheets

METHOD FOR MANUFACTURING ACOUSTICAL DEVICES AND FOR REDUCING ESPECIALLY WIND DISTURBANCES

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The present invention relates to the electronic cancellation of wind noise and more particularly to a method of manufacturing acoustical devices that incorporate the electronic cancellation of wind noise.

2. Description of Related Art

The present invention departs generally from the need of canceling wind disturbances from desired acoustical source reception as of speech or music etc. Wind noise in hearing devices is a severe problem. Wind noise may reach magnitudes of 100 dB SPL (Sound Pressure Level) and even more. Users of hearing devices therefore often switch their device off in windy conditions, because acoustical perception with the hearing device in windy surrounding may become worse than without the hearing device.

Approaches are known to counteract wind noise by mechanical constructional measures, but cannot eliminate wind noise completely, often even not to a completely satisfying degree. It is well-known that wind noise is a low-frequency phenomenon. Depending upon wind speed, direction of the wind with respect to the device, hair length of the individual, mechanical obstructions like hats and other factors, magnitude and spectral content of wind noise vary significantly. With respect to noise, effects and causes we refer to H. Dillon et al., "The sources of wind noise in hearing aids", IHCON 2000, as well as to I. Roe et al., "Wind noise in hearing aids: Causes and effects", submitted to JASA.

Wind signals at sensing ports or acoustical/electrical input converters of hearing devices mounted with a predetermined spacing are far less correlated than are normal acoustical signals to be perceived, as especially speech, music etc.

One reason is that such normal acoustical signals arrive as more or less planar waves, causing at distant acoustical to electrical input converters time delays which are far predominantly caused by the direction of arrival with which such signals impinge upon the converter. As known to the skilled artisan, this time delay is used in beamformer art, whereby a delayed output signal from one converter is subtracted from the output signal of the other converter. There results at the common output of subtraction a signal which has an amplification characteristic with respect to impinging acoustical signals which is dependent on the direction of arrival DOA of such signals with respect to the converters and is commonly known as beamformer characteristics.

The subtraction of well correlated signals as generated by the above mentioned normal signals to be perceived as of speech or music signals normally leads to the known roll-off behavior of such beamformers. The roll-off behavior or characteristic establishes a frequency dependent attenuation of the beam characteristics. It has a pronounced high-pass character, which considerably attenuates low frequencies which are critical especially for speech perception.

Wind noise signals are not subject to the the roll-off behavior of a beamformer because of their lower correlation even at very low frequencies and considered at at least two spaced apart input converters. Whereas normal signals as speech is attenuated by the roll-off towards low frequencies, wind noise is not. Even worse, wind noise has a further adverse effect on signal transfer of normal signals affecting speech recognition. It masks speech-caused signals due to the "upwards-spread-off masking". Upward-spread-off masking is a phenomenon according to which a signal at a predetermined spectral frequency masks signals at higher frequency increasingly with increasing amplitude.

From the US 2002-0 037 088 A1 as well as from the DE 10 045 197 it is known to tackle the problem of wind noise by detecting such noise at two spaced-apart input converters and use in windy situations only the output signal of one of the omnidirectional converters, thereby in fact switching beamforming off. Further, a static high-pass filter is switched on to further attenuate wind noise.

Nevertheless, many hearing devices do not feature two or more acoustical input converters, so that the detection and elimination of wind noise based on two or more converters is not always possible. Further, as was mentioned above, the spectral shape of wind noise varies significantly in time. Thereby, the spectrum range, where wind noise has an energy i.e. below $10^4$ Hz is exactly that range where a hearing device should be effective, because individuals have often impaired hearing abilities in this range. Attenuating wind noise with a static high-pass filter will either filter too little of the wind noise to maintain normal signal perception, or to such an amount that wind noise is well cancelled, but also normal acoustical signals to be perceived. Switching beamforming off as proposed in the above mentioned documents significantly reduces the overall advantages of a hearing device with beamforming abilities also at higher frequencies.

It is an object of the present invention generically to provide methods and devices which deal with the above mentioned drawbacks. Although it departs from the specific wind noise problems, some of the solutions according to the present invention may also be applied for improving signal-to-noise ratio more generically with respect to normal acoustical signals as of speech or music signals or for improving beamformer control and/or wind detection.

BRIEF SUMMARY OF THE INVENTION

Detailed theoretical considerations to the different aspects of the present invention may be found in the paper from F. Pfisterer for achieving their diploma at the Federal Institute of Technology in Zurich. The paper by F. Pfisterer, which is titled "Wind Noise Canceling for Hearing Instruments," was filed as an appendix to this specification and is incorporated herein by reference.

$1^{st}$ Aspect

Under a first aspect of the present invention the above mentioned object is resolved by manufacturing a specifically tailored hearing device. There is proposed a method for manufacturing such a hearing device which comprises the steps of

- providing in a hearing device casing an acoustical/electrical input converter arrangement with an electric output;
- providing an audio signal processing unit for establishing audio signal processing of the device according to individuals' needs and/or purposes of the device, having an input and an output;
- providing at least one electrical/mechanical output converter with an input;
- providing a filter arrangement with adjustable high-pass characteristic and with a control input for the characteristic, further having an input and an output, and
- establishing the following operational connections: between the output of the input converter arrangement and the input of the filter arrangement,
- between the output of the filter arrangement and the control input,
- between the output of the filter arrangement and the input of the processing unit,
- between the output of the processing unit and the input of said at least one output converter.

Thereby, establishing the operational connections as mentioned needs clearly not be performed in a time sequence according the sequence of above wording. The operational connections may at least in part be established between units before they are assembled. Further, it must be emphasized that the output signal of the filter arrangement is just an improved "picture" of the acoustical signals, specific signal processing as for hearing aid devices is performed downstream the filter arrangement.

By this method there is provided a hearing device at which the high-pass characteristic is adapted to the acoustical situation.

In a most preferred embodiment of this method, the step of establishing operational connection of the output of the filter arrangement to the control input of the high-pass filter is performed via a statistics evaluating unit.

Definition

By the term "statistics evaluation unit" we understand a unit at which the behavior of the input signal is continuously monitored during a predetermined amount of time and there is formed over time a statistical criterion of such signal. Generically the output signal of the statistic-forming unit reacts with a time lag on momentarily prevailing characteristics of the input signal and has thus, generalized, a low-pass characteristic. In fact and as example such statistics-forming and evaluating unit may include LMS-type algorithms (Least Means Square) or other algorithms like Recursive Least Square (RLS) or Normalized Least Means Square (NLMS) algorithms.

In a proposed preferred embodiment the statistics-evaluating unit as provided determines the amount of energy of the signal fed to its input and being indicative of the energy at the output of the filter arrangement. Adjusting the high-pass filter characteristic is performed so as to minimize such energy. Thereby preferably one of the algorithms mentioned above is applied. By adjusting the high-pass characteristic, the cut-off frequency or frequencies and/or attenuation slope or slopes and/or low frequency attenuation may be adjustable. In a further embodiment the statistics forming and evaluation unit may estimate speech intelligibility of the output signal of the filter arrangement e.g. by computing the known speech intelligibility index or may estimate speech quality e.g. by computing segmental SNR.

In a far preferred embodiment of this method of manufacturing a hearing device the addressed high-pass filter arrangement is realized with a predictor unit, thereby preferably in that there is operationally connected to the output of the input converter arrangement a unit with a predictor unit in the following structure:

- an adjustable low-pass filter is provided with an input operationally connected to the output of the input converter arrangement and with an output operationally connected to one input of a comparing unit;
- there is operationally connected the output of the input converter arrangement substantially unfiltered with respect to frequency to a second input of the comparing unit;
- finally the output of the comparing unit is operationally connected to a control input of the low-pass filter for adjusting the characteristic of the low-pass filter. The control input of the low-pass filter establishes the control input of the high-pass filter arrangement, the output of the comparing unit is in fact the output of the high-pass filter arrangement.

In fact by means of the low-pass filter—with a preceding delay unit—there is established prediction of evolution of the filter input signal. By comparing the output signal of the low-pass filter with the instantaneously prevailing unfiltered signal, principally as occurring at the output of the input converter arrangement, there results a prediction difference between actual signal and predicted signal. As in a most preferred embodiment the low-pass filter is controlled from the output of the comparing unit via statistics evaluation unit, thus with a relatively long reaction time, the low-pass filter may be adjusted to minimize the difference of prediction and actual signal, nevertheless substantially maintaining the spectrum of acoustical normal signals as of speech and music substantially less attenuated. By means of high-pass filter characteristic adjustment the device manufactured becomes optimally adapted to time-varying wind situations.

In a further most preferred embodiment which is especially applied in combination with the above mentioned predictor technique there is provided an analog to digital conversion unit, which is operationally connected at its input side to the output of the input converter arrangement and operationally connected at its output side to the input of the addressed high-pass filter arrangement. Thereby, the said filter arrangement is construed as a digital filter arrangement.

A hearing device, which resolves the above mentioned object comprises a processor unit for establishing signal processing of the device according to individual needs and/or purpose of the device and has an input and an output. There is further provided at least one, for binaural devices two output electrical/mechanical converters with an output; further there is provided an acoustical/electrical input converter arrangement, a filter arrangement with adjustable high-pass characteristics. The input of the filter arrangement is operationally connected to an output of the input converter arrangement, which has a control input for adjusting the characteristic. The control input is operationally connected to the output of the filter arrangement, which is further operationally connected to the output converter via the processing unit.

Further preferred embodiments of such device are disclosed in the claims and the detailed description.

Under the first aspect of the present invention the above mentioned object is resolved by the method of reducing disturbances, especially wind disturbances, in a hearing device with an input acoustical/electrical converter arrangement, which generates a first electric output signal. Such method comprises the steps of filtering a signal which is dependent from the first electric signal with a variable high-pass characteristic so as to generate a second electric signal and by adjusting the variable characteristic of the high-pass filter by a third signal which is derived or dependent on the second signal. In a preferred mode generating the third signal in dependency of the second signal, includes performing a statistical evaluation on the second signal, and the third signal is generated in dependency of the result of the statistical evaluation. Thereby, in a still further preferred embodiment the energy of the second signal is evaluated and adjusting of the high-pass characteristic is performed so as to minimize this energy.

In a most preferred embodiment filtering is realized by predicting and forming a difference from a prediction result and an actual signal, whereby such difference is minimized by appropriately adjusting the filter characteristics. Further, in a preferred form of realizing the method it comprises the steps of

- low-pass filtering a signal dependent on the output signal of the input converter arrangement with an adjustable low-pass characteristic;
- comparing a signal dependent on the result of the low-pass filtering with a signal dependent from the output of the input converter substantially unfiltered with respect to its frequency content, and
- controlling the adjustable high-pass characteristic by controlling the adjustable low-pass characteristic.

Most preferably and especially in the last mentioned realization form, filtering and adjusting is performed digitally.

By the methods and the device according to the present invention under its first aspect as outlined above, irrespective whether an input acoustical/electrical converter arrangement has one or more than one acoustical/electrical input converters, wind noise is substantially canceled adaptively to the prevailing wind noise situation. Thereby, the signal components to be perceived as resulting from speech or music are substantially less attenuated than wind noise components. Whenever statistic forming and evaluation is performed on basis of a correlation, in a preferred embodiment the statistics forming and evaluation unit has a further input which is operationally connected to the input of the filter arrangement.

$2^{nd}$ Aspect

Under a second aspect the present invention deals most generically with improving signal-to-noise ratio at a hearing device. Thereby, and as will be explained under this second aspect this part of the invention is most suited to reestablish improved signal-to-noise ratio with respect to wind noise after a signal has been processed by high-pass filtering as was explained under the first aspect of the invention.

$1^{st}$ Sub-Aspect

Definition:

We understand under a "pitch" spectral peaks or peaks of narrow band-width. The fundamental and the spectral harmonics of a signal represent such "pitches".

A pitch-filter is comb-filter with a multitude of narrow pass-bands. It covers for a signal with fundamental and harmonic spectral lines all predominant lines or a predetermined number thereof with pass-bands.

Under a first sub-aspect of the present invention there is provided a method for manufacturing a hearing device, which comprises the steps of

- providing in a hearing device casing an acoustical/electrical input converter arrangement with an electric output;
- providing a pitch filter with adjustable pitch position and with a control input for the pitch position and further with an input and with an output;
- providing a pitch detector arrangement with an input and with an output, and
- establishing operational connection between the electric output of the input converter arrangement and the input of the pitch filter and between the output of the input converter arrangement and the input of the pitch detector arrangement, and further between the output of the pitch detector arrangement and the control input at the pitch filter.

We draw the attention on the WO 01/47335 with respect to pitch filter appliance, which accords with U.S. application Ser. No. 09/832,587.

Generically by means of the pitch detector discrete frequency components in the signals output from the input converter arrangement are detected and their specific frequencies monitored. By controlling pitch position of the pitch filter, i.e. spectral position of its pass-bands, to track the frequencies as monitored, SNR of pitches to noise in the processed signal is improved. Thereby, such pitch signal components are amplified relative to the spectrally intermediate noise.

It has to be emphasized again that establishing the operational connection in the method of manufacturing the hearing device with the pitch filter may be done at least in part well in advance of assembling the units to form the device whenever pitch detection is to be performed by a recursive method, in a preferred embodiment a further input of the pitch detector is operationally connected to the output of the pitch filter.

Under this first sub-aspect there is further provided a hearing device, which comprises

- an acoustical/electrical input converter arrangement with an output;
- a pitch filter with adjustable pitch position and a control input for said pitch position, further having an input and an output;
- a pitch detector unit with an input and with an output, whereby the output of the input converter arrangement is operationally connected to the input of the pitch filter, the output of the input converter arrangement is further operationally connected to the input of the pitch detector unit, and the output of the pitch detector unit is operationally connected to the control input at the pitch filter.

There is further provided a method for improving signal-to-noise ratio in a hearing device, which comprises pitch filtering a first signal dependent from an output signal of an acoustical/electrical input converter arrangement, monitoring the actual pitch frequencies of predominant frequency components within the first signal and adjusting the pitch position of the pitch filtering dependent on the actual pitch frequency positions as monitored.

As was already mentioned above, by the technique according to the present invention under its first aspect the signal components to be improved as resulting from speech or music may be attenuated to some extent by high-pass filtering. By combining the present invention under the just addressed 1st sub-aspects with the invention according to the first aspect SNR with respect to wind noise is further improved. This is realized by first operating or performing the invention with adjustable high-pass filtering upon a signal dependent from the output signal of the input converter arrangement and operating on a signal dependent on the output signal of such high-pass filtering the technique according to the just addressed $1^{st}$ sub-aspect, namely of pitch filtering with controllably adjustable pitch frequency position.

$2^{nd}$ Sub-Aspect

Under the second aspect of the present invention and thereby under a second sub-aspect thereof there is provided improved SNR ratio especially with respect to speech signals.

With respect to spectrum, one characteristic of speech signals is that the fundamental is approximately between 50 Hz and 1 kHz.

Under this second sub-aspect there is provided a method for manufacturing a hearing device comprising:

providing in a hearing device casing an acoustical/electrical input converter arrangement with an electric output;

providing an adding unit with at least two inputs;

providing a first band pass filter unit with an input and with an output and with a band selected to pass selected harmonics of speech;

a non-linear modulation unit with an input and with an output;

a second band pass filter unit or a low-pass filter unit with an input and with an output and with a pass-band selected on a different harmonics of speech, and establishing the following operational connections:

from the output of the input converter arrangement to one input of the adding unit without substantial frequency filtering;

from the output of the input converter arrangement to the input of the first band pass filter unit without substantial frequency filtering;

from the output of the first band pass filter unit to the input of the non-linear modulation unit and from the output of the non-linear modulation unit to the input of the second band pass or low-pass filter unit and finally from the output of the second band pass or low-pass filter unit to the second input of the adding unit.

By manufacturing a hearing device as stated the following is realized:

On the output signal of the input converter arrangement speech signals shall be present also and especially with their fundamental components. Due to band-restricted noise as e.g. and especially wind noise, SNR greatly varies considered along the pitches of speech. By selecting at the first band pass filter unit a pass-band according to a harmonics of speech at which a good SNR prevails and subjecting such band filtered signal to a non-linear modulation, all harmonics are regenerated with good SNR. From all the harmonics generated by the non-linear modulation one or more than one band is selected by respective one or more than one second band pass filters or a low-pass filter. The resulting, remaining selected harmonics may first be amplified if desired and are added to the original fundamental and/or harmonics. Thus, in the resulting signal pitches of speech with originally low SNR are improved with respect to that SNR.

In a preferred mode of the manufacturing method under this second sub-aspect, an analog to digital conversion unit is provided with an input and with an output, and there is established the operational connection between the output of the input converter arrangement and the one input of the adding unit as well as to the input of the first band pass filter via such analog to digital conversion unit. Thereby, the filter units, the non-linear modulation unit and the adding unit are realized as digital units.

Still under the second sub-aspect of the second aspect of the present invention there is further proposed a hearing device which comprises an acoustical/electrical input converter arrangement with an output, a first band pass filter unit with an input and with an output and with a band selected to pass selected harmonics of speech, a non-linear modulation unit with an input and with an output, a second band-pass filter or low-pass filter unit selected to pass different selected harmonics having an input and an output. There is further provided an adding unit with two inputs and with an output. The output of the input converter arrangement is operationally connected to a first input of the adding unit, substantially without frequency filtering, the output of the input converter arrangement is further operationally connected to the input of the first band pass filter unit, whereby the output of that unit is operationally connected to the input of the non-linear modulation unit. The output of the non-linear modulation unit is operationally connected to the input of the second band pass filter or of the low-pass filter unit, the output of which being operationally connected to the second input of the adding unit.

Again, preferred embodiment of that device are disclosed in the claims and the specific description.

Under this second sub-aspect there is further proposed a method for increasing signal-to-noise ratio at a hearing device and especially with respect to speech signals with an acoustical/electrical input converter generating a first electric signal, which comprises the steps of band pass filtering a signal dependent on said first signal to generate a band pass filtered signal with harmonic components of speech;

modulating said filtered signal at a non-linear characteristic to generate an output signal with a re-increased number of harmonic components of speech;

band- or low-pass filtering said output signal with said re-increased number of harmonic components to generate a further signal with selected harmonic components and superposing said further signal to a signal dependent on said first electric signal.

Again the techniques according to this second sub-aspect of the present invention are ideally suited to be combined with the technique as taught under the first aspect of the present invention as disclosed in the claims and the detailed description.

$3^{rd}$ Aspect

As was mentioned above prior art electronic approaches to quit with wind noise at hearing devices with beamforming ability disable such ability whenever wind noise is too large.

Under the third aspect of the present invention a technique is proposed on one hand to substantially cancel wind noise and on the other hand to substantially maintain beamforming ability.

According to the invention under the third aspect there is proposed a method of manufacturing an acoustical device, especially a hearing device, which comprises the steps of providing in a device casing an acoustical/electrical input converter arrangement generating at an output an electrical signal in frequency or frequency band domain with a beamformer amplification characteristic of acoustical signals impinging on said arrangement in dependency of impinging angle with which the acoustical signals impinge thereon and with a predetermined frequency roll-off characteristic of the beamformer characteristic.

There is further provided a normalizing unit with in input and with an output and there is established an operational connection of the output of the converter arrangement and the input of the normalizing unit. Further, there is provided a memory unit with the predetermined roll-off characteristic stored therein. Still further, there is provided a comparing unit.

There is established an operational connection between the output of the normalizing unit and one input of the comparing unit as well as between the output of the storing unit and the second input of the comparing unit.

There is additionally provided a controlled selection unit with a control input, an input as well as an output and there is established an operational connection between the output of the converter arrangement and the input of the selection unit as well as between the output of the comparing unit and the control input of the selection unit. The selection unit is controlled to attenuate frequency components of the electric signal input to its output, the normalized values of which non-resulting in a predetermined comparison result at the comparing unit differently than such components for which said comparison does result in the predetermined result.

Although it is absolutely possible to provide an acoustical/electrical input converter arrangement with a single acoustical/electrical input converter as of a directional microphone with an intrinsic beamformer characteristic, also in this case it is preferred to provide at the input converter arrangement at least one second acoustical/electrical input converter.

This is clearly also the case if the beamformer characteristic is generated, as known, on the basis of the output signals of two or more than two distinct acoustical/electrical converters.

Therefore, in a most preferred embodiment of this method, the input converter arrangement as provided has at least two input acoustical/electrical converters.

Whenever an input converter arrangement is provided with at least two acoustical/electrical converters, in a most preferred embodiment the input arrangement is provided with at least two time domain to frequency or to frequency band domain conversion units. One of these conversion units is operationally connected to one of the at least two input converters, the second one of these conversion units to a second one of the at least two input converters. Thereby, in fact before beamforming-processing of the output signals of the at least two input converters, the output signals of these input converters are time domain to frequency or frequency band domain converted.

On the other hand whenever beamforming is performed intrinsically by an input converter with directional characteristic, the output signal of that converter as well as the output signal of a further input converter is time domain to frequency or frequency band domain converted.

In a further preferred embodiment there is provided the beamformer unit with a control input and there is established an operational connection between the output of the comparing unit and the control input of the beamformer unit.

By establishing an operational control connection between the output of the comparing unit and a control input of the beamformer unit it becomes possible to selectively control the beamforming ability of the beamformer unit according to evaluation of the comparing results as mentioned above.

Further, in a preferred embodiment and whenever the input converter arrangement as provided has at least two input acoustical/electrical converters there is established an operational connection between an output of one of these at least two input converters via a further output of the input converter arrangement, and a further input of the normalizing unit for receiving there a normalizing signal.

In a further preferred mode thereof there is interconnected between the output of the said one input converter the further input of the normalizing unit, a time domain to frequency or frequency band domain conversion unit, so that the normalizing signal applied to the further input of the normalizing unit is in frequency or frequency band domain. Thus, normalizing signals are applied frequency- or frequency band-specifically.

In a further preferred mode, varying attenuation at the selection unit is performed softly. It is preferred not to binaurally switch from maximum attenuation, e.g. leading to zero level, to minimum attenuation e.g. leading to maximum level. Therefore, in a further preferred embodiment there is provided a signal transfer unit with a low-pass-type signal transfer between its input and output, and the operational connection between the output of the comparing unit and the control input of the selection unit is provided via such signal transfer unit. At the selection unit, preferably, frequency or frequency band-specific attenuation is adjustable continuously of substantially continuously as in small steps, controlled by the control signals.

In a most preferred embodiment for manufacturing a hearing device at which wind noise is optimally canceled the predetermined result established is when said normalized values are at most equal to roll-off characteristic values at the respective frequencies considered. There is thus checked, whether the normalized beamformer output signals at the specific frequency is at most equal to the value of the roll-off characteristic at that frequency, and if it is this frequency component is passed to the output by the selection unit, if it is not the respective component becomes attenuated.

Accordingly there is provided under this third aspect of the invention, an acoustical, thereby especially a hearing device which comprises an input acoustical/electrical converter arrangement, which has an output and generates an output signal thereat with a beamformer amplification characteristic having a predetermined frequency roll-off characteristic. This output signal is in the frequency or in the frequency band domain. There is further provided a normalizing unit with an input which is operationally connected to the output of the input converter arrangement and with an output which is operationally connected to one input of a comparing unit. There is further provided a memory unit with a predetermined roll-off characteristic stored therein, an output of which being operationally connected to a second input of the comparing unit. A control selection unit with a control input and a signal input operationally connected to the output of the input converter arrangement has its control input operationally connected to the output of the comparing unit, thereby controllably attenuating frequency components in a signal input to a signal output, for which comparison has not shown up a predetermined result, thereby performing said attenuating differently than upon components for which the comparison result has affirmatively resulted in the predetermined result.

Preferred embodiments of such device are disclosed in the claims as well as in the detailed description.

Under this third aspect there is further provided a method for at least substantially canceling wind disturbances in an acoustical device, thereby especially in a hearing device, which has an input acoustical/electrical converter arrangement, which generates at an output an electric signal in frequency or in frequency band domain with a beamformer amplification characteristic with respect to impinging angle with which acoustical signals impinge upon the arrangement and with a predetermined frequency roll-off characteristic. The method comprises the steps of normalizing a signal which depends on the electric signal in frequency or frequency band domain, comparing frequency or frequency band specifically the normalized signals with respective values of the frequency roll-off characteristic and attenuating frequency signal components of the electrical signal in dependency of the results of the comparing operation.

Here too, preferred embodiments of this method are disclosed in the claims as well as in the detailed description.

$4^{th}$ Aspect

As was mentioned above in prior art attempts wind noise canceling was established in hearing devices with beamforming abilities just by switching off such beamformer ability and going on by processing acoustical signals substantially based on an omnidirectional characteristic.

Under the present fourth aspect an approach has been invented, according to which the beamformer ability is only attenuated up to complete switch off at those frequencies or frequency bands, where significant disturbances are present. More generically, nevertheless departing from the above mentioned wind noise canceling problem, a technique is proposed, by which beamforming abilities at an acoustical device may frequency or frequency band selectively be reduced up to switching such beamforming ability off.

A method of manufacturing a beamforming device, thereby especially an acoustical device and even more specifically a hearing device, comprises providing in a casing of the device a beamformer unit which operates in frequency or in frequency band domain. At such beamformer unit there is provided a control input, which frequency or frequency band selectively controls beamforming of the beamformer unit. There is further provided a control unit which has an output for frequency or frequency band selective control signals, and there is established an operational connection between the output of the control unit and the said control input.

With an eye on specific noise canceling purposes the method comprises providing the control unit with a frequency or frequency band selective noise detector.

Thereby, with an eye on wind noise handling, the control unit is provided having a wind noise detector. Thereby, it must be established that wind noise is in fact a band-specific noise, which is detected by a respectively tailored frequency- or frequency band-selective noise detector.

In a most preferred mode there is provided the beamformer unit with at least two input converters, each having an output. There is further provided at least one controlled frequency- or frequency band-specific attenuation unit with a frequency or frequency band selective attenuation control input, further with an input and an output. For beamforming there is further provided a beamformer processing unit, which has at least two inputs and an output.

Operational connections are established between an output of one input converter via the attenuation unit to one input of the processing unit. Thereby, clearly both outputs of the at least two input converters may be operationally connected to the inputs of the processing unit via such an attenuation unit.

In any case there is established an operational connection between the output of a second input converter and the second input of the processing unit. Further, an operational connection is established between the output of the control unit and the control input of the attenuation unit.

Under this fourth aspect of the present invention there is further proposed a beamforming device, preferably an acoustical device, most preferably a hearing device, which comprises a beamformer unit, which is operating in frequency or frequency band domain, and which has a control input for frequency or frequency band selectively controlling beamforming. There is further provided a control unit, which has an output for frequency- or frequency band-specific control signals, which is operationally connected to the said control input.

Preferred embodiments of such method and device are disclosed in the claims as well as in the detailed description.

Still under the fourth aspect of the present invention it is proposed a method for controlling beamforming—especially for acoustical appliances, thereby most preferably for hearing device appliances—which method comprises performing beamforming in frequency or frequency band domain and controlling beamforming frequency- or frequency band-selectively.

Again preferred embodiments of this method are disclosed in the claims as well as in the detailed description.

The invention under the presently discussed fourth aspect, namely of selectively controlling beamforming, may and is preferably used and applied when realizing the present invention under its third aspect:

According to the third aspect, spectral components of a signal are determined and selected (comparison with roll-off characteristic) which are more noise disturbed than others. Once such selection has been made, the same selection may be applied to the presently proposed frequency or frequency band selective attenuation of beamforming. In such a combination not only that selected frequency of frequency band components are attenuated with a preferred slowly varying attenuation, but additionally beamforming in frequencies or frequency bands of those components is, preferably steadily or slowly, attenuated, resulting finally and for those specific frequency or frequency bands considered, in beamforming being switched off, thereby transiting to omnidirectional amplification characteristic for those frequencies or frequency bands.

$5^{th}$ Aspect

As the skilled artisan is perfectly aware of, it is a need in acoustical devices and especially hearing devices to detect whether wind noise is present to a higher amount than desired so as to take appropriate measures in controlling such device. This is true for such devices irrespective whether their input acoustical/electrical converter arrangement is based on acoustical signal reception by means of one single acoustical/electrical input converter or by means of more than one such input converters, as for two or more converter beamforming.

Under this fifth aspect the present invention proposes a novel and most advantageous wind noise detection technique, which may be applied especially irrespective of the concept of the input converter arrangement with respect to number of acoustical/electrical converters.

This object is resolved by a method of manufacturing an acoustical device, which comprises providing an acoustical/electrical input converter arrangement into a casing of the device, whereby the arrangement has an output. There is further provided a calculation unit, which has an input and an output. Operational connection is established between the output of the converter arrangement and the input of the calculating unit.

The calculation unit is programmed to calculate from a signal input the frequency coordinate values of the balance point of a surface defined by the spectrum of the said signal in a predetermined frequency range. The calculating unit thereby generates an output signal in dependency of the said coordinate value, which is indicative of wind noise.

In a most preferred embodiment the calculation unit as provided is programmed to continuously average the coordinate values of the addressed balance point over a predetermined amount of time and/or to continuously calculate the variance of the coordinate value over a predetermined amount of time. Thereby, preferably generating of the output signal comprises generating such signal at least in dependency of such averaging and/or the said variance.

Preferred embodiments of this method are disclosed in the claims as well as in the detailed description.

Under this fifth aspect of the invention there is further proposed an acoustical device, which comprises an acoustical/electrical input converter arrangement with an output, a calculation unit with an input being operationally connected to the output of the converter arrangement. The calculation unit is programmed to calculate from an input signal the frequency coordinate value of the balance point of a surface of the spectrum in a predetermined frequency range. The calculation unit further generates an output signal in dependency of the found coordinate value, which output signal is indicative of wind noise.

Preferred embodiments of this device are disclosed in the claims as well as in the detailed description.

There is further proposed under this fifth aspect of the present invention a method of detecting wind noise at an acoustical device with acoustical/electrical conversion to generate an electric signal. Such method comprises the step of electronically calculating the frequency coordinate value of the balance point of the spectrum of the signal within a predetermined frequency range and generating a wind noise indicative signal in dependency of this value.

Preferred embodiments of this method are apparent to the skilled artisan from its disclosure in the claims as well as the detailed description.

BRIEF DESCRIPTION OF THE SEVERAL VIEWS OF THE DRAWINGS

The invention shall now be described in more details and referring to examples and with the help of figures.

The figures show by examples.

DETAILED DESCRIPTION OF THE INVENTION

Figure 1:
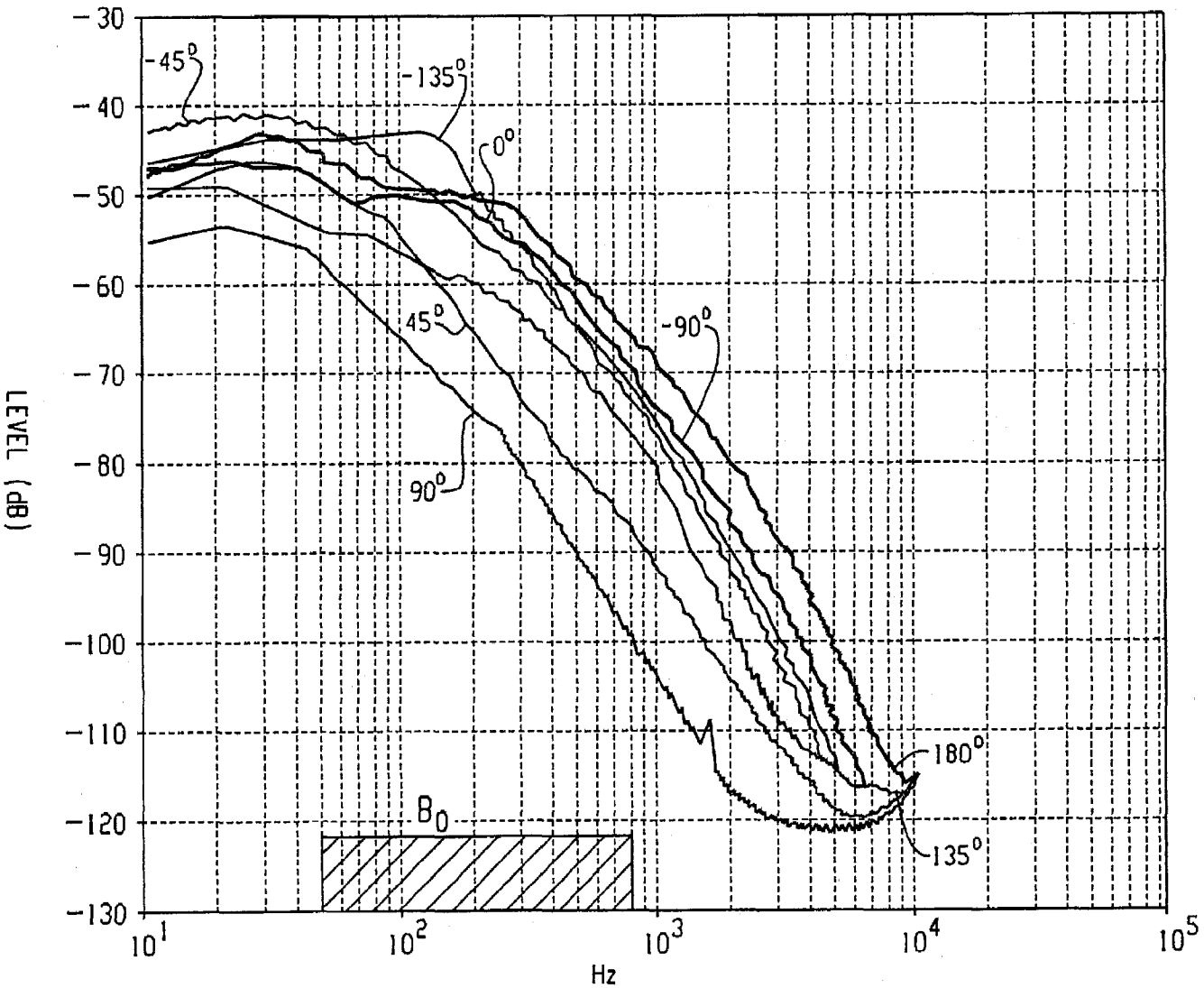
FIG. 1 wind spectra in dependency on wind direction.

In FIG. 1 there is shown wind noise spectral characteristic for a wind speed of 10 m/s at an individual head with no hair. Therefrom it might be seen that wind noise spectrum varies significantly as wind direction alters with respect to a device registering such noise. Nevertheless, wind noise spectrum is band-limited.

In FIG. 1 there is further schematically introduced the approximate frequency band for human speech fundamental pitch.

1st Aspect

Figure 2:
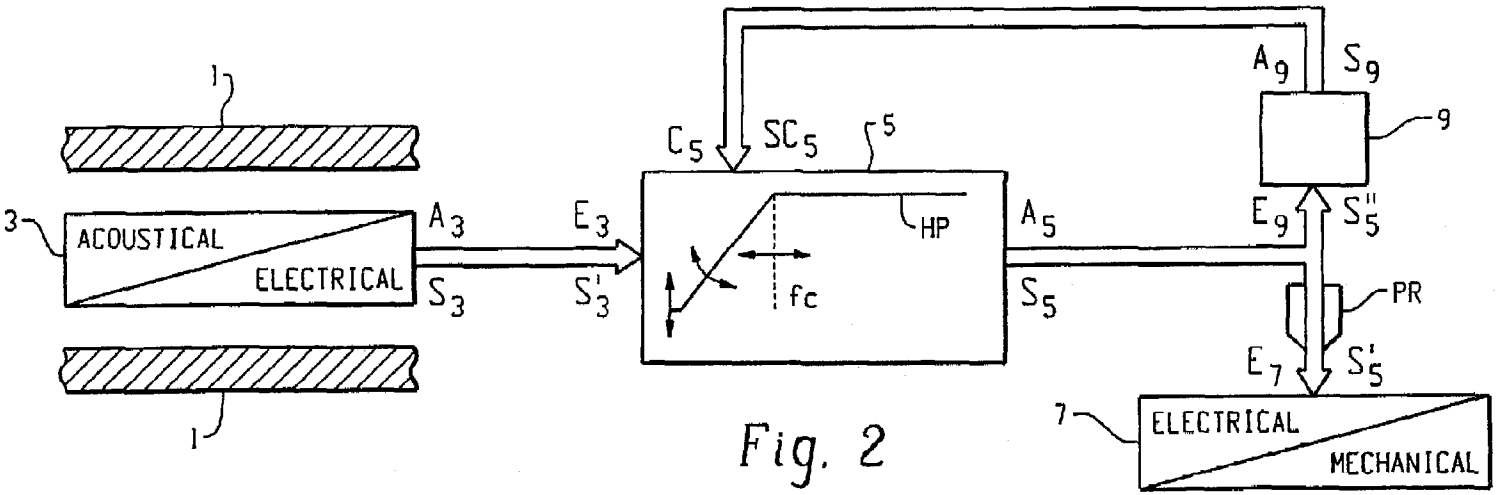
FIG. 2 by means of a simplified schematic functional block/signal flow representation a hearing device operating according to the method of reducing disturbances and manufactured by a method, all according to the present invention under its first aspect.

In FIG. 2 there is shown, by means of a simplified schematic signal-flow/functional block diagram, an acoustical device, especially a hearing device as manufactured according to the present invention under its first aspect. The device as shown performs the method according to the present invention under this first aspect.

The device comprises, assembled into a schematically shown device casing 1, an input acoustical/electrical converter arrangement 3. Such arrangement 3 may comprise one or more than one specific acoustical/electrical converters as of microphones. It provides for an electric output at $A_3$, whereat the arrangement 3 generates an electric signal S3. Possibly via some signal processing, as e.g. pre-filtering and amplifying (not shown), a signal $S_3'$ dependent on $S_3$ is fed to input $E_5$ of a high-pass filter arrangement 5. The filter arrangement 5 has a control input $C_5$ for control signals $SC_5$ which, applied to $C_5$, control the high-pass characteristic as shown in block 5 and with respect to its one or more than one corner frequencies $f_c$, its low-frequency attenuating, one or more than one attenuation slopes. The high-pass filtered signal $S_5$ output at an output $A_5$ and is operationally connected, possibly via further signal processing, especially as will be described in context with the second aspect of the present invention, to one or more than one electrical/mechanical output converter arrangements 7 of the device.

With an eye on manufacturing such device all the units as of 3, 5, 9, 7 will be assembled in a casing, whereby they need not be all assembled in the same casing 1, wherein the input converter arrangement 3 is provided. Further, the addressed operational signal connection may be established during or after assembling of the device, some or even all of them may nevertheless be preassembled as by combining units by an integration technique.

A signal $S_5''$ dependent on signal $S_5$ as output by high-pass filter unit 5, possibly made dependent via additional signal processing as e.g. amplification, is fed from the output $A_5$ to an input $E_9$ of a unit 9, which most generically performs upon the signal $S_5''$ a statistical evaluation. The statistic-forming unit 9 performs registering and evaluating selected characteristics of signal $S''_5$ over time. There results from performing such statistical evaluation that the signal $S_9$ has a low-pass-type dependency from signal $S''_5$ input to unit 9. The output signal $S_9$ at output $A_9$ is operationally connected, possibly by some intermediate additional signal processing, as e.g. amplification or filtering, to the control input $C_5$ as a control signal $SC_5$ and controls the high-pass filter characteristic HP of filter unit 5. As shown in FIG. 2, whenever the improved audio signal as of $S_5$ has to be further processed so as to take individual hearing improvement needs into account, so as customary for hearing aid devices, such processing is performed downstream $S_5$ at a processor unit PR.

Figure 3:
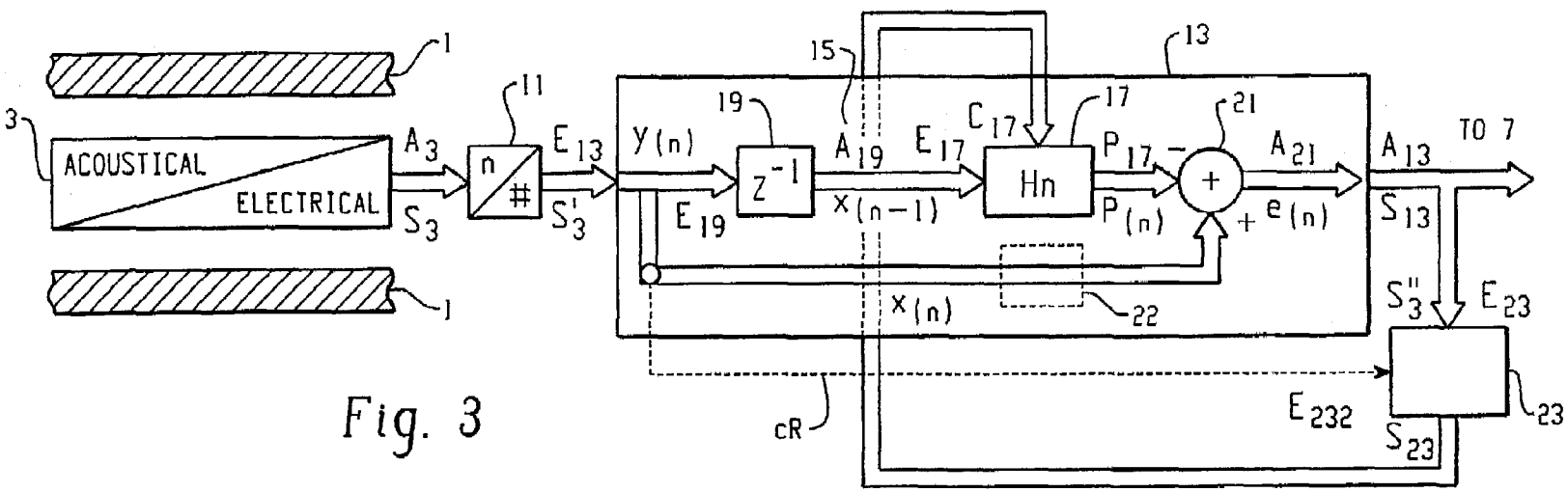
FIG. 3 in a more detailed, but still simplified schematic functional block/signal-flow representation, a preferred embodiment of the invention of FIG. 2.

In spite of the fact that functioning of the most generic embodiment as of FIG. 2 might be better understood when reading the following explanations to FIG. 3 with respect to a preferred form of realization, it is already clear from the embodiment of FIG. 2, that, with an eye on FIG. 1, the high-pass filter arrangement 5 provides for attenuating wind noise has its corner frequency $f_c$ set and adjusted adjacent the upper end of the wind noise spectra, i.e. somewhere between 1 kHz and 10 kHz. The unit 9 generates the output signal $S_9$ which does not vary in time on the basis of short-term single signal variation of $S''_5$, but only with long-term or frequency variations and thereby controls the filter characteristics of filter arrangement 5 to optimize attenuation of such long-term or frequent variations, i.e. signal components as resulting from wind noise. Signal components in $S''_5$ resulting from normal acoustical signals not to be canceled as from speech or music and appearing in $S''_5$ with spectra rapidly changing in time will substantially not be canceled by the filter arrangement 5, at least substantially less than steadily or slowly varying or repeatedly occurring signal components as caused by wind noise.

In FIG. 3 there is shown a most preferred form of realization of the device and method as disclosed with the help of FIG. 2 and accordingly of manufacturing a respectively operated hearing device.

Thereby, signal processing is realized by digital signal processing. Functional blocks and signals, which have already been explained in context with FIG. 2 are shown in FIG. 3 with the same reference numbers. The output signal $S_3$ of input converter arrangement 3 is analog/digital converted by an analog/digital conversion unit 11. The filter arrangement 5 as of FIG. 2 is realized by a digital filter unit 13. The signal $S_3'$ as input according to FIG. 2 to the filter arrangement 5 is now digital and applied to the input $E_{13}$ of digital HP-filter unit 13. The high-pass—HP—filter arrangement 5 is realized making use of a predictor 15. It comprises a time delay unit 19 and a low-pass digital filter 17, which may be of FIR or IIR type and may be of any particular implementation, e.g. of lattice, direct form, etc. structures.

Signal samples x(n) from input signal $S'_3$ are input to time delay unit 19, at its input $E_{19}$. Delayed samples x(n−1) at output $A_{19}$ of unit 19 are input at input $E_{17}$ to low-pass filter unit 17, whereat the samples are low-pass filtered to generate at an output $A_{17}$ an output signal p(n). The units 19 and 17 represent as known to the skilled artisan a predictor and the output signal p(n) is the prediction result.

The prediction result p(n) is compared by subtraction at a subtraction unit 21 with the actual sample x(n) of the actual input signal according to $S'_3$. Thereby, the output $A_{17}$ of filter unit 17 is operationally connected to one input of comparing unit 21, the other input thereof being operationally connected to the input $E_{13}$ of high-pass filter unit 13 without substantial frequency filtering. A matching time delay unit may be introduced in the connection from input $E_{13}$ to the one input of unit 21 as shown in dashed lines at 22.

At the output $A_{21}$ of the comparing unit 21 the predictor error signal e(n) is generated, which is indicative for the deviation of the prediction result p(n) from actual signal x(n).

The low-pass filter unit 17 has a control input $C_{17}$. A control signal applied to that input $C_{17}$ adjusts the coefficients and/or adaption time constants of the digital filter unit 17. The input $C_{17}$ of low-pass filter unit 17 represents, with an eye on FIG. 2, the control input $C_5$ of the high-pass filter arrangement 5.

The signal $S_{13}$ according to the predictor error e(n), is on one hand and as was explained in context with FIG. 2 operationally connected to at least one electrical/mechanical output converter (not shown here) of the device.

Further, a signal $S_{13}''$, which depends, possibly via some additional signal processing as e.g. amplification, to signal S13 is input to input $E_{23}$ of statistics forming and evaluating unit 23. In a most preferred embodiment unit 23 monitors the overall energy of the signal $S''_{13}$. The control signal $C_{17}$ to the low-pass filter unit 17 is made dependent from the output signal $S_{23}$ of unit 23, which is representing the overall energy of the input signal $S_{13}''$. Thereby, in fact in the sense of a negative feedback control loop via control input $C_{17}$, the adaption time constants and/or the filter coefficients of filter unit 17 are adjusted to minimize the energy of signal $S''_{13}$ and thus of $S_{13}$. Thereby, LMS type algorithms or other algorithms like Recursive Least Square (RLS) or Normalized Least Means Square (NLMS) algorithms may be used. In a different embodiment the unit 23 may estimate speech signal intelligibility at signal $S_{13}''$ e.g. by computing from that signal speech an intelligibility index. In a still further embodiment, unit 23 may estimate speech signal quality e.g. by segmental SNR computation.

If unit 23 performs evaluation of statistics based on a correlation, and as shown in dotted line at CR in FIG. 3, the input $E_{13}$ may be operationally connected to a further input $E_{232}$ of statistics forming and evaluating unit 23.

Although the embodiment of FIG. 3, as has been explained, operates in time domain, the same principal may be realized in frequency domain.

As the filter unit 17 is adjusted to minimize the energy of e(n), the predictor 19, 17 will reconstitute the predictable parts of signal x(n) as accurately as possible. Therefore, the prediction error e(n) will only contain non-predictable parts of signal x(n). Because wind noise constitutes substantially predictable components of x(n) and, in opposition, signals to be perceived as especially from speech or music, are non-predictable parts of x(n), the wind noise components are canceled from the output signal $S_{13}$, finally acting upon the output converter 7, whereas speech or music signals, as non-predictable signals, are passed by $S_{13}$ to the converter 7.

Experiments have shown that the order of the digital filter 17 may be low, preferably below $5^{th}$ order FIR. The resulting filter is thus cheap to implement and still very efficient. Such low-order filter has additionally the advantage of allowing relatively fast adaption times, thus enabling tracking fluctuations of wind noise accurately.

Further, it has been found that by the disclosed technique, especially according to FIG. 3, wind noise is substantially more attenuated than target signals like speech or music, thereby improving comfort and signal-to-noise ratios.

The skilled artisan being taught the invention under the first aspect may find other adaptive filter structure to realize the principal technique as disclosed.

2nd Aspect

Under this second aspect of the present invention two techniques have been invented, one generically improving signal-to-noise ratio at an acoustical device, especially hearing device, the other one doing so especially with an eye on speech target signals. As will be shown both techniques are considered per se and self-contained as inventions, but are most preferably combined with the teaching under the first aspect of the invention to further improve low-frequency target signals within a frequency band covered by wind noise spectrum.

1st Sub-Aspect

Figure 4:
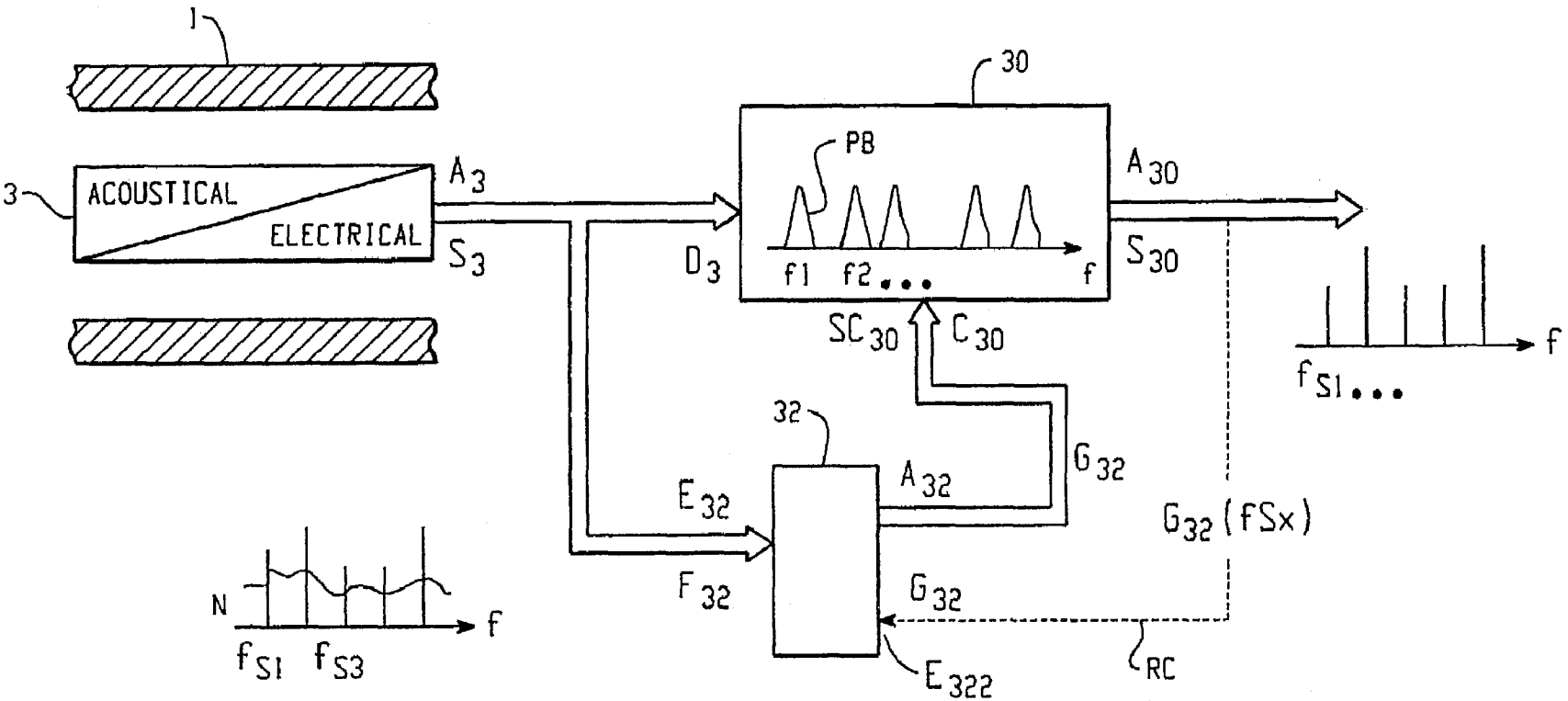
FIG. 4 in a simplified schematic functional block/signal-flow representation an acoustical device which operates the method for improving signal-to-noise ratio and is manufactured by a method, all according to the present invention under a first sub-aspect of a second aspect.

FIG. 4 shows, by means of a simplified, schematic functional block/signal-flow diagram an acoustical device, especially a hearing device as manufactured by the present invention, thereby disclosing a hearing device according to the present invention, which performs the signal processing method according to the present invention, namely under the first sub-aspect of its second aspect.

According to FIG. 4 an input acoustical/electrical converter arrangement 3, which again may be equipped with one or more than one input acoustical/electrical converters as of microphones, provides at its output $A_3$ the signal $S_3$.

A signal $D_3$ which is dependent from $S_3$, especially preferred dependent by having been processed by an arrangement as was disclosed in context with FIGS. 2 and 3 and thus the first aspect of the present invention, is input to a pitch filter unit 30.

The pitch filter unit 30 is a comb filter as schematically shown within the block of unit 30 with a multitude of pass-bands PB. The filter characteristic of the pitch filter unit 30 is adjustable by a control signal $SC_{30}$ applied to a control input $C_{30}$. Thereby, especially the spectral positions as of $f_1$, $f_2$ . . . of the pass-bands PB are adjusted. A further signal dependent on the signal $S_3$, preferably with the same dependency as $D_3$. $F_{32}$, is input to an input $E_{32}$ of a pitch detector unit 32.

Whenever signal $F_{32}$ has pitch components as schematically shown at the frequencies $f_{S1}$ . . . , $F_{S3}$ exceeding noise spectrum N the pitch detector unit 32 detects the pitch frequencies $f_{Sx}$ and generates at its output $A_{32}$ an output signal $G_{32}$ which is indicative of spectral pitch position, i.e. of the pitch frequency $f_{Sx}$ of input signal $F_{32}$.

The output $A_{32}$ of pitch detector unit 32 is operationally connected to the control input $C_{30}$ so as to apply there the control signal $SC_{30}$ which is indicative of spectral pitch positions within signal $F_{32}$ and thus $S_3$.

At the adjustable pitch filter unit 30 the spectral positions of the pass-bands PB are thereby adjusted to coincide with the spectral pitch position $f_{Sx}$ in signal $F_{32}$ and thus in signal $S_3$, so that at the output $A_{30}$ of the adjustable pitch filter unit 30 a signal $S_{30}$ is generated, whereat the noise spectrum according to N is substantially attenuated, whereas the pitch components are passed.

If the pitch detector unit 32 operates on the basis of a recursive detection technique, a further input $E_{322}$ of unit 32 is operationally connected to the output $A_{30}$ of pitch filter unit 30.

This is shown in FIG. 4 by dashed lines at RC.

As not shown in FIG. 4 again the output signal $S_{30}$ is further processed by the device specific signal processor, especially to consider individual needs with respect to hearing improvement as was addressed in context with FIG. 2 and is finally operationally connected via such possible signal processing to at least one output electrical/mechanical converter 7.

By the technique under this sub-aspect, signal-to-noise ratio of the device is significantly improved.

Again with an eye on the method for manufacturing such a device, establishing operational connections between the respective units may at least to a certain extent be done before assembling such units to the one or more than one device casings, one of them being schematically shown in FIG. 1 at reference No. 1.

Figure 5:
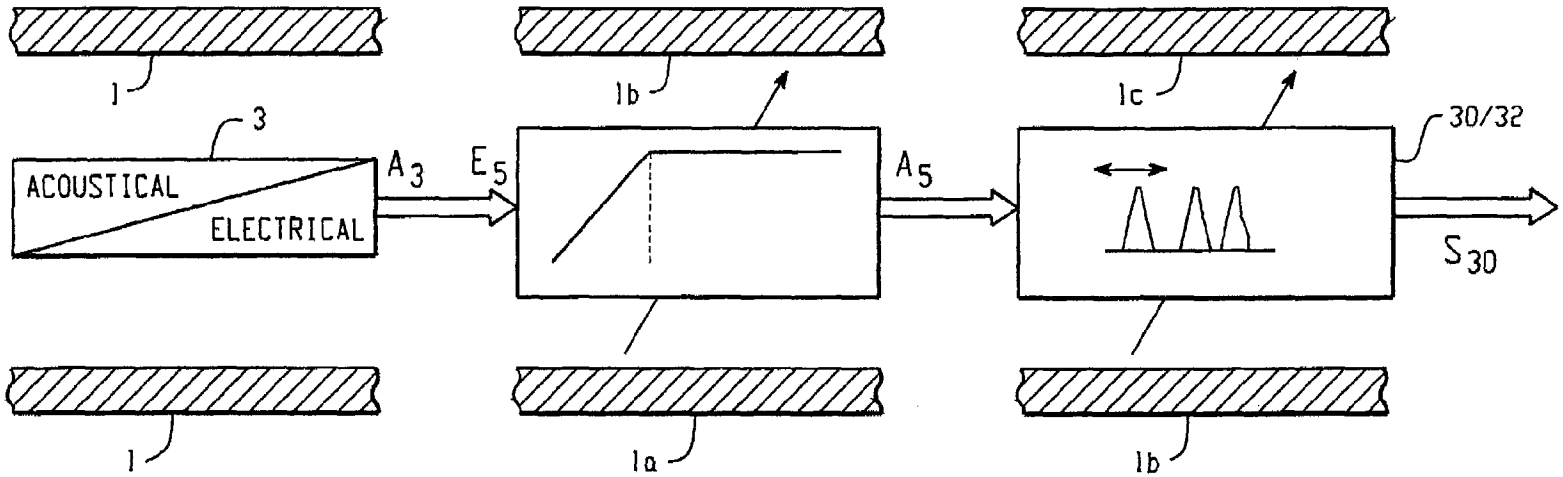
FIG. 5 in a simplified schematic functional block/signal-flow representation a preferred embodiment combining the invention under its first aspect and the invention under the first sub-aspect of the second aspect.

The teaching according to this sub-aspect of the present invention may ideally be combined with the teaching of the present invention under its first aspect. This is schematically shown in FIG. 5. Thereby, the output $A_3$ of the input converter arrangement 3 is operationally connected, again preferably via an analog to digital conversion unit (not shown), to the input $E_5$ of filter arrangement 5, preferably realized according to FIG. 3, the output thereof, $A_5$, being operationally connected to the adjustable pitch filter system 30/32 as of FIG. 4. Thereby, the pitch filter unit 30 in a preferred mode of realization will especially be tailored with pass-bands within the wind noise spectrum as of FIG. 1, thereby to reestablish pitches, i.e. frequency components of the tracking signals especially of speech or music signals in that spectral band.

Nevertheless, the technique according to this sub-aspect, i.e. applying a controllably adjustable pitch filter, may be more generically used to reduce signal-to-noise ratio with respect to tracking signals especially at acoustical devices.

2nd Sub-Aspect

The teaching according to this second sub-aspect is more specifically directed on improving speech signals.

Figure 6:
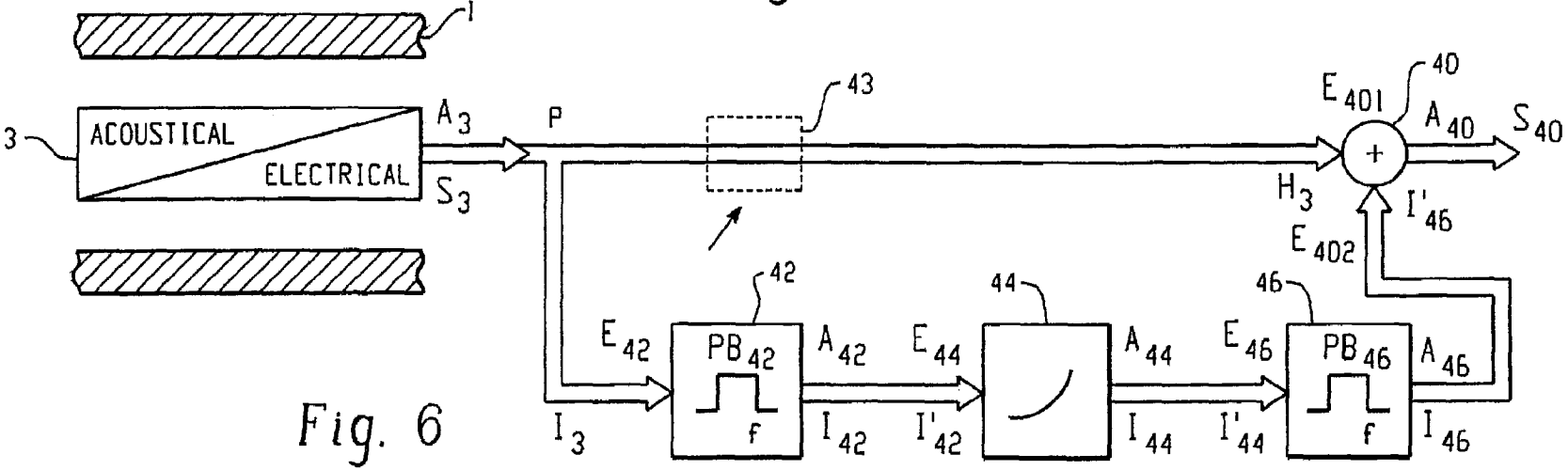
FIG. 6 an acoustical device operating a method for increasing signal-to-noise ratio and manufactured by a method all according to the present invention under a second sub-aspect of its second aspect.

According to FIG. 6 an input acoustical/electrical converter arrangement 3 has an output $A_3$. A signal $H_3$ which depends from the signal $S_3$ output from input converter arrangement 3 is fed to a first input $E_{401}$ of an adding unit 40. At a point P along signal transfer path between $S_3$ and $H_3$ a signal $I_3$ is branched off. The operational connection of the output $A_3$ to the branching point P is thereby, in a preferred mode, established via the high-pass filtering unit as was explained with the help of FIGS. 2 and 3 and in context with the first aspect of the present invention as will be explained later. With respect to frequency content there occurs substantially no frequency filtering in the signal transfer path between branching point P and $E_{401}$, which would be different from such filtering of signal $I_3$. The signal $I_3$ is input to an input $E_{42}$ of a band-pass filter unit 42 with a pass-band $PB_{42}$. At the output $A_{42}$ of band-pass unit 42 an output signal $I_{42}$ is operationally connected to an input $E_{44}$ of a non-linear modulation unit 44.

At unit 44 the input signal $I'_{42}$ is modulated at a nonlinear e.g. parabolic characteristic. The modulation result signal $I_{44}$ at output $A_{44}$ is operationally connected to input $E_{46}$ of a second band-pass filter or of a low-pass filter unit 46, without significant frequency filtering.

Unit 46 generates at its output $A_{46}$ a signal $I_{46}$. A signal $I'_{46}$ dependent from the signal $I_{46}$ without significant frequency filtering is applied to the second input $E_{402}$ of adding unit 40, generating at its output $A_{40}$ the signal $S_{40}$. This output signal $S_{40}$ is (not shown) operationally connected to further signal processing units of the acoustical device, especially the hearing device, which accomplishes device-specific and/or user-specific signal processing.

Figure 7:
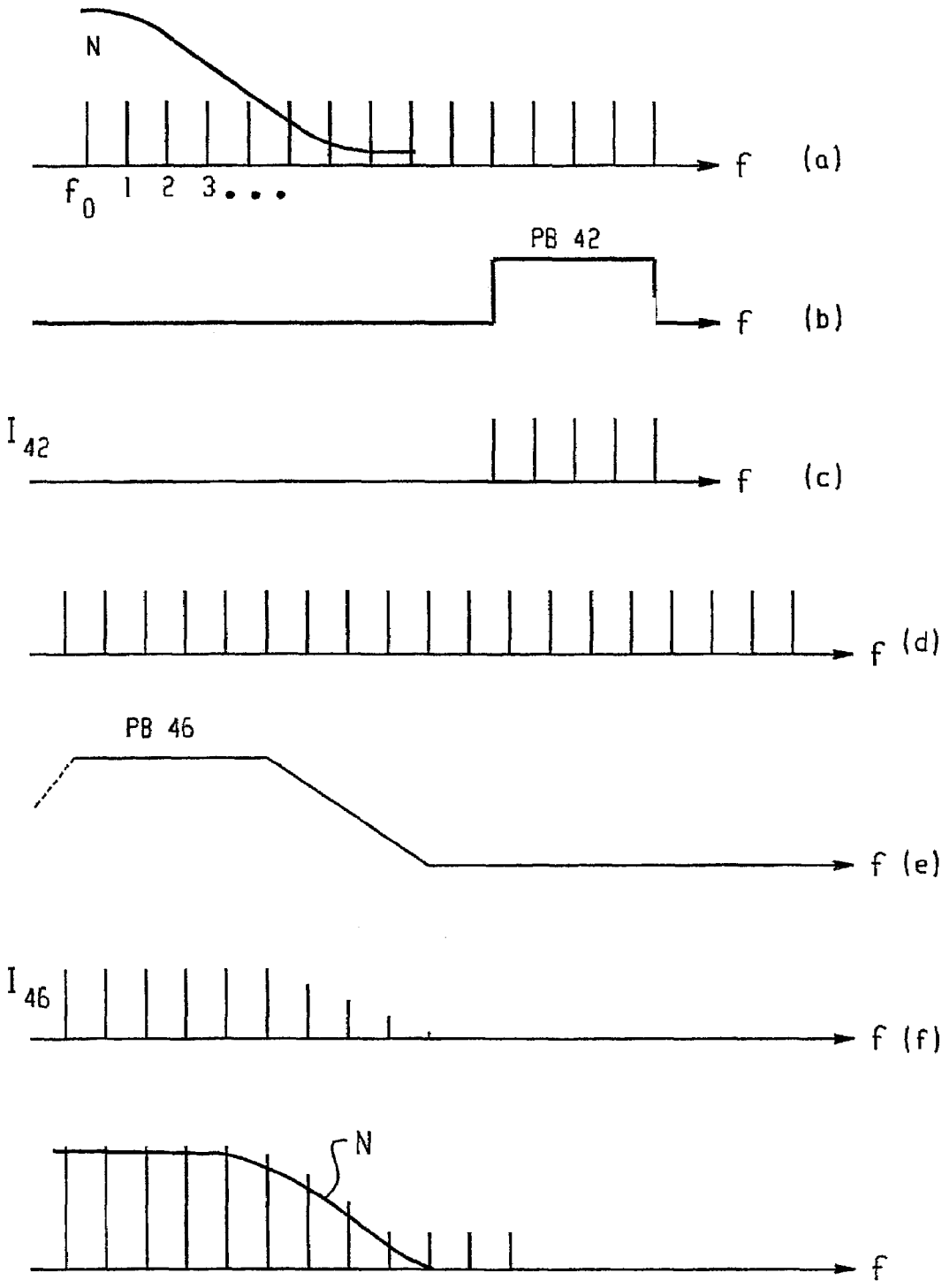
FIG. 7 simplified spectra for explaining functioning of the device and method as shown in FIG. 6.

The functioning of the device or method as shown in FIG. 6 and thereby specific selection of the filtering characteristics, especially of units 42 and 46, shall be explained with the help of FIG. 7.

In FIG. 7(*a*) there is schematically shown on one hand wind noise spectrum N and on the other hand the fundamental of a speech signal and its harmonics 1, 2, 3, . . . . It may be seen that whereas fundamental and lower harmonics have bad SNR, higher harmonics have increasingly better SNR.

According to FIG. 7(*b*) the pass-band $PB_{42}$ of unit 42 is selected to pass high SNR harmonics, resulting in $I_{42}$ as of FIG. 7(*c*).

This signal is subjected at unit 44 to non-linear modulation. As perfectly known to the skilled artisan by such non-linear modulation, e.g. at a parabolic characteristic, new harmonics are produced as generically shown in FIG. 7(*d*), also considering intermodulation products and folding at the zero-frequency axes.

It has to be noted that these harmonics are spectrally located exactly there where the harmonics and fundamental of the original speech signal according to FIG. 7(*a*) are located.

The signal $I_{44}$ with good SNR or the signal dependent therefrom is fed to unit 46 with a filter characteristic as shown in FIG. 7(*e*), whereat those harmonics within signal $I_{44}$ according to FIG. 7(*d*) are canceled or filtered out, which do not accord with original speech harmonics according to FIG. 7(*a*) to be improved as shown in FIG. 7(*e*). At adding unit 40 the signal $I'_{46}$ with the spectrum according to 7(*f*) possibly amplified is added to the signal $H_3$ with a spectrum according to FIG. 7(*a*) resulting in an output signal $S_{40}$ with speech fundamental and lower harmonics significantly improved with respect to SNR, and as shown in FIG. 7(*g*).

Thus, the pass-band PB 42 of unit 42 is selected to coincide spectrally with a harmonics of speech with relatively good SNR and the characteristic of filter unit 46 is selected so that in the resulting signal harmonics are present, which coincide spectrally with the poor SNR fundamental and lower harmonics of speech to be improved with respect to SNR.

The embodiment as shown in FIG. 6 may thereby be implemented digitally by providing down-stream $A_3$ (not shown) an analog to digital conversion unit and further may be implemented by signal processing in frequency or frequency band domain, thereby adding respective time domain to frequency or frequency band domain conversion units.

As further shown in FIG. 6 a delay unit 43 may be provided between point P and input $E_{401}$ to compensate for time delays between P and $E_{402}$.

With an eye on the method of manufacturing a device according to FIG. 6 with a device casing 1, the remaining units are provided and assembled in the same casing or in different casings, the operational connections between the different units being established before, at or after assembling the units in the one or more than one casings.

In a most preferred form the technique as disclosed with FIGS. 6 and 7 is combined with upstream high-pass filtering of the output signals of the input converter arrangement 3, thereby especially preferred with adjustable high-pass filtering as was explained with the help of the FIGS. 1 and 2 and which accords to the present invention under its first aspect.

Figure 8:
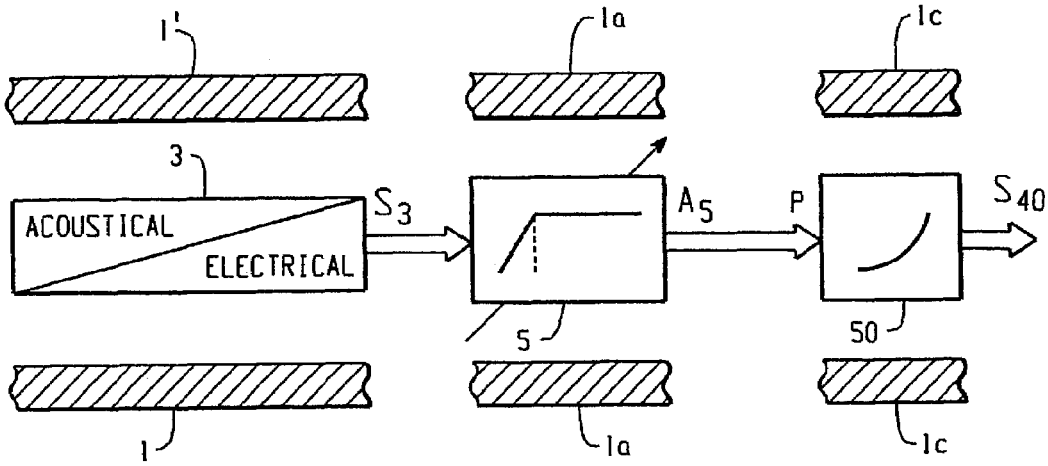
FIG. 8 in a simplified functional block/signal-flow diagram a preferred combination of the invention under its first aspect with the invention under the second sub-aspect of its second aspect.

This is schematically shown in FIG. 8. The system according to this FIG. 8 needs not be additionally described, besides of the fact that the system according to FIG. 6 between branching point P and output signal $S_{40}$ is considered residing in unit 50.

$3^{rd}$ Aspect

Under all the aspects of the present invention discussed up to now the addressed input acoustical/electrical converter arrangement may comprise one or more than one distinct input acoustical/electrical converters as of microphones and may thereby provide for beamformer characteristics. Nevertheless, the arrangement may also comprise only one distinct acoustical/electrical input converter.

In contrary thereto, the present invention under its third aspect is directed on acoustical devices, especially hearing devices with a mores specific input converter arrangement.

Figure 9:
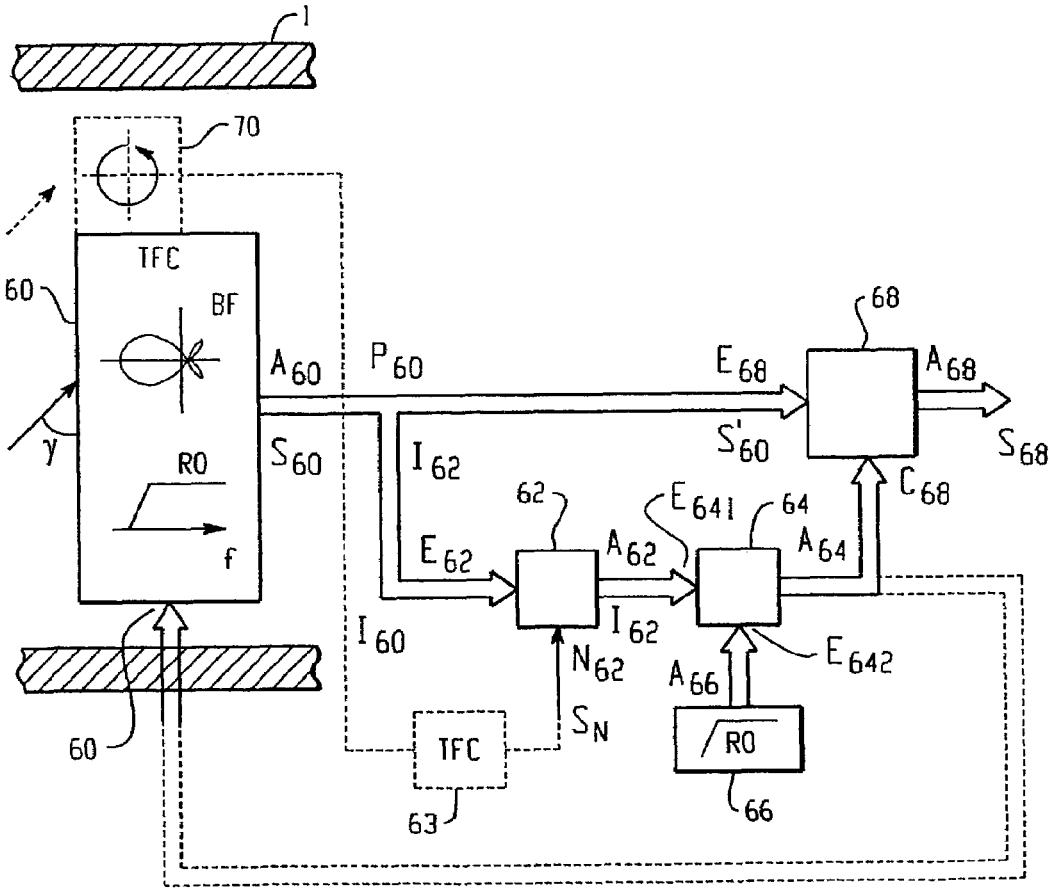
FIG. 9 by means of a simplified schematic functional block/signal-flow diagram an acoustical device operating according the method for at least substantially canceling wind disturbances and manufactured by a method, all according to the present invention under its third aspect.
Figure 10:
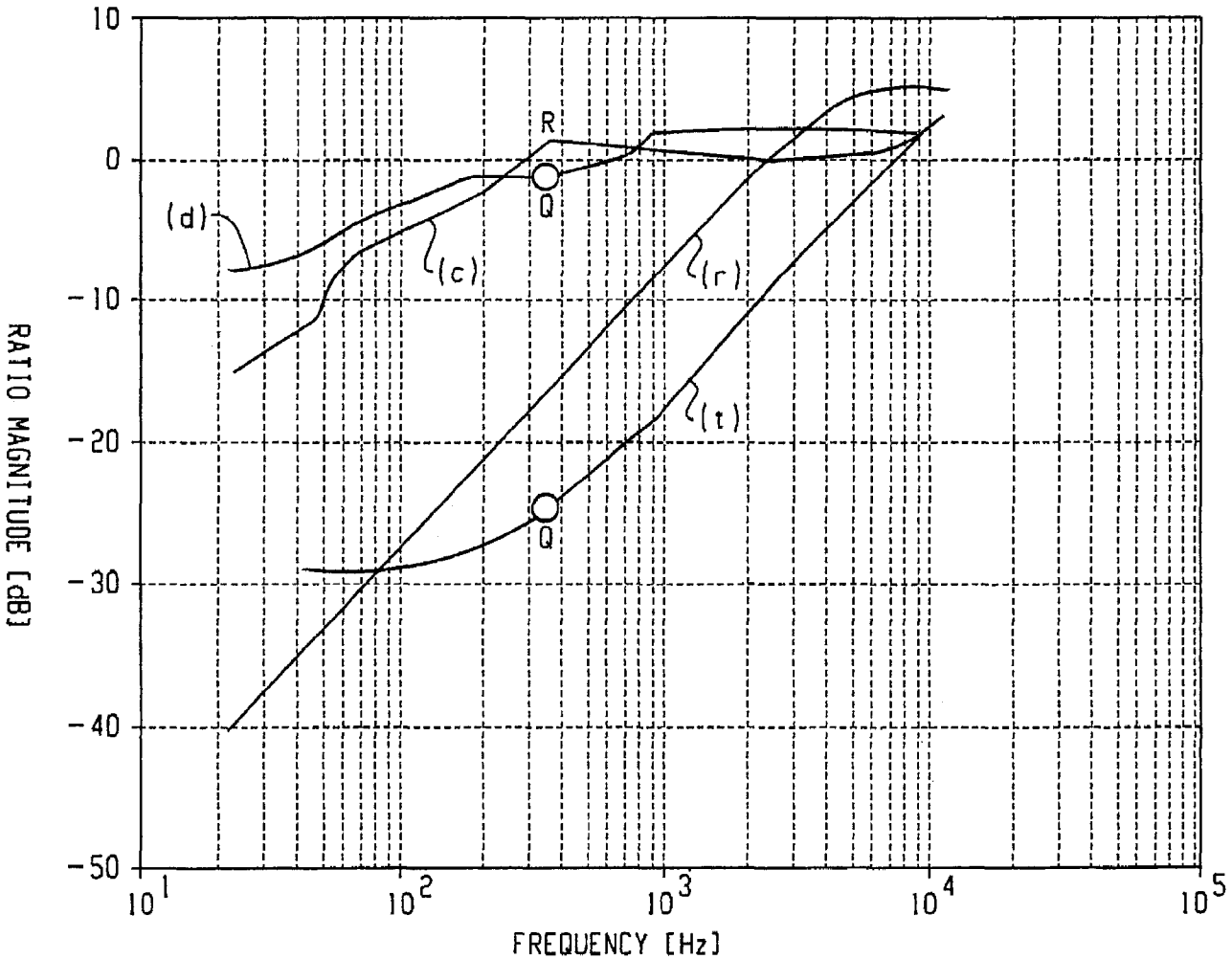
FIG. 10 as an example a roll-off characteristic (a), speech as well as wind spectra for explaining the effect of the invention under its third aspect.

According to FIG. 9 there is provided an input acoustical/electrical converter arrangement 60 with an output $A_{60}$ generating there an output signal $S_{60}$. The input converter arrangement 60 has the following characteristics:

a) It provides for a beamformer amplification characteristics BF, i.e. with a specific amplification characteristic of acoustical input signals ACU to electric output signal $S_{60}$ in dependency of direction of arrival $\phi$ with which such acoustical signals ACU impinge on a sensing area of the arrangement 60.

b) The beamformer characteristic of amplification has a predetermined roll-off characteristic RO. This roll-off characteristic defines for a considered DOA angle $\phi$, how the amplification is attenuated as a function of signal frequency. Such a roll-off characteristic over frequency is shown in FIG. 10 by course (a).

c) Further, within the input converter arrangement 60 analog to digital conversion as well as time domain to frequency or frequency band domain conversion is performed.

Such beamformer arrangements are known. The beamformer characteristics may thereby be realized by applying a single, discrete input acoustical/electrical converter with an intrinsic directional characteristic or may be implied by means of more than one distinct input acoustical/electrical converters, e.g. following the well-known delay-and-add technique.

The output signal $S_{60}$ in frequency or frequency band domain or a signal dependent therefrom is branched at branching point $P_{60}$. Signal $I_{62}$, still dependent on output signal $S_{60}$, is input to the input $E_{62}$ of a normalizing unit 62. There each frequency sample of prevailing, actual value is normalized by a signal $S_N$ value fed to normalizing input $N_{62}$ of unit 62. For each frequency sample the normalizing unit 62 generates at output $A_{62}$ a normalized value as signal $I_{62}$, a signal dependent therefrom being fed to one input $E_{641}$ of a comparing unit 64. A storing unit 66 is provided wherein the predetermined roll-off characteristic RO is stored. The output $A_{66}$ thereof is operationally connected to the second input $E_{642}$ of comparing unit 64. The output $A_{64}$ with the comparison result is fed to a control input $C_{68}$ of a selection unit 68. A signal input $E_{68}$ of that unit is operationally connected via branching point $P_{60}$ to the output $A_{60}$ of converter arrangement 60. Unit 68 generates signal $S_{68}$ at output $A_{68}$.

The roll-off characteristic RO is defined as the quotient of a spectral component of a considered frequency at output signal $S_{60}$ to the value of the respective component in the acoustical signal impinging on the sensing area of arrangement 60. From unit 66, for each frequency sample f' a roll-off value is fed to unit 64. For comparison purposes the respective sample prevailing in signal $I_{60}$ must be normalized before any meaningful comparison may be performed at unit 64 with the respective frequency-specific roll-off value.

Thus, the normalizing value $S_N$ fed to normalizing unit 62 must be dependent as accurately as possible on the actual value of frequency components of the acoustical signal impinging on converter arrangement 60.

If within the input acoustical/electrical converter arrangement 60 beamforming is achieved with a single discrete directional converter, as with a microphone with directional characteristic, preferably a second microphone will be installed e.g. in arrangement 60. Its output signal, after time domain to frequency or frequency band domain conversion, is operationally connected to the input $N_{62}$ of the normalizing unit 62 as normalizing signal $S_N$. Thereby such an additional acoustical/electrical converter is preferably selected to have an omnidirectional characteristic.

As shown in dashed lines in FIG. 9 such additional standardizing input converter 70 has an output, in fact forming a further output of converter arrangement 60, which is operationally connected to the input $N_{62}$ of normalizing unit 62 after time to frequency of frequency band domain conversion TFC at a unit 63. Thus, at the normalizing unit 62 each prevailing frequency sample of signal $I_{60}$ will be normalized with the value of respective spectral component of the acoustical signal.

Another possibility of normalizing the signal $I_{60}$ in the case of providing a directional input converter in arrangement 60 is to continuously average the signal after beamforming overall frequencies and over a predetermined amount of time and to apply the average result to input $N_{62}$. In this case the input acoustical/electrical converter arrangement 60 needs only to be provided with a single input acoustical/electrical converter with intrinsic beamforming ability and the normalizing signal $S_N$ is established from the signal $I_{60}$. Nevertheless it appears that such processing will be less accurate than processing normalization by the actual spectral component values of the acoustical signal as is performed with a normalizing omni-directional converter 17.

Very often the beamforming ability of the input acoustical/electrical converter arrangement 60 is achieved by means of at least two discrete input acoustical/electrical converters, the output signals thereof being processed e.g. according to the well-known delay-and-add principal.

Figure 11:
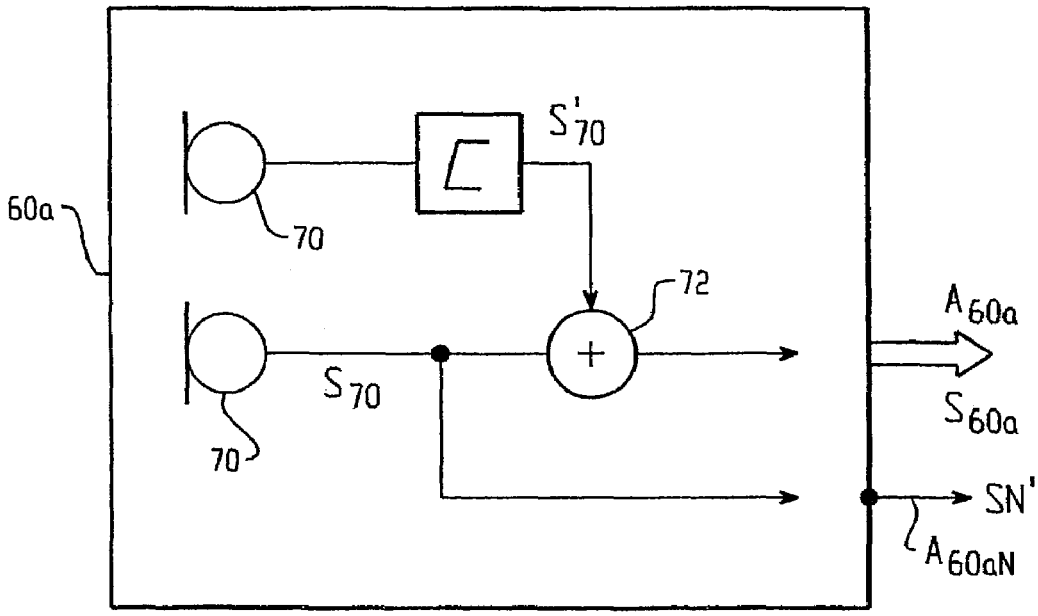
FIG. 11 by means of a simplified schematic functional block/signal-flow representation a preferred input acoustical/electrical converter arrangement as preferably used in the embodiment of FIG. 9.

In this case providing normalizing signals is quite simple. This is shown schematically in FIG. 11. The input acoustical/electrical converter arrangement 60*a* has at least two distinct input acoustical/electrical converters 70, the output thereof being processed e.g. and as shown by the well-known delay-and-add method. As each single distinct converter 70 provides at its output an output signal yet not having been subjected to beamforming, which is performed in a beamformer processing unit 72, each of the output signals $S_{70}$ and $S_{70}'$ has spectral components with the value according to that component in the impinging acoustic signal. The signal of one of the distinct input converters is directly tapped off after time domain to frequency or frequency band domain conversion to an output $A_{60aN}$ of arrangement 60*a* and a signal dependent therefrom is operationally connected to the input $N_{62}$.

In comparing unit 64 there is monitored for each frequency sampled whether the actual normalized value has a predetermined relationship with respect to the roll-off value. In a most preferred embodiment it is established for each normalized frequency sample value, whether it is at most equal to the roll-off value. The output signals at the output $A_{64}$ of comparing unit 64 thereby indicate for which specific frequency the normalized value fulfills the predetermined comparison criterion, thus, as preferred, whether the normalized value is at most equal to the roll-off value.

In the selection unit 68, to which by input signal $S'_{60}$ the instantaneously prevailing frequency samples are fed, only those samples are passed for which the normalized samples fulfill the requested predetermined comparison criterion. Canceling the samples at those frequencies which do not fulfill the comparison criterion is easily done by establishing in the control signal applied to $C_{68}$ a zero for that not fulfilling frequency component and multiplying at the selection unit 68 the respective frequency samples by zero.

With an eye on FIG. 10 the spectral characteristic (b) represents clean speech, the characteristics (c) and (d) respectively represent strong and weak wind noise. As was said characteristic (a) represents typical roll-off characteristic.

By comparing the characteristics as of FIG. 10 with the embodiment and method of FIG. 9, especially with the preferably established comparison criterion according to which only samples of those frequencies are passed by unit 68, for which the value of the normalized sample is at most equal to the roll-off value, it may be seen that all samples Q below the roll-off characteristic (a) will be passed, whereas samples R above that roll-off characteristic (a) will be cancelled at selection unit 68.

Figure 12:
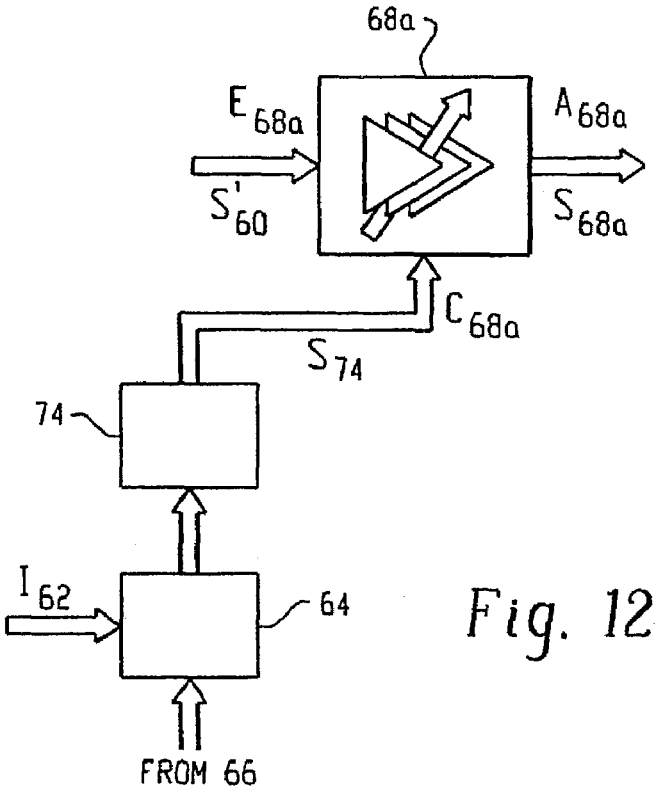
FIG. 12 by means of a simplified schematic functional block/signal-flow representation a preferred embodiment of signal control as preferably applied to the invention as explained with the help of FIGS. 9 to 11.

Following up the description of FIG. 9 up to now, the spectral components or frequency samples prevailing in signal $S_{62}$ are rather binaurally passed or not passed to output signal $S_{68}$. Very often and for many appliances as especially for hearing devices, thereby especially hearing aid devices, such binary switching is not optimal. In FIG. 12 there is shown by means of a simplified schematic signal-flow/functional block representation a preferred embodiment of establishing control between the comparing unit 64 and frequency sample selection at a selection unit 68*a*. The unit 68*a* as well as 64 are operationally connected and fed with signals as was described with the help of FIG. 9. As was explained with the help of FIG. 9 at the output of comparing unit 64 there appears specifically for each frequency or frequency band a control signal, which indicates whether the respective normalized value of the respective samples do or do not fulfill the predetermined comparison condition. These signals are, according to FIG. 12 first operationally connected to a unit 74 which has a transfer characteristic of low-pass type. This results in an output signal $S_{74}$, which is a continuously varying average signal specifically for each frequency or frequency band. Thus, the control signals applied to $C_{68a}$ are not anymore binary pass/not pass control signals for unit 68, but do continuously or steadily vary between predetermined maximal and minimal values. Additionally the selection unit 68 of FIG. 9 is replaced by a frequency or frequency band selective attenuation unit 68*a*, in which frequency or frequency band specifically, the value of the frequency samples are attenuated, controlled by the frequency- or frequency band-specific control signals applied to $C_{68a}$.

Thereby, it is achieved that samples at those frequencies, whereat the respective normalized values do not fulfill the criterion frequently or during predetermined time spans are more and more attenuated in time up to finally disappearing in output signal $S_{68a}$.

$4^{th}$ Aspect

Under the fourth aspect of the present invention a beamforming technique is proposed in which frequency or frequency band specifically beamforming may be controlled. This technique under the fourth aspect of the present invention may be ideally combined with the technique as was explained in context with FIG. 9 to 12, i.e. in context with the third aspect of the present invention. This invention shall be explained with the help of FIG. 13.

A beamformer arrangement 80 comprises at least two distinct input acoustical/electrical converters $\mathbf{80}_a$ and $\mathbf{80}_b$. The electric outputs of the converters $\mathbf{80}_a$ and $\mathbf{80}_b$ are respectively connected to inputs $E_{82a}$ and $E_{82b}$ of respective time domain to frequency or frequency band domain conversion—TFC—units 82*a* and 82*b*.

Figure 13:
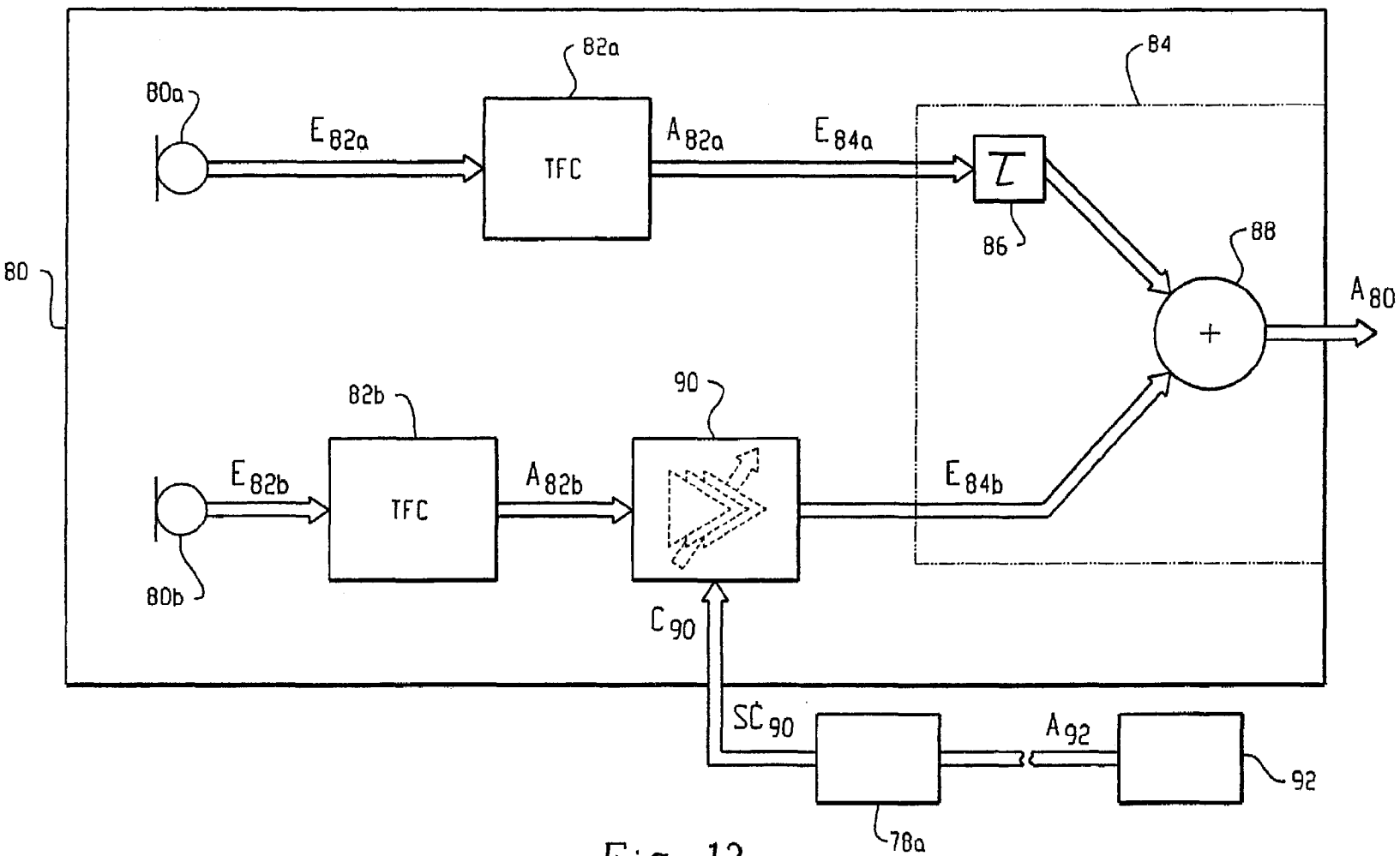
FIG. 13 by means of a simplified schematic functional block/signal flow representation a beamforming device operating the method for controlling beamforming and manufactured by a method, all according to the present invention under its fourth aspect, and FIG. 14 by means of a simplified functional block/signal-flow representation an acoustical device operating to perform the method of detecting wind noise and manufactured by a method, all according to the present invention under its fifth aspect.

The outputs $A_{82a}$ and $A_{82b}$ are generically input to a beamformer processing unit shown in FIG. 13 within dashed-pointed lines and referred to by the reference No. 84. When beamformer processing is done by the known delay-and-add principle, such beamformer processing unit 84 incorporates a—preferably controlled—delaying unit 86 and an adding/subtracting unit 88. Both output signals of the TFC units 82*a* and 82*b* are operationally connected to the respective inputs $E_{84a}$ and $E_{84b}$ of the beamformer processing unit 84. At least one of the operational connections between the respective outputs of the TFC units and respective inputs of the beamformer processing unit 84 comprises a frequency or frequency band selective control unit 90. The control unit 90 has a control input $C_{90}$ to which control signals $SC_{90}$ are fed.

The control unit 90 is construed in fact equally to the selection unit 68 of FIG. 9 or the attenuation unit 68*a* of FIG. 12.

To the control input $C_{90}$ frequency-specific or frequency band-specific control signals are applied, which control for each frequency-specific or frequency band-specific samples at the output of TFC unit 82*b*, how it is passed to input $E_{84b}$ of the beamformer processing unit 84. Binary passing/not passing samples of the respective frequency or frequency band according to the respective frequency- or frequency band-specific control signal to $C_{90}$, means switching the beamforming ability of the beamforming processing unit 84 for the specific frequencies considered on and off.

Whenever samples of a specific frequency or frequency band are blocked by control unit 90 for that specific frequency or frequency band, beamforming ability of processor unit 84 ceases. There results namely, in that case that such samples of the considered frequencies or frequency bands are only fed to processor unit 84 from the one remaining input converter, according to FIG. 13 from converter 80*a*.

Thereby, here too, it might be advisable not to binarily switch beamforming ability on and off. Therefore it might be advisable on one hand to provide the control signals to $C_{90}$ via a low-pass type unit 74*a*, operating as was explained in context with FIG. 12 for unit 74 and/or to construe control unit 90 as a frequency- or frequency band-specific attenuation unit according to unit 68*a*, which was explained with the help of FIG. 12 in context with the third aspect of the present invention.

Under a generic aspect the frequency- or frequency band-specific control signals $SC_{90}$ of FIG. 13 are generated from a control unit 92, which generates at its output $A_{92}$ frequency- or frequency band-specific control signals for the frequency of frequency band-specific beamformer ability of acoustical/electrical converter and beamformer arrangement 80.

With an eye on noise canceling it is thereby preferred that the addressed control unit 92 is a frequency- or frequency band-selective noise detector especially a wind noise detector.

Switching back to the third aspect of the present invention as disclosed in FIG. 9, the normalizing unit 62 and the comparing unit 64, to which the roll-off characteristic is fed from unit 66 represent in fact a frequency- or frequency band-selective noise detector unit, thereby even a wind noise detector unit. As has been described, whenever at unit 64 a predetermined comparison result is achieved, the respective frequency-specific or frequency band-specific control signal at the output of that unit 64 is indicative of such a result, and in analogy when the respective comparison result is negative. Therefore, a control unit 90 as of FIG. 13 is preferably construed by a normalizing unit as of 62, a comparing unit 64 and storing unit 66 as of FIG. 9.

In a most preferred embodiment the invention according to the fourth aspect is combined with the invention according to the third aspect. In the embodiment of FIG. 9, on one hand, the input converter arrangement 60 is construed as an input converter arrangement 80 of FIG. 13. On the other hand, the output of comparing unit 64 is additionally to be operationally connected to the control input $C_{68}$ of selection unit 68, operationally connected to the input $C_{90}$ of such input converter arrangement 80.

By such a combination a most advantageous effect is reached: Whenever samples of a predetermined frequency or frequency band are more and more attenuated or are blocked at selection unit 68 or, respectively, at amplification unit 68*a* as of FIG. 12, simultaneously beamforming ability of the beamforming processing unit 84 with respect to that frequency or frequency band will be attenuated as well or even completely stopped. By latter action the roll-of function for that specific frequency or frequency band does not prevail anymore, because roll-off behavior results from beamforming. Because for the frequency or frequency band considered, roll-off behavior does not anymore prevail, there will appear at the output $A_{80}$ (FIG. 13) the respective frequency or frequency band component unattenuated by roll-off. Back to FIG. 9, this will lead at comparing unit 64 to the normalized value largely exceeding the roll-off value at the considered frequency or frequency band, thereby accelerating the increase of attenuation for such sample at unit 68/68*a*.

Thus, combining the teachings of the fourth aspect and of the third aspect of the present invention leads to improved noise canceling, thereby especially wind noise canceling at an acoustical device, thereby especially a hearing device and further preferably a hearing aid device.

Fifth Aspect

Under the fifth aspect of the present invention a wind noise detection technique is proposed, leading to a method of manufacturing an acoustical device with wind noise or more generically wind detection ability, further to a respective acoustical device and to a wind detecting method most preferably applicable for hearing devices, especially hearing aid devices.

Figure 14:
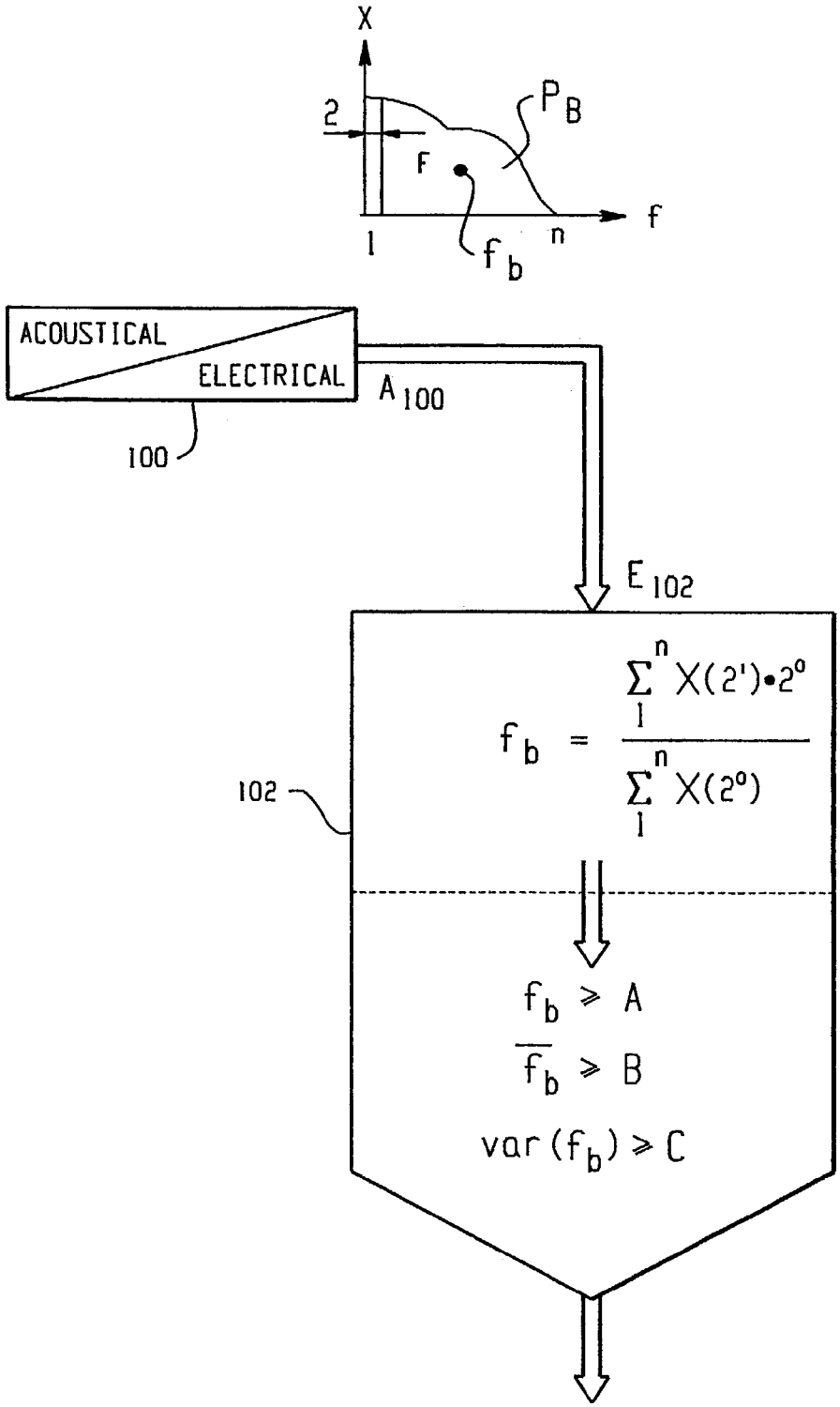

According to FIG. 14 an acoustical/electrical input converter arrangement 100 with one or more than one distinct acoustical/electrical input converters and having beamforming ability or not is provided, the output $A_{100}$ of which being operationally connected to the input $E_{102}$ of a calculating unit 102. In FIG. 14 there is schematically shown a spectrum with amplitude X over frequency axis f. The signal fed to $E_{102}$ has a spectrum which accords with or is dependent from the spectrum of acoustical signals impinging on a sensing area of the arrangement 100.

Within a predetermined frequency band the spectrum defines for a surface F. The calculation unit 102 is programmed to calculate from the spectrum at its input $E_{102}$ the frequency coordinate $f_b$ of the point of balance $P_B$ of the surface F.

This is performed according to the well-known formula as indicated within the block of calculation unit 102 for calculating the balance point coordinates of a geometric surface.

Once within the calculation unit 102 the prevailing frequency coordinate $f_b$ of the balance point $P_B$ is calculated, the respective value forms the basis for deciding by evaluation, whether wind with a predetermined disturbing effect is present or not. Thereby, evaluation may comprise checking, whether the frequency coordinate value $f_b$ itself fulfills a predetermined criterion or not. Further and in a preferred embodiment the average of the frequency coordinate value is calculated continuously over a predetermined time span, and it is evaluated, whether the average value $f_b$ fulfils a predetermined criterion or not. As a third criterion the variance of the frequency coordinate $f_b$ is continuously calculated over a predetermined amount of time and again evaluation is made whether such variance value fulfills a predetermined criterion or not.

Further, evaluation is preferably done on the basis of the quotient of average value to variance value of the said frequency coordinate $f_b$ and/or on the basis of the inverse quotient. From combining two or more than two of these testing criteria there is finally evaluated whether wind and thereby wind noise is present to a disturbing amount or not. Additional evaluation parameters may be used and considered in the calculation of calculating unit 102 by respective programming, so e.g. energy of the signal applied to $E_{102}$, SNR with respect to speech signals, etc.

By the technique according to this fifth aspect of the present invention, wind detection becomes possible from an acoustical/electrical input converter arrangement, irrespective of its specific layout. The output of calculating unit 102 is used for appropriately controlling an acoustical device or for construing an acoustical device which is controlled according to the prevailing wind characteristics.

Again and with respect to the methods of manufacturing a device under all aspects of the invention, the operational connections between the various units are established preferably at least to a part before assembling the units in respective single or multiple casings. All aspects of the present invention do not address specific processing of electric signals representing audio signals according to specific device and/or individual needs. By the invention according to the present invention it is achieved—beside of wind recognition per se—that the electric signals at the output of an input acoustical to electrical converter arrangement representing audio signals are improved with respect to their relevancy on signals to be tracked as with respect to signal-to-noise ratio and thereby especially signal-to-wind noise ratio.

ETH
Eidgenössische Technische Hochschule Zürich
Swiss Federal Institute of Technology Zurich Signal and Information Processing Laboratory
Institut für Signal- und Informationsverarbeitung
ISI Winter Semester 2002/2003 Prof. Dr. H.-A Loeliger Diploma Thesis

Wind Noise Canceling for Hearing Instruments

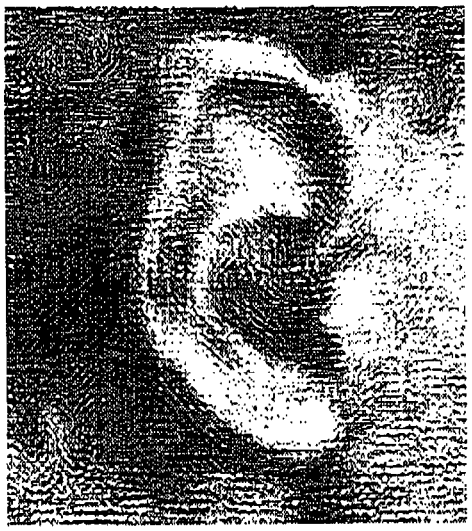

Franziska B. Pfisterer

Advisor at ISI: Sascha Korl

Advisors at Phonak AG: Hans-Ueli Roeck

Dr. Silvia Allegro

Acknowledgment

Problem

Diploma thesis for Franziska Pfisterer
October 2002 February 2003, Phonak AG, Stäfa
Responsible at ISI/ETH: Sascha Korl, Prof. A. Loeliger
Responsible at Phonak AG: Silvia Allegro

Wind noise canceling for hearing instruments

Introduction

In hearing instruments, high listening comfort and speech intelligibility shall be guaranteed also in adverse situations. Existing noise cleaning methods employed in hearing instruments are however very general and not targeted to individual acoustic situations. Single-microphone noise canceling allows the suppression of stationary noises, while dual microphone methods (beamforming) achieve a better SNR by directional filtering. Both approaches are not suitable to improve speech intelligibility in particular acoustic situations such as e.g. in the presence of wind noise. The goal of this diploma thesis is to propose, implement and evaluate practically applicable means for wind noise canceling in hearing aids. This task comprises the recognition of wind noise, the suppression (filtering) of the undesired signal components, and the evaluation of the proposed approaches. The designed solutions shall be implemented in Matlab or Simulink and tested on a real-time simulation system. Minimal computational complexity, i.e. clever implementation of basic functionalities is a requirement for usage in hearing instruments and shall be considered as well. The designed solution shall be implemented in Phonak's next generation of hearing instruments.

Procedure

- Study known causes and effects of wind noise in hearing instruments, existing approaches and state of the art in wind noise recognition and suppression.
- Look through wind noise sound material existing at Phonak and acquire further material if required.
- Properly analyze characteristics of wind noise (e.g. amplitude and spectral distributions, temporal characteristics, etc.). I
- mplement a technique for the recognition of wind noise based on evaluating the correlation between two microphone signals. Wind noise is a particular problem on hearing instruments with exposed microphones (in particular behind-the-ear hearing instruments). These devices are usually equipped with two microphones in order to allow directional filtering. Turbulences at the microphone inlets are a source for high-frequent wind noise. The wind noise signals as present at the two microphones are therefore highly uncorrelated. State of the art wind noise recognition techniques make use of this fact by examining the correlation between the two microphone signals.
- Based on the previously investigated characteristics of wind noise, develop and implement a method for recognizing wind noise from a single-microphone signal. Suitable features might e.g. be the spectral distribution and the tonality. Investigate the suitability of using HMMs for wind noise recognition.

- Evaluate the robustness of the proposed wind noise recognition means.
- Implement simple and efficient means for the suppression of wind noise such as attenuation of low-frequency components and wind-noise adapted spectral subtraction (basic implementation available at Phonak).
- Develop and investigate further means for reducing wind noise based on the gained know-how.
- Provide additional means for coping with wind noise such as e.g. activation of the omnidirectional mode and adaptation of gain parameters.
- Evaluate the benefit of the proposed wind noise canceler by means of the available real-time system.
- Documentation.

Literature

H. Dillon, I. Roe, R. Katsch, 1999(?). "Wind noise in hearing aids. Oral presentation at AAA 1999 (?), xxx, USA.

H. Dillon, I. Roe, R. Katsch, 2000. "The sources of wind noise in hearing aids. Poster presentation at IHCON 2000, Lake Tahoe, USA.

I. Roe, H. Dillon, R. Katsch, 20xx. "Wind noise in hearing aids: causes and effects. Paper submitted to JASA.

T. Dickel, B. Knapp, 2002. "Verfahren zum Betrieb eines Hrhilfegertes ode Hrgertesystems sowie Hrhilfegert ode Hrgertesystem. Deutsche Patentschrift DE 100 45 197 (Siemens Audiologische Technik), 2002.

Abstract

In this study the problem of wind noise in hearing aids is investigated and algorithmic solutions for wind noise canceling will be developed. In hearing instruments high listening comfort and speech intelligibility are important. Todays hearing aids come with very general noise cleaning methods which however are not suitable for the improvement of speech intelligibility in the presence of wind noise.

In a first step the generation and the characteristics of wind noise shall be analyzed. Based on these findings and the state of the art in wind noise recognition and suppression new algorithms will be developed. As hearing aids are equipped with different numbers of microphones two different approaches will be investigated, where one is based on the usage of multiple channels and the other one relying only on a single microphone.

In a first step the algorithms have the aim to improve the listening comfort in the presence of wind noise. In a second step the intelligibility of wind noise shall be improved by an additional block.

The algorithms are implemented in Matlab and Simulink and are tested with different sound examples. The canceling algorithms reduced the noise magnitude considerably and hence improved the listening comfort. The intelligibility of speech could also be improved by a small amount due to the added speech enhancement block.

Zusammenfassung

In diese Arbeit wird das Problem von Windgeräuschen in Hörgeräten untersucht und es sollen Algorithmen zur deren Reduktion gefunden werden. In Hörgeräten spielt der Hörkomfort und die Sprachverständlichkeit eine grosse Rolle. Moderne Hörgeräte haben allgemeine Algorithmen zur Störgeräuschunterdrückung, die jedoch für die Verbesserung der Sprachqualität in Windsituationen nicht sehr geeignet sind.

In einem ersten Schritt soll die Entstehung und die Eigenschaften der Windgeräusche analysiert werden. Basierend auf diesen Kenntnissen und den bekannten Methoden zur Erkennung und Unterdrückung von Windgeräuschen werden neue Algorithmen entwickelt. Da Hörgeräte mit unterschiedlicher Anzahl von Mikrophonen ausgerüsted sind, werden zwei verschiedene Ansätze verfolgt. Der eine Algorithmus soll auf mehreren Kanälen operieren während der andere Ansatz nur ein Mikrophon zur Verfügung haben soll.

Das erste Ziel der Algorithmen soll die Verbesserung des Hörkomfortes sein. In einem weiteren Schritt soll dann die Sprachverständlichkeit in einem zusätzlichen Block verbessert werden.

Die Algorithmen sind in Matlab und Simulink implementiert und anhand von verschiedenen Beispielsignalen getestet. Die Algorithmen reduzieren die Lautheit der Windgeräusche sehr deutlich und verbessern dadurch den Hörkomfort. Die Sprachverständlichkeit konnte dank dem zusätzlichen Block auch leicht erhöht werden.

Contents

Acknowledgment i

Problem ii

Abstract 2

1 Introduction 10

2 Wind Noise in Hearing Instruments 13
- 2.1 Origin of Wind Noise . . . . . 13
- 2.2 Power Spectrum of Wind Noise . . . . . 14
- 2.3 Correlation and Coherence of Wind Noise . 16
- 2.4 Dependence of Wind Noise . . . . . 20
- 2.5 Influence of Hearing Aid Position . . . . . 25

3 State of the Art 33
- 3.1 Mechanical Solutions . . . . . 33
- 3.2 Algorithmic Solution . . . . . 34
  - 3.2.1 Wind Noise Detection . . . . . 35
  - 3.2.2 Measures for Wind Noise Reduction . 35
- 3.3 Evaluation . . . . . 36

4 Multi Channel Solution 41
- 4.1 Frequency Domain System . . . . . 41
- 4.2 Beamforming . . . . . 43
- 4.3 Noise Reduction Using a Wiener Filter . . . 45

4.4 Results for Multi Channel Solution . . . . . 49

5 Single Channel Approach 62
5.1 Wind Detection Using a Sound Classification Scheme . . . . . 62
5.2 Wind Canceling Based on a Linear Predictor 66
5.2.1 Linear Predictor . . . . . 66
5.2.2 Selection of the Filter Order . . . . . 69
5.2.3 Step Size and Adaption Time . . . . 72
5.3 Results for Single Microphone Approach . . 75
5.3.1 Wind Noise Detection . . . . . 75
5.3.2 Wind Canceling . . . . . 77

6 Intelligibility of Speech in Wind Noise 86
6.1 Introduction . . . . . 86
6.2 Pitch Detection and Filtering . . . . . 88
6.3 Nonlinear Filtering . . . . . 90
6.3.1 System Overview . . . . . 90
6.3.2 Parameter Selection . . . . . 92
6.3.3 Voiced Unvoiced Detection . . . . . 96
6.4 Results . . . . . 97

7 Conclusions 103

A Wind Noise Records 105

B Sound Examples 106

List of Figures 1.1 General block diagram for wind noise canceling algorithms . . . . . 12

2.1 Spectrum of a typical wind noise record with wind coming from an angle of 0° with a velocity of 5 m/s . . . . . 17
2.2 Recording Situation to obtain the Spectrum in Figure 2.1 . . . . . 17
2.3 Cross correlation for wind noise and speech . 18
2.4 Coherence between two microphone signals for wind noise and clean speech . . . . . 20
2.5 Power spectrum of different wind speeds for a BTE . . . . . 22
2.6 Different directions of wind arrivals . . . . . 22
2.7 Power spectrum for wind noise from different angles for a BTE . . . . . 23
2.8 Different frequencies versus the angle for BTE 24
2.9 Power spectrum for different hair and different angles . . . . . 26
2.10 Comparison of power spectrum for BTE and ITE . . . . . 27
2.11 Power spectrum for an ITE for different angles 27
2.12 Power spectrum for different frequencies versus the angle for an ITE hearing aid . . . . 28
2.13 Power spectrum for different hair for an ITE hearing aid . . . . . 29

2.14 Coherence for ITE hearing aid for different angles of incidence . . . . . 30
2.15 Coherence for BTE hearing aid different angles of incidence. . . . . 31

3.1 Algorithm proposed by Siemens Audiologische Technik GmbH . . . . . 35
3.2 Results for Siemens algorithm without scaling 37
3.3 Results for Siemens algorithm for scaling with signal magnitude . . . . . 39
3.4 Results for Siemens algorithm for scaling with maximum power . . . . . 40

4.1 Frequency domain algorithm for wind noise detection using two microphones . . . . . 42
4.2 Situation for plane wave signal. . . . . 42
4.3 Spatial filter situation for a plane wave. . . . 44
4.4 Frequency response of the upper bound for acoustic signals . . . . . 46
4.5 Standard situation for Wiener filter. . . . . 47
4.6 Wiener filter for wind canceling system defined on the difference signal. . . . . 47
4.7 Schematic overview of multi channel system 50
4.8 Beamformer output for different sounds . . . 51
4.9 Gain of two channel solution for different sounds . . . . . 52
4.10 Output spectra etc. for party environment . 54
4.11 Output spectra etc. for traffic noise . . . . . 55
4.12 Output spectra etc. for wind noise . . . . . 56
4.13 Input spectra for speech in wind noise with different SNR . . . . . 58
4.14 Output spectra etc. for wind noise . . . . . 59
4.15 Output spectra for speech in wind noise with different SNR . . . . . 60

4.16 Output spectra etc. for speech wind noise with 0dB SNR . . . . . 61

5.1 General block diagram of a sound classification system . . . . . 63
5.2 Rule-based sound classification. . . . . 65
5.3 Linear predictor for wind noise canceling . . 66
5.4 Filter order of linear predictor vs. RMS of error . . . . . 70
5.5 Spectrum of error signal for different filter orders . . . . . 71
5.6 Filter coefficient for large step size . . . . . 73
5.7 Filter coefficient for large step size . . . . . 74
5.8 ROC-Gaph for the final settings . . . . . 78
5.9 Input and output spectrum for speech in wind noise at three different SNRs . . . . . 79
5.10 Adaption of linear predictor to signal spectrum 81
5.11 Analysis and Synthesis filter for different wind speeds . . . . . 82
5.12 Input and output spectra for single microphone for 10dB . . . . . 83
5.13 Analysis and Synthesis filter for different angles of incidence . . . . . 84
5.14 Input and output spectra for single microphone for 0dB . . . . . 85

6.1 Block diagram of pitch filtering algorithm . 89
6.2 Block diagram of enhancement system . . . 91
6.3 Formant triangle for fist and second formant for German vocals . . . . . 93
6.4 3D spectrogram for clean speech and speech in wind for -10dB SNR . . . . . 95
6.5 Computation of ACF . . . . . 96
6.6 Decision between voiced and unvoiced . . . . 96

6.7 ACF and power threshold of silence detection 98
6.8 Maximum of ACF in the selected search range 99
6.9 Voiced unvoiced decision signal . . . . . 101
6.10 Spectrogram of input and output signal of the enhancement block . . . . . 102

List of Tables 4.1 Composition of signals speech in wind noise 53

5.1 Features extracted by classifier algorithm. . 64
5.2 Confusion matrix for initial settings . . . . . 76
5.3 Confusion matrix for wind noise classification using the first classification rule . . . . 76
5.4 Results for classifier with first rule for wind noise classification. . . . . 77
5.5 Confusion matrix wind noise classification using the first and second classification rule. 77
5.6 Final results for wind noise classification. . . 77

6.1 Fundamental and formant frequencies . . . . 93

Chapter 1

Introduction

Wind noise is a known problem for people reliant on hearing aids, as pointed out by [1]. Hearing aid users often switch off their aids in the presence of wind, because they render themselves useless or because of the unpleasant sound. The origin of wind noise are turbulences which are generated by air flowing along the head. The microphones of the hearing instruments take up the pressure fluctuations resulting from these turbulences. The amount of noise taken up depends now on the position of the microphones. That is the main reason why normal hearing persons are afflicted very little with wind noise. Their microphone, the eardrum, is located in the ear channel and is therefore protected against the turbulences, whereas the microphones of hearing instruments usually are located directly in the propagation path of the turbulence or create additional turbulences themselves.

The loudness of wind noise is probably the most striking problem for users of hearing instruments. This is manifested in two ways. First of all wind noise can easily reach magnitudes of 100dB SPL and higher [1]. On the other hand the residual hearing abilities of hearing impaired people

[1] As a comparison a truck has a loudness of around 90 dB SPL and a starting air plane at a distance of 100m generates a loudness of 120dB SPL usually are limited to low frequencies. Wind noise can be shown to be a low frequent phenomenon thus the high magnitude low frequency parts of wind noise will mask frequency parts from other sounds with a lower magnitude. This effect is known as upward spread of masking. It is relatively small at low noise levels can be quite large for very high levels, such as that resulting from high-gain amplification of relatively intense background noise [2]. This masking effect results in bad intelligibility of speech in the presence of wind noise.

Todays hearing aids incorporate signal processing algorithms to cope with the problem of background noise. These algorithms are mostly very general and do not focus on a specific noise type. Examples of common noise reduction solutions are different kinds of stationary or adaptive filters, that allow the suppression of stationary noises, or spatial filters also called beamformers, that achieve a better results. Both approaches do have limits in improving speech intelligibility in special acoustic situations as in the presence of wind noise.

Even though the problem of wind noise is known for several years, only few solutions can be found in literature. Fist approaches were made using mechanical wind noise protection, for example by covering the microphones with a special cover. This method resulted in only small improvements and therefore a few attempts were made to reduce wind noise by means of signal processing algorithms based on multiple microphone signals.

The aim of this project was to study the existing solutions and develop new algorithms based on single and multiple channels. Figure 1.1 shows a general block diagram of wind noise canceling algorithms. In a first step the presence of wind is detected in a detection block. In the presence of wind noise accurate measures can be applied to the signal before it is fed into the hearing loss compensator of the hearing aid.

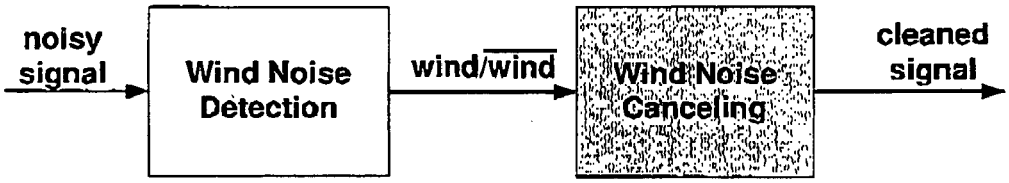

Figure 1.1: General block diagram for wind noise canceling algorithms consisting of two main parts: the detection and the canceling block.

In order to have a good understanding on the phenomenon of wind noise the basic mechanisms of wind noise generation and its characteristics, such as the power spectrum and the correlation as well as the dependency on different environment parameters were analyzed and are summarized in chapter 2. In Chapter 3 the solutions for wind noise canceling found in literature will be presented before in Chapter 4 a new canceling algorithm based on two input channels is developed and the corresponding results are presented. As not all hearing instruments are equipped with multiple channels, in Chapter 5 an algorithm that relies on only one channel will be presented. In Chapter 6 attempts to additionally improve the intelligibility of speech after the wind noise canceling are exploited. Finally in Chapter 7 the results and the performance of the different algorithms are discussed and an outlook on possible further work is suggested.

Chapter 2

Wind Noise in Hearing Instruments

In this chapter the basic mechanisms of wind noise generation and the resulting characteristics such as spectral composition and correlation of this noise are explained. Then the dependency of the noise characteristics from wind speed, the angle of incidence on the head and ear and on the hair lengths are described. All the calculations are based on wind noise sound files recorded by hearing aid microphones on a manikin that was placed in a wind tunnel. The measurements were made with two different hearing aid types inserted in the manikins ears: a behind-the-ear (BTE) hearing aid mounted behind the pinna and an in-the-ear (ITE) type. For each type of instrument recordings with different wind speeds, different angles of incidence on the head and different hair cuts were made. Detailed information about the recordings can be found in Appendix A.

2.1 Origin of Wind Noise

The noise we recognize as the sound of wind is generated in a pressure field produced by air of a certain velocity flowing past our head. When the airflow encounters an obstacle it has to evade and change direction around the obstacle. Any airflow can be characterized by its Reynolds number $R$ defined by the product of flow velocity $V$ times some dimensions of the obstacle L times the ratio of the density $\rho$ and the viscosity $\mu$[1] of the medium. That is $$R = V \cdot L \cdot \frac{\rho}{\mu}. \tag{2.1}$$

If the Reynolds number exceeds a certain value called the *critical number* or *transition Reynolds number*, the flow is said to become turbulent. However the transition from a laminar flow into a turbulent one is not an instantaneous process. For wind flowing past the head the critical Reynolds number $R_{crit}$ is about 10'000 [3] . Solving now equation 2.1 for $V$, the critical velocity for air flowing past an idealized head of a diameter $L = 18cm$ for a Reynolds number of 10'000 can be calculated to $0.78m/s \approx 2.88km/h$ which is equivalent to 1 Beaufort[2]. Hence turbulent flow and therefore wind noise is generated whenever the wind speed exceeds about $3km/h$. At this wind speed, the wind direction can only be identified by looking at smoke, and on the water shingle type waves are generated. The pressure fluctuations at each point in the turbulent region act as a source of acoustic waves that propagate outwards in all directions. The resulting sound is therefore the superposition of all the different sources.

2.2 Power Spectrum of Wind Noise

When turbulent flow, for example in the water, is visualized, it can be seen, that the flow contains eddies of various

[1]For air the density is $\rho = 1.225kgm^{-3}$ and the viscosity $\mu = 1.789 \cdot 10^{-5}kgm^{-1}s^{-1}$.

[2]Beaufort wind scale is a system of code numbers from 0 to 12 classifying wind speeds into groups from 0-1 mile per hour or 0-1.6 kilometers per hour (Beaufort 0) to those over 75 miles per hour or 121 kilometers per hour (Beaufort 12).

sizes, that is regions of swirling flow. The largest eddies have a size related to the size, shape and orientation relative to the flow of the obstacle that caused them. They detach from the obstacle and move at the mean velocity of the fluid $V$. The frequency at which the eddies shed from the obstacle is inversely proportional to the size of the eddy and hence to the size of the obstacle $L$, and proportional to the velocity of the air $V$:

$$f \sim \frac{V}{L}. \tag{2.2}$$

The eddies will break down into further small eddies creating new turbulence. The resulting pressure spectrum is continuous with a relatively broad shape where smaller eddies contribute less to the total turbulent energy. The spectrum has a maximum corresponding to the largest eddy size approximately at the frequency denoted by equation 2.2. At high frequencies the amplitude of energy is negligible because the small eddies responsible for this energy contribution decay rapidly. The highest frequency in a typical wind recording is according to [4] about $$f = (R_{crit})^{3/4}(\frac{V}{L}). \tag{2.3}$$

Hence the frequency range of wind noise is usually about a factor of a thousand. This factor is determined by the factor $(R_{crit})^{3/4}$, where $R_{crit} = 10000$ as explained above. There is a lot of small amplitude, high frequency random motion involved in a turbulent flow, the details of which are very difficult to calculate or to predict.

The agreement of the above numbers is, according to [3] fairly good for simple obstacle forms such as a cylindric wire. In Figure 2.1 a typical wind noise power spectrum is shown. The spectrum is very broad and flat but it is obvious that wind noise is a low frequency phenomenon because signal power is low in the range above about 1kHz. The maximum of the spectrum is at about 65 Hz and can, according to equation 2.2, only be generated by an obstacle of about 8 cm. This can clearly not be the head itself. Figure 2.2 shows the according, artificially constructed recording situation, based on pictures in [5]. The wind is blowing at a speed of 5 m/s from front. The airflow is passing around the bald head and generates turbulences at the back side of the obstacle. The recording hearing aids with their microphones are placed behind the manikin ears. Looking at this recording situation it gets clear that the turbulences responsible for the recorded wind noise are not the ones generated by the head, as they would be right at the back end of the head, but by some smaller objects. It is however not possible to simply associate different frequency regions with different obstacles, except that very low frequency turbulence can only be developed by the largest obstacle present, which in this case is the head.

2.3 Correlation and Coherence of Wind Noise

For an obstacle with complex shape, eddies shedding from different parts of the obstacle are incoherent with each other. In case of our head, the air flow is disturbed by the head, the pinna, the tragus, the hearing aid itself and the microphone inlet ports.

The upper plot of Figure 2.3 shows the shape of the cross correlation $r_{12}(m)$ for wind noise sensed by the two microphones of a behind-the-ear (BTE) hearing aid for wind at 5 m/s blowing from an angle of 0°. The correlation between the front and back microphone signals is high only for very small delays, but decays rapidly to approach zero for high

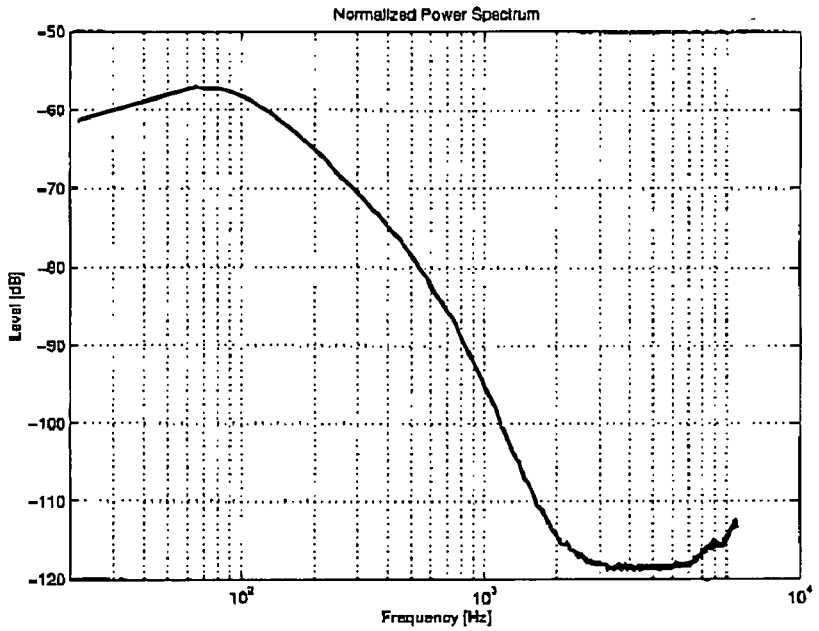
Figure 2.1: Spectrum of a typical wind noise record with wind coming from an angle of 0° with a velocity of 5 m/s
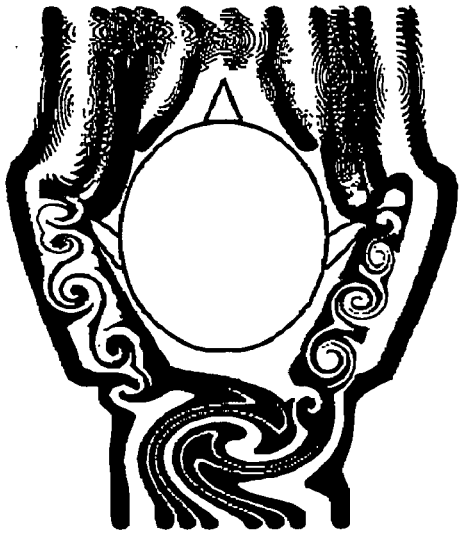
Figure 2.2: Recording situation to obtain the spectrum in Figure 2.1. The wind is blowing at 5m/s from front spreading out over the whole face area. The behind-the-ear (BTE) hearing aid is placed behind the right ear.

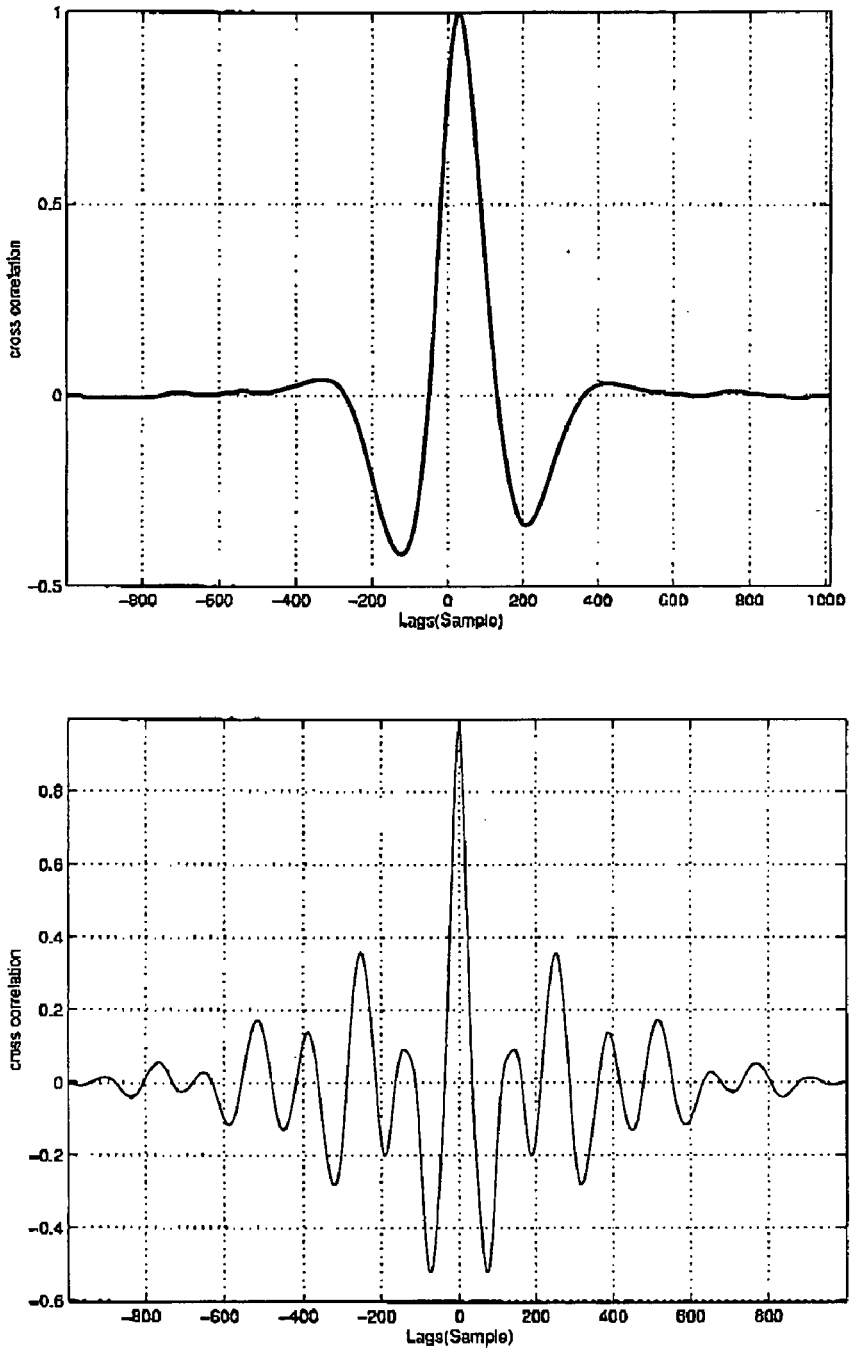
Figure 2.3: *Upper Figure:* Cross correlation of two BTE microphone signals for a wind speed of 5 m/s and an angle of 0° on a bald head. *Lower figure:* Cross correlation of two BTE microphones for a clean speech signal delays. As a comparison the lower plot of Figure 2.3 shows the correlation for a speech signal. The speech signal is a more or less periodic signal, which is manifested also by the somehow periodic correlation function. From this figure it is clear that the correlation of wind differs a lot from that of other signals such as speech. If the correlation is inspected in the frequency domain, the coherence is computed. The coherence, or spectral coherence, of two random processes is a normalized form of the cross power spectral density $$P_{12} = E\{S_1(\omega)S_2^*(\omega)\} = \sum_{m=-\infty}^{\infty} r_{12}(m)e^{-j\omega m} \tag{2.4}$$

and is defined as $$C_{12}{}^2(\omega) = \frac{|P_{12}(\omega)|^2}{P_{11} \cdot P_{22}}, \tag{2.5}$$

Where $P_{11}$ and $P_{22}$ are the power spectral densities of signal $s_1$ and $s_2$ [6]. The coherence function is the equivalent to the correlation coefficient in the frequency domain and shows how well the two signals $s_1$ and $s_2$ correlate at each frequency. It is real valued and the values lie between 0 and 1, where a value near 1 indicates a strong correlation in that frequency interval.

Figure 2.4 shows the coherence function for a typical wind noise recording. It can be seen, that the two microphone signals are highly coherent only for very low frequencies whereas for higher frequencies the correlation decays rapidly and for frequencies above about 1kHz the coherence is approximately zero. The coherence for a speech signal on the other hand would be more or less 1 over the whole frequency range, because for linearly dependent data the coherence is 1.

As mentioned above the low frequency turbulence is generated by the head and therefore is a large scale phenomenon

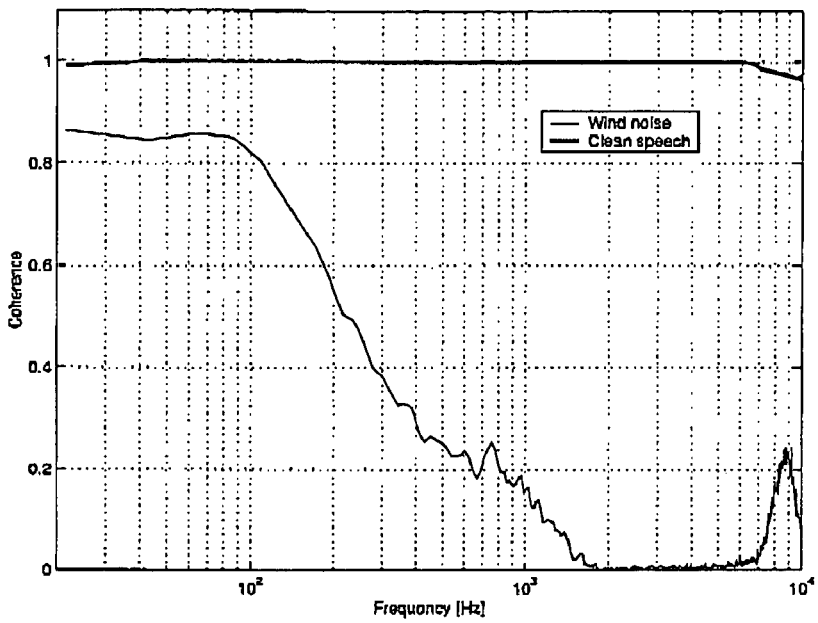

Figure 2.4: Coherence between two microphone signals for wind noise at 5 m/s blowing from front and for clean speech.

that probably is sensed by both hearing aid microphones, whereas the high frequency turbulences may be forced by smaller obstacles such as different parts of the ear and particularly also the microphone inlet ports. These small scale turbulences are therefore different for each of the two microphones and hence the correlation of the two signals is very low in these frequency regions. The peak around 8 kHz in Figure 2.4 is possibly resulting from the limited range of the microphones which is about up to 8 kHz. The peak is found in all the recordings on behind-the-ear (BTE) hearing aids.

2.4 Dependence of Wind Noise

Because the effect an obstacle has on wind noise depends largely on whether eddies shedding by the obstacle pass by the microphone port, the relative effect of the different sources varies with wind direction, wind speed and other obstacles such as for example the hair. In the following subsections the influence of these different environment parameters on the spectral shape and the magnitude of wind noise are summarized. The results presented in the following were obtained by analysis of different wind noise recordings (see Appendix A).

Variation with wind speed

Figure 2.5 shows the power spectrum for three different wind speeds recorded by the font microphone of a behind-the-ear (BTE) hearing aid. An increase or decrease in wind speed results in two main changes. First the spectral shape is retained but the whole spectrum is moved up to higher frequencies with the increase of wind speed. This can also be seen from equations 2.2 and 2.3, that show the bounds of the frequency range for wind noise. Evidently the frequency bounds are proportional to the air velocity $V$. Secondly the noise level is increased with higher wind speeds.

Variation with wind direction

Figure 2.6 shows the different directions of wind arrival measured. The + sign marks the hearing aid close to the wind source, whereas the − marks the hearing aid at the opposite side of the head. For each of these angles Figure 2.7 shows the power spectrum at a wind speed of 5 m/s and no hair present recorded by the front microphone of a BTE hearing aid. It can be seen, that the spectral shape is similar for nearly all angles, but the frequency range and the maximum noise level change for the different angles. For all frequencies the maximum noise level (except below

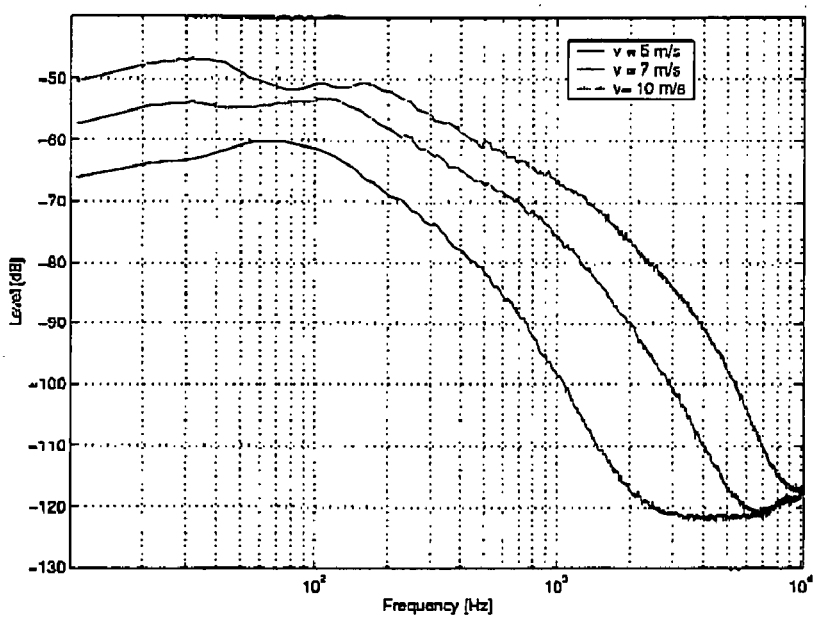
Figure 2.5: Power spectrum for three different wind speeds 5 m/s, 7 m/s and 10 m/s at an angle incidence of 0° and no hair recorded on the front microphone of a BTE hearing aid.
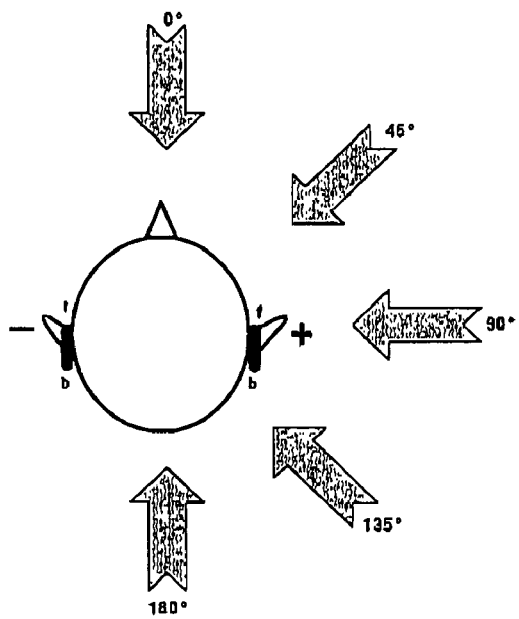
Figure 2.6: Different directions of wind arrival were analyzed. The sounds were recorded on both sides of the head. f: front microphone, b: back microphone of the hearing aid.

40 Hz) is obtained by wind coming from 0°. The minimum noise level on the other hand results from wind blowing from 90°. For a better visualization Figure 2.8 shows the power level for different frequencies versus the angle of incidence. The influence of the angle of incidence is stronger for low frequencies, whereas the difference in magnitude for high frequencies is negligible. The difference in the power level for the different angles can be up to about 30 dB for low frequencies.

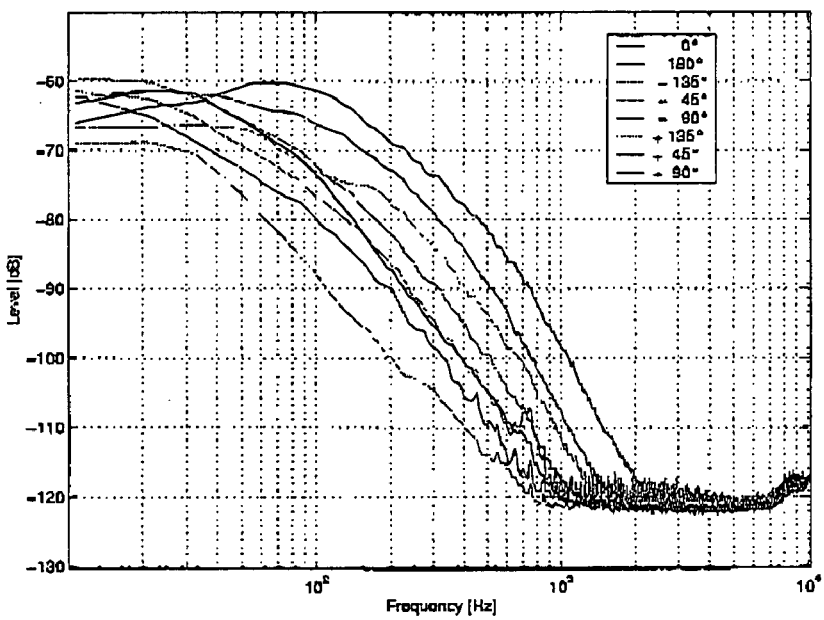

Figure 2.7: Power spectrum for different angles and wind speed of 5 m/s and no hair for the front microphone of a BTE.

Variation with hair cut

The dependence of wind noise on the hair cut is very interesting and could also lead to a most simple solution for wind reduction. The upper plot in Figure 2.9 shows the power spectra for 3 different hair cuts: no hair, short and long hair. It is not that surprising that a person with long hair

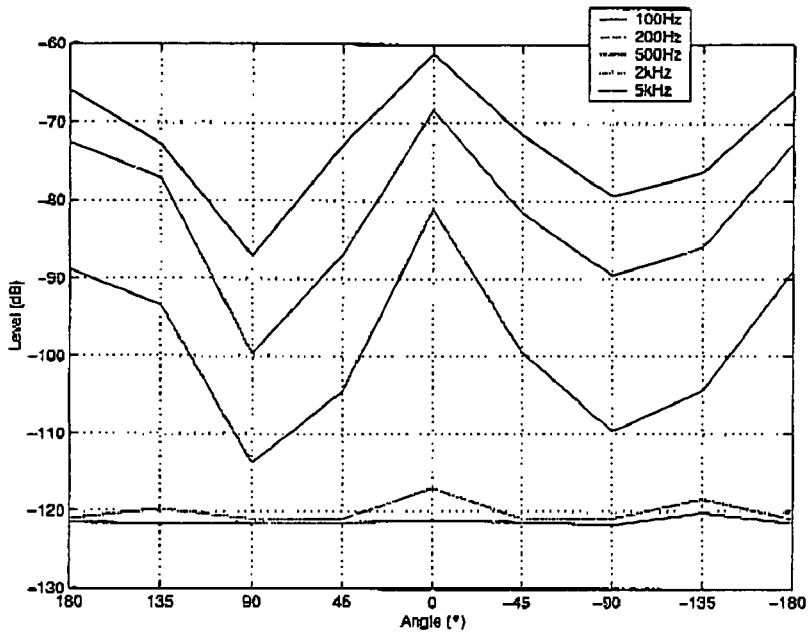

Figure 2.8: Dependence of the frequency on the angle of wind arrival for selected frequencies for a BTE hearing aid type.

does not suffer that much from wind noise, because the long hair does screen the hearing instrument (especially BTE) from the airflow. Also the shape of the spectrum changes with long hair present. The normally mostly flat spectrum then decreases with about -6dB/oct up to 1kHz and then vanishes in the noise floor. The influence of hair is present only if the hair covers or at least touches the hearing aid and is therefore also dependent on the direction of the wind arrival, which can also be seen comparing the plots in Figure 2.9 where the power spectra for two different angles and different hair cuts are shown.

The above observations could therefore lead to a most simple solution to reduce the wind noise problem, namely to wear long hair. Unfortunately this screening solution is only effective in situations where the hair perfectly covers the hearing aid. This is however not guaranteed because the hair is not remaining steady but is moving with the wind.

2.5 Influence of Hearing Aid Position

Hearing Instruments get produced as CIC (completely-in-the-channel), ITE (in-the-ear) and BTE (behind-the-ear) designs. As stated in Section 2.1 the wind noise is the resulting sound developed by turbulences generated by the head, the different parts of the ear and the microphone inlet ports. It is therefore not astonishing that the exact position of the hearing aids and their microphones should have an influence on the spectral shape and magnitude of the wind noise and the correlation between the two microphone signals. Figure 2.10 shows the power spectrum for an ITE and a BTE hearing aid for wind at 5 m/s coming from an angle of 0° recorded by the front microphones. The spectral shape for both is similar and the power level is high for frequencies up to 1kHz. The ITE spectrum is even shifted up to higher frequencies. The difference in magnitude of the two power spectra is however only small.

The depenence on wind source direction is similar for ITE and BTE. In Figure 2.11 the ITE wind noise spectra for different incidence angles at a wind speed of 5 m/s are shown. Comparing with the picture for the BTE spectra in Figure 2.7 on page 23 the maximum for ITE occurs not at an incident angle of 0° but if the wind is coming from 135° on the wind side of the head. Figure 2.12 shows the magnitude of the spectrum for different frequencies plotted versus the angle of incidence. As for the BTE the angle dependence is stronger for low frequencies. The difference in magnitude between the different angles for the ITE type is about 40dB, which is even a bit higher than for the BTE.

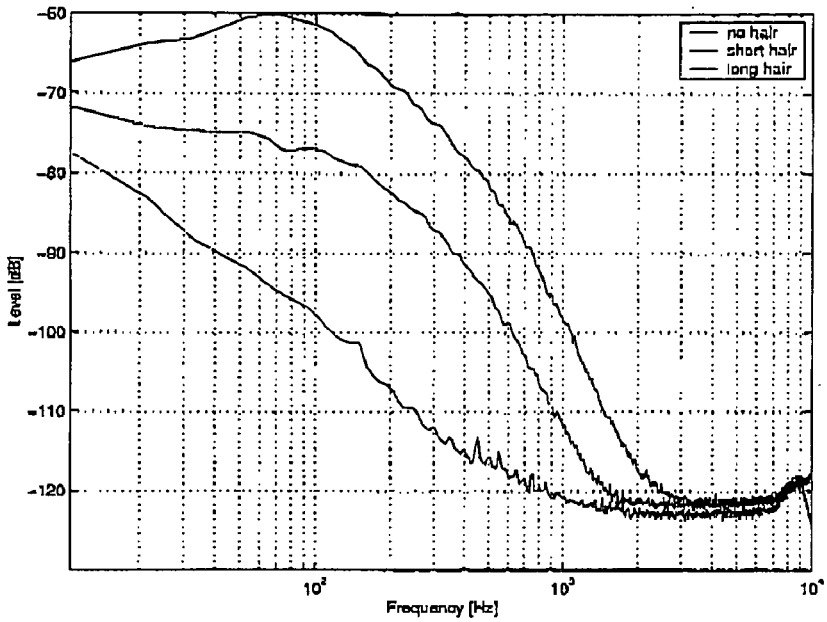
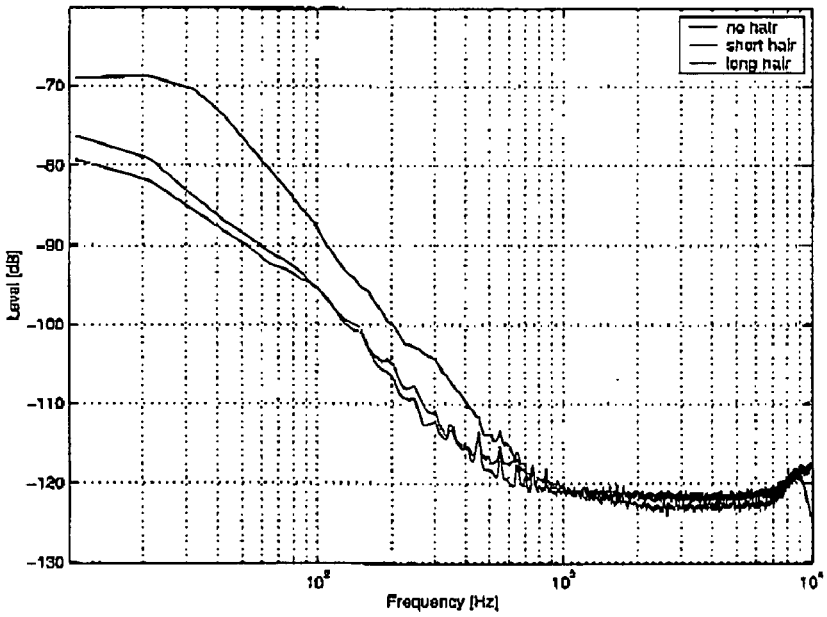
Figure 2.9: *Upper figure:* Power spectrum for different hair for wind at 5m/s from an angle of 0°. *Lower figure:* Power spectrum for different hair for wind at 5m/s from 90°.

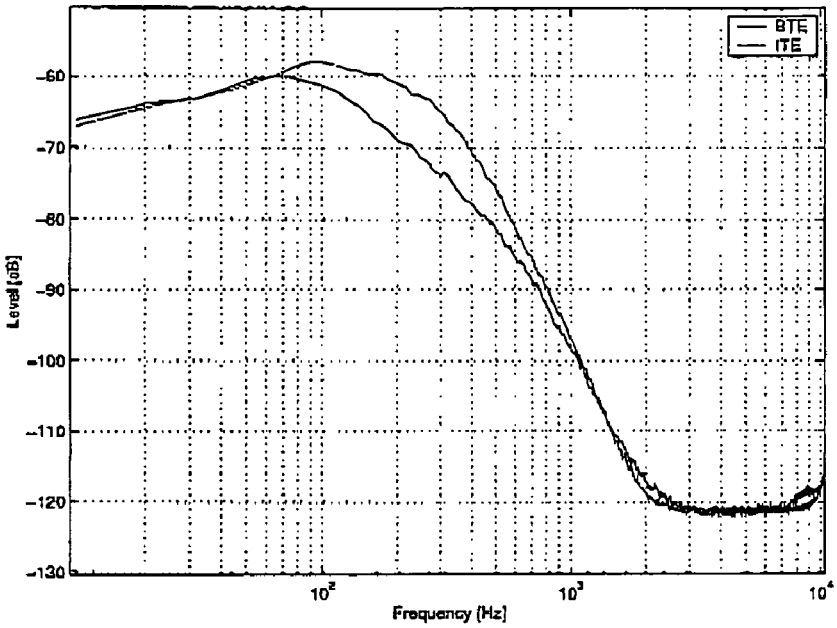
Figure 2.10: Power spectrum for BTE and ITE for wind at 5 m/s from 0° recorded by the front microphones.
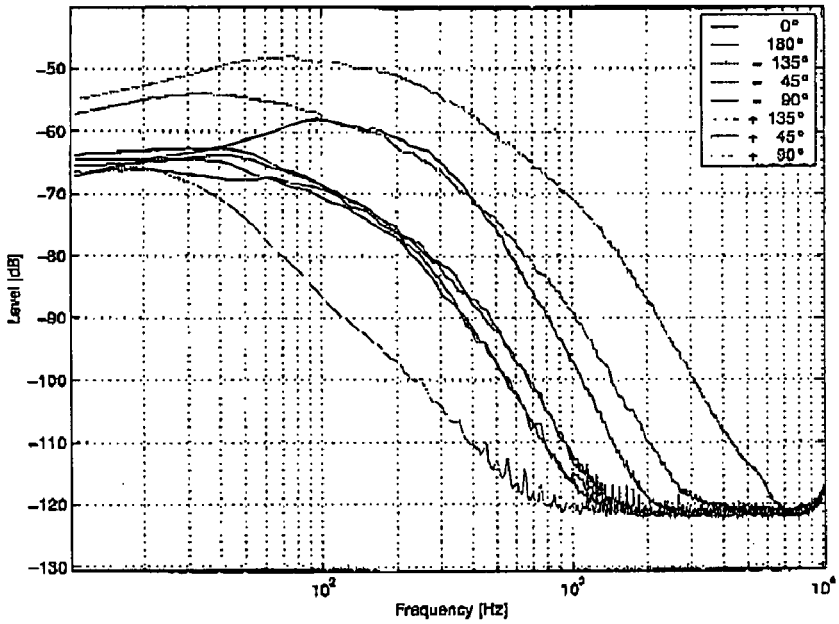
Figure 2.11: Power spectrum for an ITE hearing aid for different angles with wind speed of 5m/s and no hair

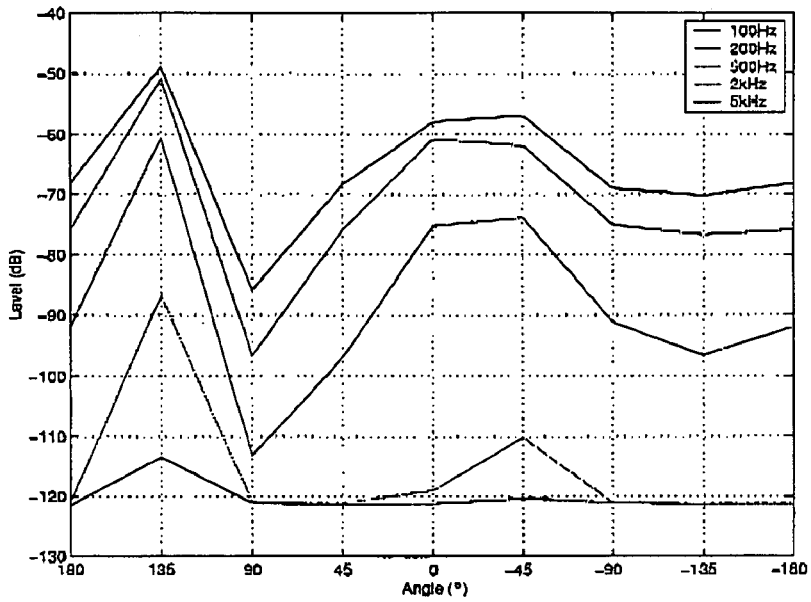

Figure 2.12: Power spectrum for different frequencies versus the angle for an ITE hearing aid The influence of wind speed, as expected, is not dependent on the hearing aid type and the exact microphone position. As for the BTE type the wind noise level in the ITE hearing instrument is increased with higher wind speeds.

As for the BTE the dependence of the shape and magnitude of the spectrum is dependent on the hair cut, that is if the hearing aid is covered or touched by the hair. It is therefore not astonishing that for the ITE the difference between short hair and a bald head is negligibly small, because the hair is not touching the hearing aid in both situations. Figure 2.13 shows the power spectra for the ITE hearing aid for different hair cuts for the wind blowing at 5 m/s from an angle of 0° in the upper figure and from an angle of 135° in the lower figure. The influence of the hair is smaller if the wind is blowing from the front than from somewhere at the back side of the head.

The most astonishing difference between the ITE and

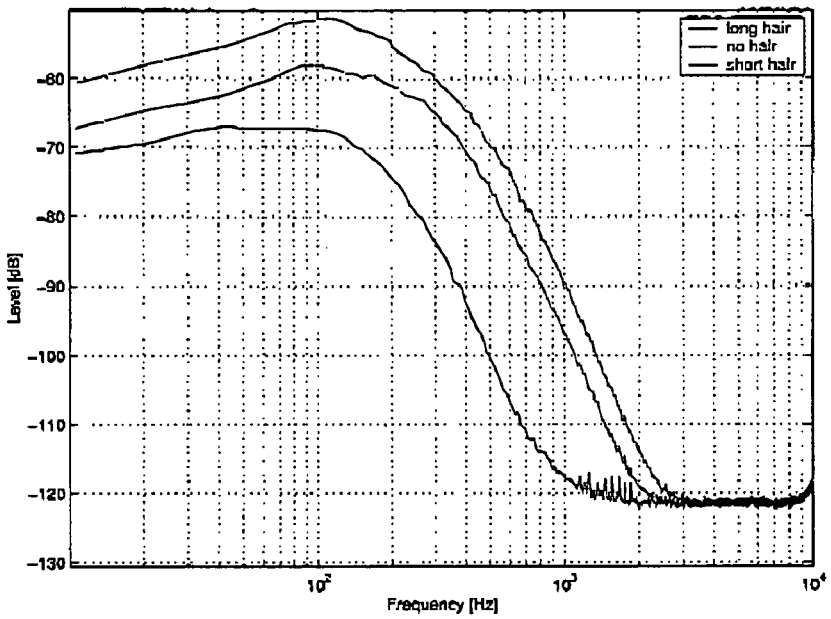
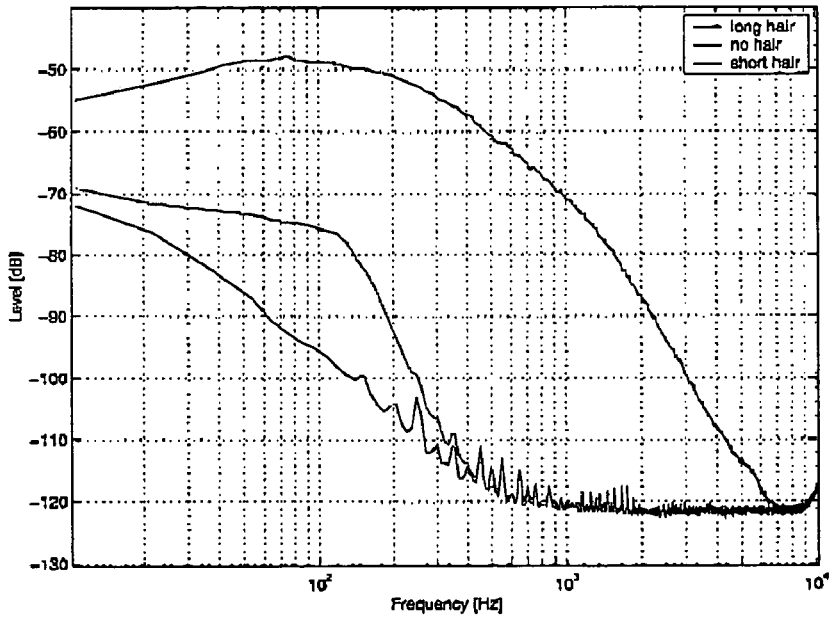
Figure 2.13: *Upper figure:*ITE power spectrum for different hair for wind with speed of 5m/s coming from an angle of 0° *Lower figure:*Power Spectrum for an ITE hearing aid for different hair lengths for wind with speed 5m/s coming from an angle of 135°

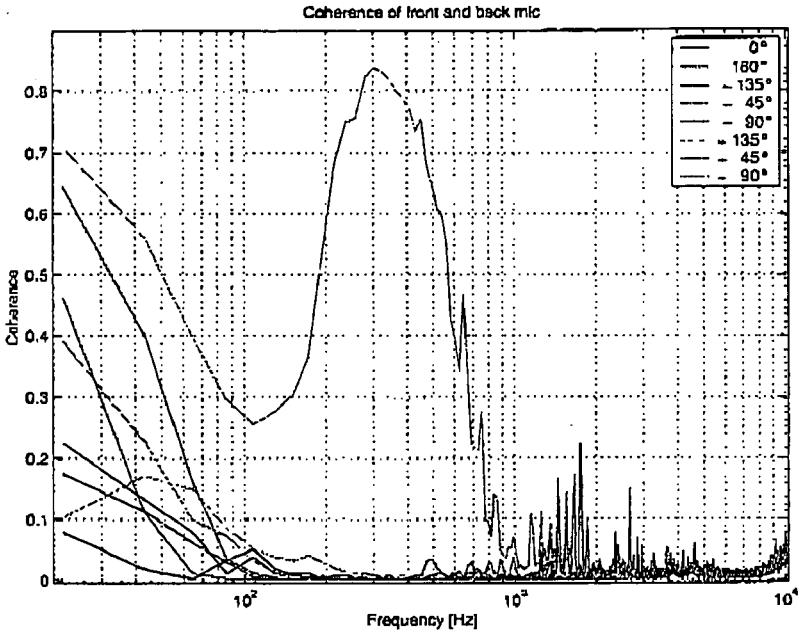

Figure 2.14: Coherence for ITE hearing aid for different angles of incidence

BTE hearing aid is established in the coherence or correlation between front and back microphone. As can be seen by comparing Figure 2.14 and Figure 2.15), the coherence for the ITE hearing aid is much smaller than for the BTE for all frequencies. This probably results from the fact, that the ITE microphones are exposed mainly to small scale turbulences at the ear and the inlet port and lesser extent to large scale turbulences from the head. The peak in Figure 2.14 for an angle of 90° probably results from turbulences that are recorded at both microphones. According to [3] both microphone signals are correlated if they both are screened by the same object, which in this case could be the tragus. For both hearing aid types however the coherence as the power spectrum is dependent on the angle of incicence of the wind.

Out of the previous observations,one can state that the signal characteristics of wind noise changes significantly

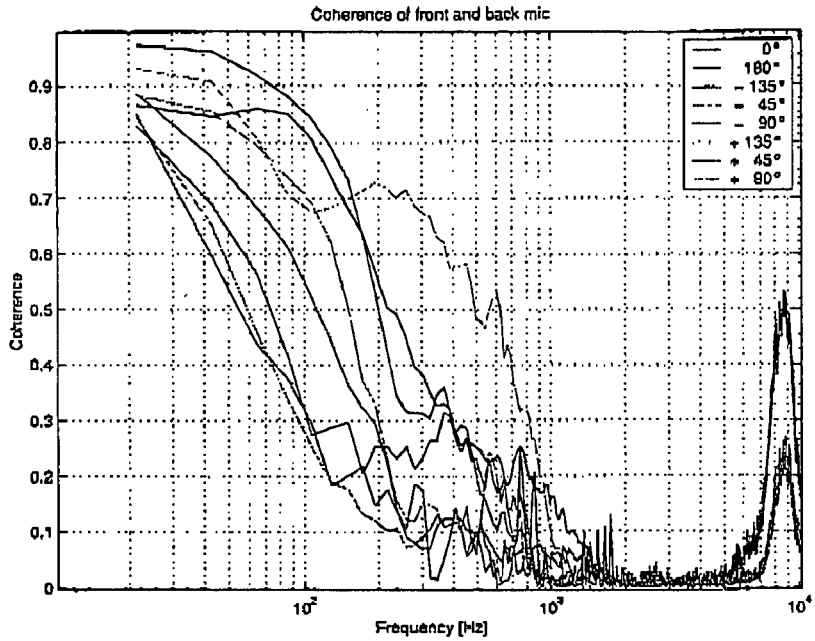

Figure 2.15: Coherence for BTE hearing aid different angles of incidence.

with wind speed, angle of incidence and other factors such as hair cut and hearing aid type and possibly also the individual ear. The analysis does agree with existing wind noise researches [3]. The main discrepancy was found for the power levels of wind noise for BTE and ITE. In [3] the ITE was found to be less sensitive to wind noise than the BTE hearing aid. A possible explanation of this different findings could be found in the measuring method. In this study the wind noise was measured with the microphones in commercially available hearing instruments, whereas in [3] the wind noise was measured with single microphones simply placed at the position of the hearing aid.

The main message from the wind analysis is the same for both studies: The wind noise in hearing aids is influenced by many different factors. It is not always possible to explain all the gained results. For a wind noise canceling algorithm it would therefore be recommendable to adapt to the actual situation to get acceptable results. The following chapters now will propose different solutions for wind noise reduction.

Chapter 3

State of the Art

In this chapter the wind noise reduction solutions found in literature will be pointed out. Although as shown in Chapter 1 wind noise is a problem in hearing instruments, only few research activities can be found in literature. There are basically two different approaches to cope with the problem of wind noise. The first method delineated in Section 3.1 is aimed at the design and protection of the microphone ports. As this mechanical windscreen only resulted in moderate improvement, other solutions in the region of digital signal processing were investigated. The methods and results will be summarized in Section 3.2.

3.1 Mechanical Solutions

First investigations were made to protect the microphone inlet ports with the help of mechanical screening. This technique is also used for microphones for radio and television, which usually are covered with large windscreens. In [7] four hearing instruments with different covers were tested. The windscreens were made of a thin layer of Styrofoam, which is also used as an earphone cover for personal cassette and disc players. It could be shown that the wind noise in the middle frequencies was reduced with the microphone cover but the low frequency part still remains strong. The mechanical windscreen reduces the amount of turbulences and increases the distance between the position of the turbulence and the microphone openings. Additionally it increases the physical dimensions of the microphone cover, resulting in a reduction in the frequency of the turbulence. Some of todays hearing aids are provided with a windscreen covering the cave where the microphones are located. They brought but small improvement in wind noise reduction and therefore other solutions in the region of digital signal processing have to be investigated. However a construction protecting the microphones against wind noise and a possible saturation of the microphone due to the high power of wind noise, would still be useful. If the microphone comes into saturation no wind canceling algorithm can help much because the high magnitude signals will be clipped, resulting in signal distortions.

3.2 Algorithmic Solution

The algorithmic methods found in literature do all rely on more than one microphone, especially for the detection of wind noise. As shown in Figure 1.1 in Chapter 1, a wind noise canceling algorithm can be divided in two main parts. The first part is concerned with the detection of wind noise. If wind noise is present a second block then selects the correct measure to reduce the noise level. The algorithm known from literature delineated in the following sections also follows this structure. In Section 3.2.1 the detection of wind noise will be delineated and and some canceling methods will be listed in Section 3.2.2. In Section 3.3 the algorithm will be evaluated and the results will be discussed.

3.2.1 Wind Noise Detection

As observed in Chapter 2, the correlation between different microphone ports is low compared to other acoustic signals such as for example speech or music. It is therefore evident to use the correlation of the two microphone signals to decide whether wind noise is present or not. The algorithm proposed by Siemens Audiologische Technik GmbH [8] is based on multiple microphones. As shown in the block diagram in Figure 3.1 it uses a simple difference operation to compute the correlation, an averager and a decision block to detect wind noise. The absolute value of the difference $|x(t)|$ decreases with increasing correlation of the two microphone signals. Because wind noise is not correlated the absolute value of the difference is expected to be high and therefore wind is detected if $|x(t)|$ exceeds a threshold. To avoid too frequent changes between the two states wind and no wind, the absolute value of the difference has to stay beyond the threshold for longer than a certain time interval before the systems recognizes the presence of wind.

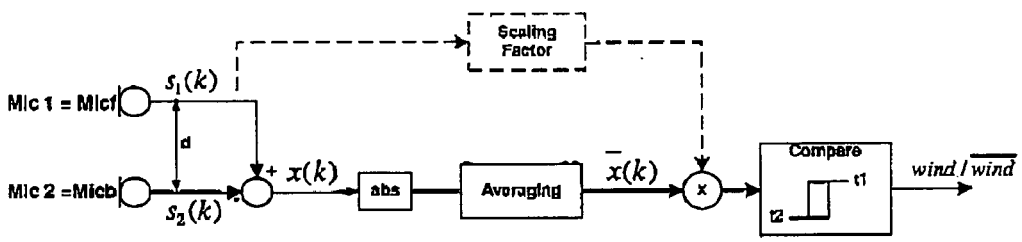

Figure 3.1: Algorithm proposed by Siemens Audiologische Technik GmbH [8].

3.2.2 Measures for Wind Noise Reduction

If wind noise is detected particular measures can be taken to reduce the amount of disturbing noise. In [8] among others, the following measures are proposed:

- change the directivity of the hearing aid by switching of the spatial filtering and use the omnidirectional signal for further processing. The directional microphones are known to be more sensitive for wind noise than the omnidirectional ones, as will be explained in Chapter 5
- use a high pass filter to remove the most dominant low frequency parts of wind noise.
- Propagate further only the signal parts present in more than microphone signals. Signal parts which are present in only one microphone signal shall be filtered out. For this filtering process a subtraction filter is proposed. The uncorrelated wind noise will be suppressed, because no two microphones pick up exactly the same wind noise signals and therefore these signals will not be propagated.

The first measure is probably the most simple one. Unfortunately by switching the directivity of the hearing aid entirely off, the remaining benefits for at higher frequencies, where usually no wind is present but other sounds, will be lost. The other canceling methods, both based on filtering seem more appropriate and more sophisticated. After the observations made in Chapter 2 the filters need to be adapted to the actual situation to get the best results possible.

3.3 Evaluation

To get a first insight into the problem of wind detection the system in Figure 3.1 was reproduced (without the red

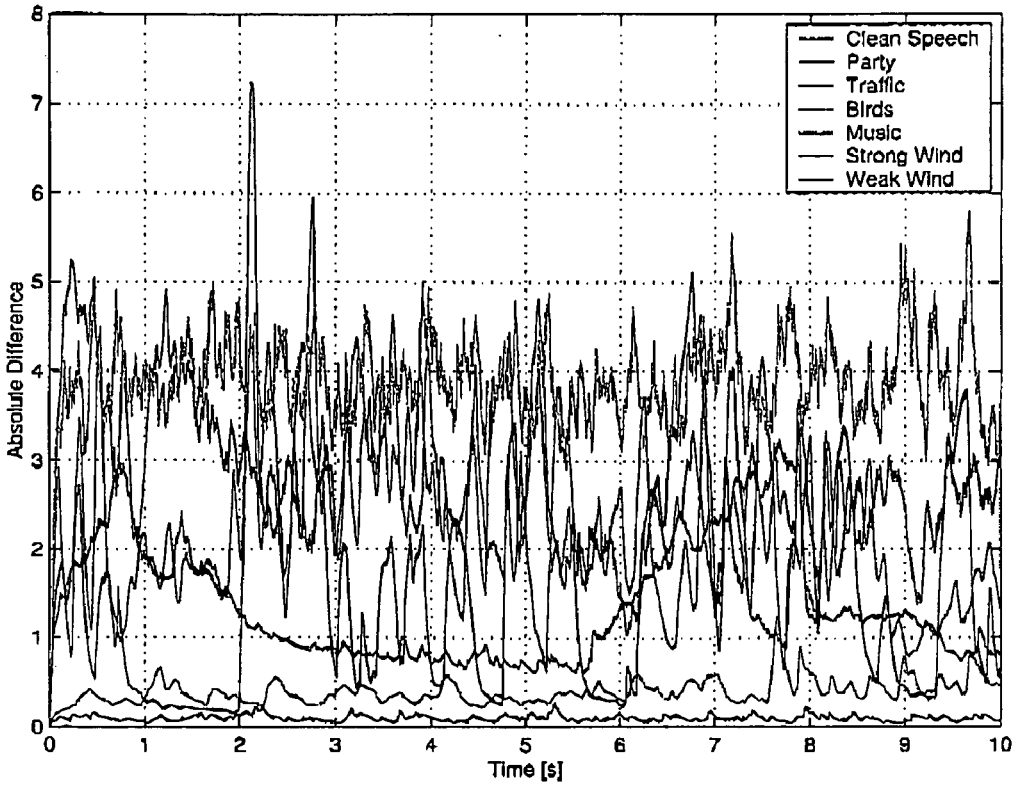

Figure 3.2: Results for system in Figure 3.1 without any scaling of the input signal.

drawn scaling operation). Unfortunately some of the details, such as the averaging filter or the selection of the thresholds, were not exactly described in [8]. The algorithm was tested with different classes of sounds recorded by the same hearing aid type as the wind noises. Figure 3.2 shows the resulting signals after the averaging filter for clean speech, party sound, rain, birds singing and two wind sounds with different power levels. From these results some problems get evident:

- The averaged difference depends on the level of the input signal. High level signals (= loud signals) will result in a high absolute difference although they may be highly correlated. The sounds are never exactly correlated but there is a difference resulting from the propagation delay of the sound caused by the distance between the two microphones.

- The determination of the compare threshold(s) is not described. Should it be estimated analytically? But on the base of which parameter? And should it be adapted to the present situation?

In order to eliminate the first problem, the dependence of the averaged difference on the input level a scaling block was inserted as shown in Figure 3.1 in red. Two different scaling factors were tried out. Figure 3.3 shows the result for scaling the difference with the maximum of the input signal magnitude. As can be seen the second problem of the threshold selection still is present. It is still not evitent how to select an appropriate threshold. Figure 3.4 shows a second attempt for a scaling factor. This time the averaged difference was scaled by the maximum power of the input signal. Again the separation between wind noise and other sounds is not evident. As the results shown in Figures 3.3 and 3.4 showed, a threshold selection is not straight forward, not even by visually inspecting the results. The algorithm was not investigated further, but a slightly different algorithm, presented in Chapter 4, was developed, explaining the shortfalls of this state of the art algorithm.

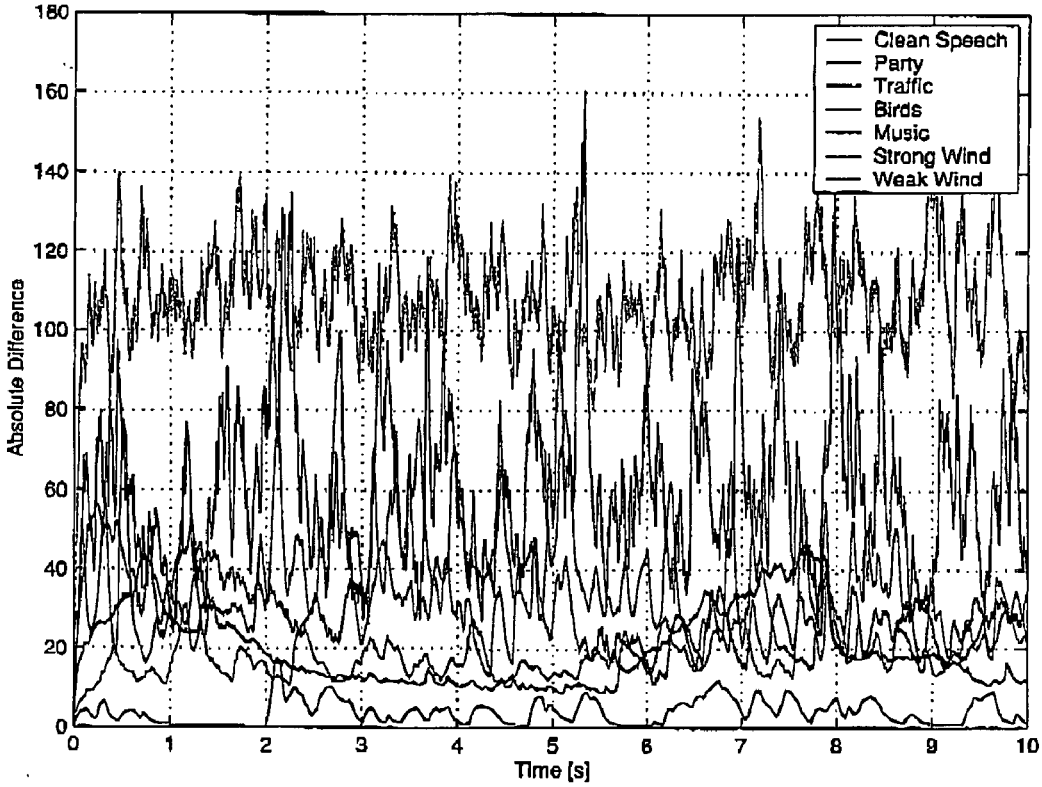
Figure 3.3: Results for system in Figure 3.1 for scaling with the maximum of the input signal magnitude.

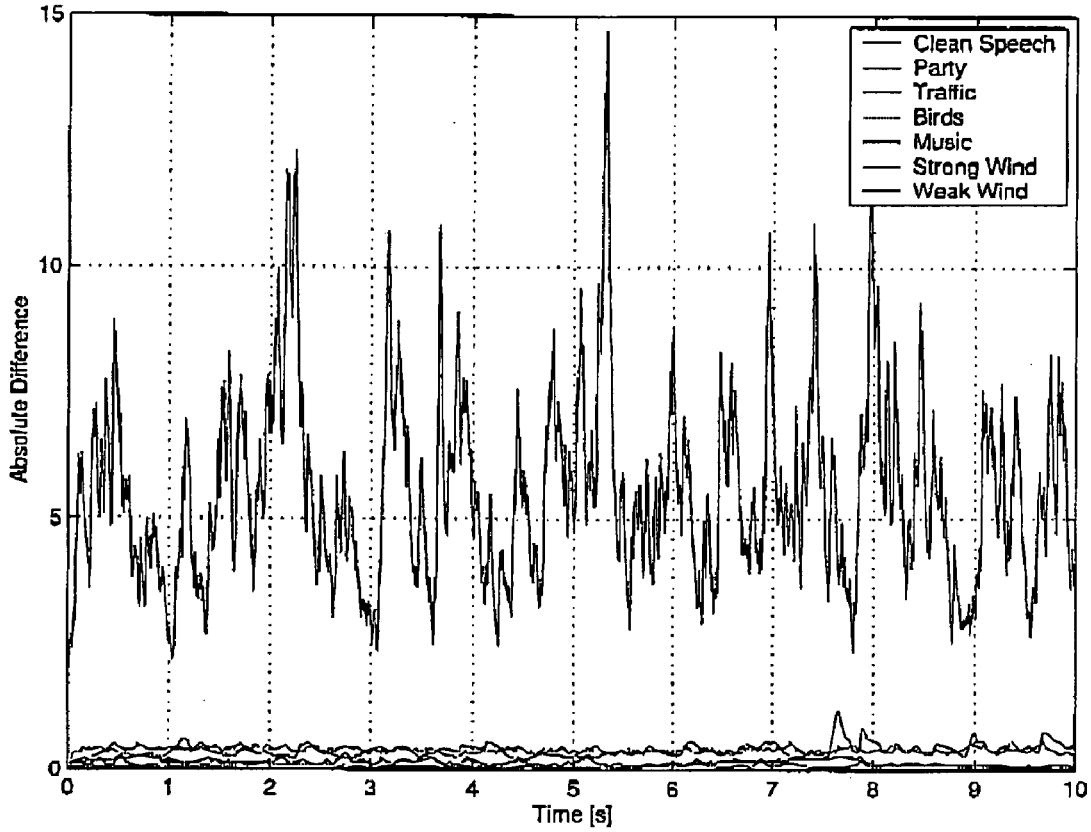
Figure 3.4: Results for system in Figure 3.1 for scaling with the maximum power of the input signal.

Chapter 4

Multi Channel Solution

This Chapter describes an approach for the detection and cancelation of wind noise in hearing aids using multiple microphone signals. The algorithm is developed step by step based on the observations made with the system described in Chapter 3. In a first step the computation of the correlation by a simple subtraction is transformed into the frequency domain in Section 4.1. In a next step described in Section 4.2 the subtraction operation is replaced by a spatial filter (beamformer) which is a part of a basic hearing aid system. Finaly the gain applied to the input signal is established by the Wiener filter theory as delineated in Section 4.3. In Section 4.4 the results obtained by the algorithm will be presented and discussed.

4.1 Frequency Domain System

Going back to the plots of the coherence function for a typical wind noise recording as shown in Figure 2.4, it can be observed that the correlation between the two microphone signals of a hearing instrument depends strongly on frequency. Hence computing the difference in the frequency domain as shown in Figure 4.1 should enable a better distinction between the different classes of signals. Likewise, in state of the art beamforming algorithms, the spectra of the microphone signals is often computed, thus this operation is "for free".

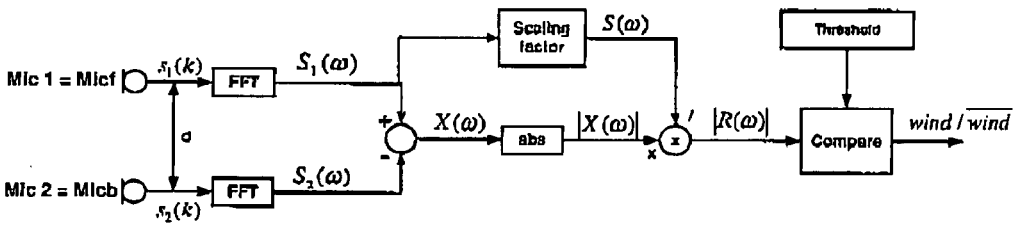

Figure 4.1: Algorithm for wind noise detection using two microphones. The correlation between the two microphones is computed in frequency domain, by a simple subtraction.

In the following the system shall be analyzed analytically to get a better insight in its performance. Figure 4.2 shows the situation for a plane wave signal $s(t)$ with the spectrum $S(\omega)$.

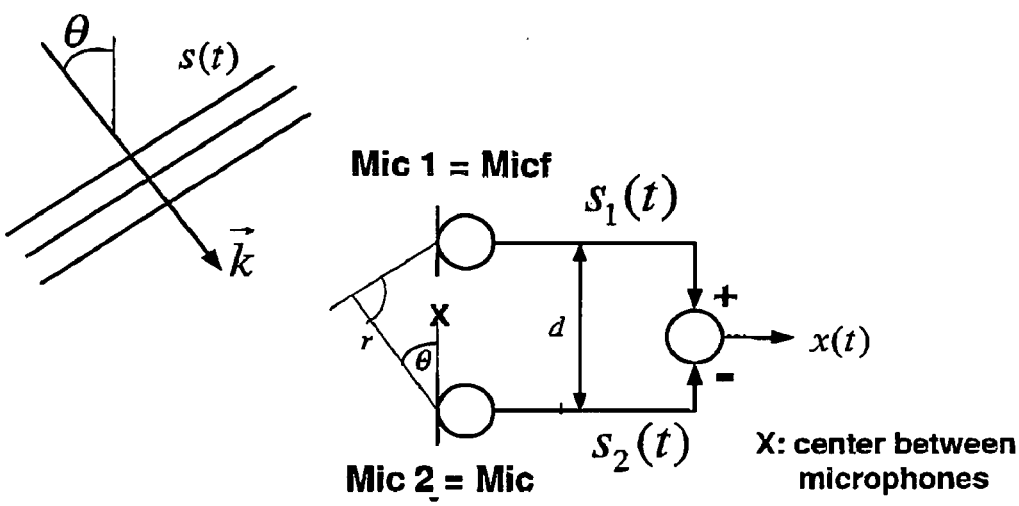

Figure 4.2: Situation for plane wave signal.

With the vektor $\vec{k}$ going through the center between the two microphones the two input signals $s_1(t)$ and $s_2(t)$ and their corresponding spectra are:

$$s_1(t) = s(t - \tau/2) \qquad S_1(\omega) = S(\omega)e^{-j\omega\tau/2} \quad (4.1)$$
$$s_2(t) = s(t + \tau/2) \qquad S_2(\omega) = S(\omega)e^{j\omega\tau/2} \quad (4.2)$$

with $\tau = \frac{r}{c} = \frac{dcos\Theta}{c}$ where $c$ is the speed of sound. The output signal spectrum $X(\omega)$ can be written as, $$\begin{aligned} X(\omega) &= S_1(\omega) - S_2(\omega) = -S(\omega)[e^{j\omega\tau/2} - e^{-j\omega\tau/2}] \\ &= -2jS(\omega)sin(\omega\tau/2) = -2jS(\omega)sin(\frac{\omega d}{2c}cos\Theta) \end{aligned} \quad (4.3)$$

Normalizing the output signal by the input spectrum $S(\omega)$ results in $$|R(\omega)| = |\frac{X(\omega)}{S(\omega)}| = 2|sin(\frac{\omega d}{2c}cos\Theta)| \quad . \quad (4.4)$$

The value given in equation 4.4 evaluated at an angle $\Theta = 0°$ defines therefore an upper bound for the magnitude of the normalized spectrum of the difference $|R(\omega)| = |\frac{X(\omega)}{S(\omega)}|$ in Figure 4.1 for plane wave signals from any incident direction. This bound can now be used as a threshold to compare with. All acoustic signals should approximate this value very well, because they arrive at the microphones as more or less plane waves, whereas the wind noise signal is expected to differ considerably from this plane wave situation.

4.2 Beamforming

By closer inspecting the behavior of the difference operation it gets clear that it behaves like a spatial filter also known as beamformer. Figure 4.3 shows the general architecture of a

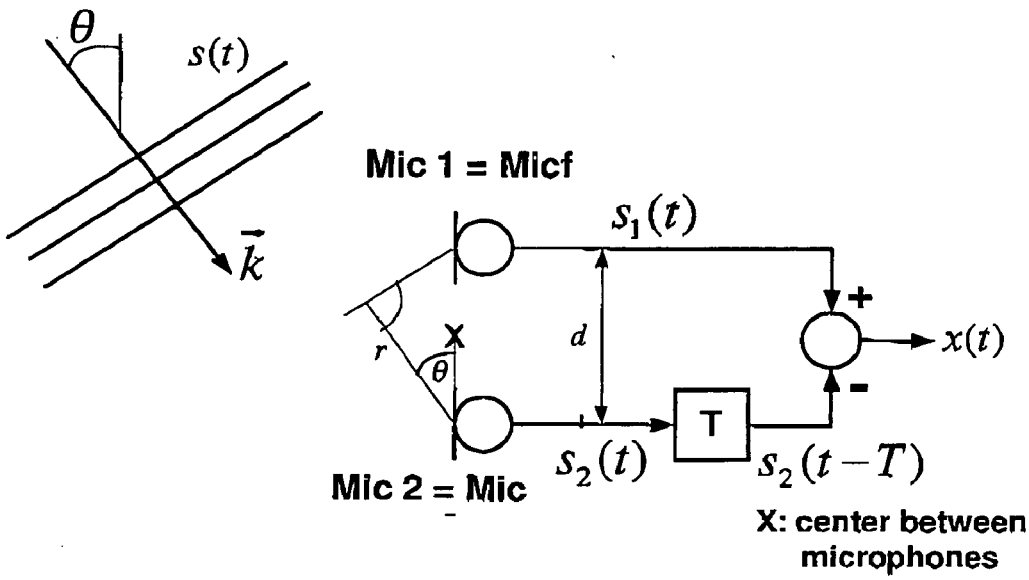

Figure 4.3: Spatial filter situation for a plane wave.

spatial filter [9] for a plane wave signal $s(t)$ with spectrum $S(\omega)$.

This situation is similar to the one shown in Figure 4.2 but with an additional delay $T = d/c$ in one of the signal paths. Therefore equation 4.3 changes to $$X(\omega) = -2jS(\omega)e^{-j\omega T/2}sin(\frac{\omega\tau}{2c}cos\Theta + 1) \quad (4.5)$$

$$= 2jS(\omega)e^{-j\omega T/2}sin(\frac{\omega d}{2c}(1 + cos\Theta)) \quad (4.6)$$

and therefore, $$|Cf(\omega)| = |X(\omega)| = 2|S(\omega)sin(\frac{\omega d}{2c}(1 + cos\Theta))| \quad (4.7)$$

and the normalized spectrum, $$\left|\frac{Cf(\omega)}{S(\omega)}\right| = 2|sin(\frac{\omega d}{2c}(1 + cos\Theta))| \quad (4.8)$$

now specifies the upper bound for acoustic signals arriving as plane waves at the two microphones at an angle of incidence $\Theta$. Figure 4.4 shows the value in equation 4.8 over frequency for an angle $\Theta = 0°$. The first zero of the function in equation 4.8 for $\Theta = 0$ is calculated by $$2sin(\frac{\omega d}{c}) = 0 \quad \Rightarrow \quad \frac{\omega d}{c} = n\pi \quad . \tag{4.9}$$

Hence the frequencies for which the equation 4.8 is zero are given by $$\omega_n = \frac{n\pi c}{d} \quad \text{and} \quad f_n = \frac{nc}{2d}. \tag{4.10}$$

The first zero, for a microphone distance of 12 mm, is according to equation 4.10 at the frequency $f_0 = \frac{c}{2d} =$ 14.3kHz. For a sampling frequency of 22.05 kHz this zero lies well outside the usefull frequency range. Additionally, an antialiasing filter will limit the maximum frequency to about 8 kHz hence the zeros of the function in equation 4.8 will not be a problem. In the used frequency range (100Hz-8kHz) the upper bound has a constant slope of -6dB/oct.

4.3 Noise Reduction Using a Wiener Filter

The aim of a wind noise canceling block is to remove the noise from a composed signal and output only the desired signal. This situation is shown in Figure 4.5. It is supposed that the input signal $x(k)$ consists of the sum of a desired signal $s(k)$ and an undesired noise $n(k)$, which in this case is the wind noise. The optimum linear filter $h(k)$ for a given signal statistics is called the Wiener filter. It is optimal in the sense that the mean value of the squared error signal $e(k)$, the mean-square error (MSE) is minimal.

now specifies the upper bound for acoustic signals arriving as plane waves at the two microphones at an angle of incidence $\Theta$. Figure 4.4 shows the value in equation 4.8 over frequency for an angle $\Theta = 0°$. The first zero of the function in equation 4.8 for $\Theta = 0$ is calculated by $$2sin(\frac{\omega d}{c}) = 0 \quad \Rightarrow \quad \frac{\omega d}{c} = n\pi \quad . \tag{4.9}$$

Hence the frequencies for which the equation 4.8 is zero are given by $$\omega_n = \frac{n\pi c}{d} \quad \text{and} \quad f_n = \frac{nc}{2d}. \tag{4.10}$$

The first zero, for a microphone distance of 12 mm, is according to equation 4.10 at the frequency $f_0 = \frac{c}{2d} =$ 14.3kHz. For a sampling frequency of 22.05 kHz this zero lies well outside the usefull frequency range. Additionally, an antialiasing filter will limit the maximum frequency to about 8 kHz hence the zeros of the function in equation 4.8 will not be a problem. In the used frequency range (100Hz-8kHz) the upper bound has a constant slope of -6dB/oct.

4.3 Noise Reduction Using a Wiener Filter

The aim of a wind noise canceling block is to remove the noise from a composed signal and output only the desired signal. This situation is shown in Figure 4.5. It is supposed that the input signal $x(k)$ consists of the sum of a desired signal $s(k)$ and an undesired noise $n(k)$, which in this case is the wind noise. The optimum linear filter $h(k)$ for a given signal statistics is called the Wiener filter. It is optimal in the sense that the mean value of the squared error signal $e(k)$, the mean-square error (MSE) is minimal.

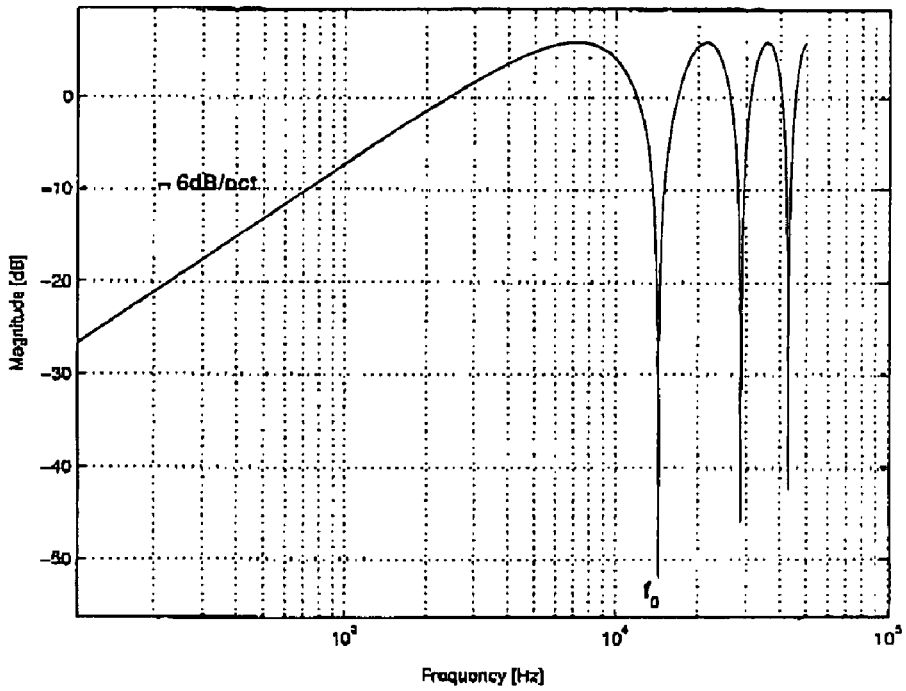

Figure 4.4: Frequency response of the upper bound, defined in equation 4.8 for $\Theta = 0°$, for the normalized difference of the two microphone signals for plane wave signals. The function rises with -6dB/oct up to a frequency of about 7kHz. The fist zero $f_0 = \frac{c}{2d}$ for a microphone distance of 12 mm and a sampling frequency of 22.05kHz lie well outside the usefull frequency range.

As developed in [6] the Wiener filter can also be expressed in frequency domain as, $$H(\omega) = \frac{S(\omega)}{X(\omega)} = \frac{S(\omega)}{S(\omega) + N(\omega)} \tag{4.11}$$

which in this case would be suitable, because the detection part also operates in the frequency domain.

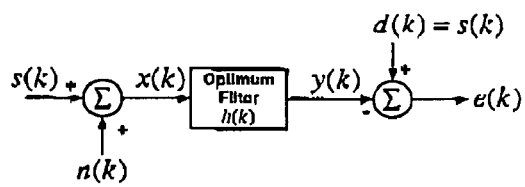

Figure 4.5: Standard situation for Wiener filter.

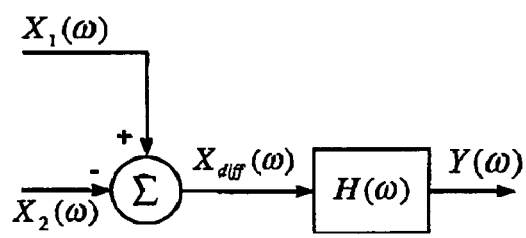

Figure 4.6: Wiener filter for wind canceling system defined on the difference signal.

In order to search for the Wiener filter for the situation with two noisy microphone signals we start from Figure 4.6. The two microphone signals are both expected to consist of a desired acoustic signal that is equal at both microphones except for a delay term and two additive wind noise parts that are different for both microphone ports. Hence the power spectra of the two input signals can be defined as $$X_1(\omega) = S_1(\omega) + N_1(\omega) \tag{4.12}$$

$$X_2(\omega) = S_2(\omega) + N_2(\omega) \quad , \tag{4.13}$$

and the spectrum of the difference $X_{diff}(\omega)$ is given by $$\begin{aligned} X_{diff}(\omega) &= S_2(\omega) - S_1(\omega) + (N_2(\omega) - N_1(\omega)) \\ &= S_{tot}(\omega) + N_{tot}(\omega) \quad , \end{aligned} \tag{4.14}$$

where $S_{tot} = S_2(\omega) - S_1(\omega)$ and $N_{tot} = N_2(\omega) - N_1(\omega)$.

Now the Wiener filter can be written according to equation 4.11 for the input signal $X_{diff}(\omega)$ to, $$|H(\omega)| = \left|\frac{S_{tot}(\omega)}{X_{diff}(\omega)}\right| = \frac{|S_{tot}(\omega)|}{|S_{tot}(\omega) + N_{tot}(\omega)|} = \frac{|S_{tot}(\omega)|}{|\mathrm{Cf}(\omega)|}. \tag{4.15}$$

Equation 4.15 is therefore the optimum filter to remove wind noise while preserving the characteristics of the desired signal. If $S_1(\omega)$ and $S_2(\omega)$ are defined as in equation 4.1 to $S_1(\omega) = S(\omega)e^{-j\omega\tau/2}$ and $S_2(\omega) = S(\omega)e^{j\omega\tau/2}$, $S_{tot}$ can be written as $$|S_{tot}| = |S_2(\omega) - S_1(\omega)| = |S(\omega)[e^{j\omega\tau/2} - e^{-j\omega\tau/2}]| = \left|2jS(\omega)sin(\frac{\omega d}{2c}cos\Theta)\right| \tag{4.16}$$

which is equivalent to equation 4.4. Hence taking this upper bound $R_{max}$ for the value $S_{tot}$ in equation 4.15 should result in a nearly optimal filter for this problem.

Applying the gain defined as $$G(\omega) = H(\omega) = \frac{R_{max}(\omega)}{\frac{\mathrm{Cf}(\omega)}{X_1(\omega)}} \tag{4.17}$$

to the input signal of one of the microphones in Figure 4.1 would result in the desired signal without noise. Using $|X_1|$ for the normalization of —Cf($\omega$)— instead of the clean signal spectrum $|S(\omega)|$ as in equation 4.8 will result in a small error, which is a function of the signal-to-noise ratio (SNR) of the input signal.

Figure 4.7 now shows the block diagram of the whole wind detection and cancelation system in the case two ore more microphones are present. The Wiener filter $H(\omega)$ is applied to one of the input signals, and the resulting spectrum is transformed back to time domain to produce a noise free signal at the loudspeaker end. Additionally, the attenuation of the Wiener filter is limited to a maximum of $-25dB$ to reduce possible artifacts. The analyticaly set, frequency dependent threshold of the system described so far does eliminate the shortfall of an appropriate threshold in the state of the art system presented in Chapter 3.

4.4 Results for Multi Channel Solution

In order to demonstrate the performance of the algorithm the different steps are analyzed separately. As described in the previous sections acoustic signals arrive at the microphones as plane waves. Figure 4.8 shows the normalized beamformer output $\frac{Cf(f)}{S_1(f)}$ for different sounds, such as clean speech, party environment, traffic, birds singing ,music, and two different wind strengths. Additionally the maximum value predicted for plane waves is plotted. It can be seen that all signals except the two wind sounds exhibit a roll-off of $-6dB/oct$, which is typical for the beamformer. Only for very low frequencies also the other signals deviate from the roll-off.

The gain applied to the signal spectra is shown in Figure 4.9. As developed in the previous section in equation 4.17 the gain is calculated as the ratio of the maximum predicted value for plane waves and the normalized beamformer output.

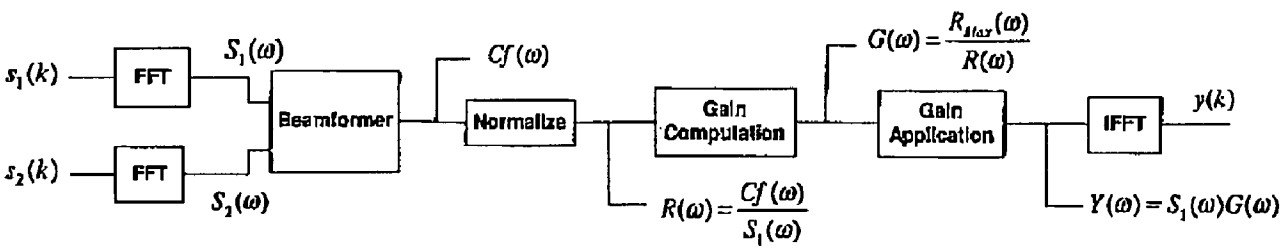
Figure 4.7: Schematic overview of the proposed multichannel solution. First the signals are transformed into the frequency domain, then the beamforming is applied to the input signals and then the gain is computed

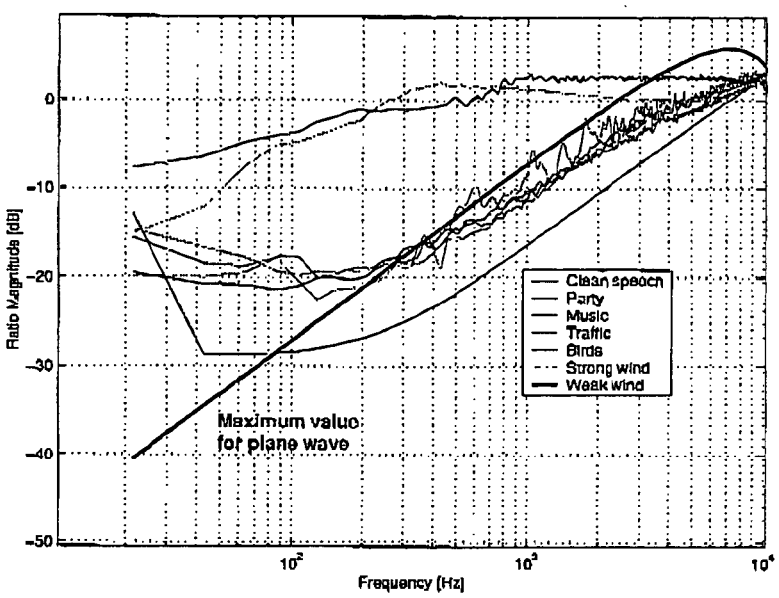
Figure 4.8: Beamformer output for different sounds, such as clean speech, party environment, traffic, birds singing, music and two different wind strengths. It gets evident that all signals, except wind noise, do exhibit the typical beamformer roll-off of -6dB/oct.

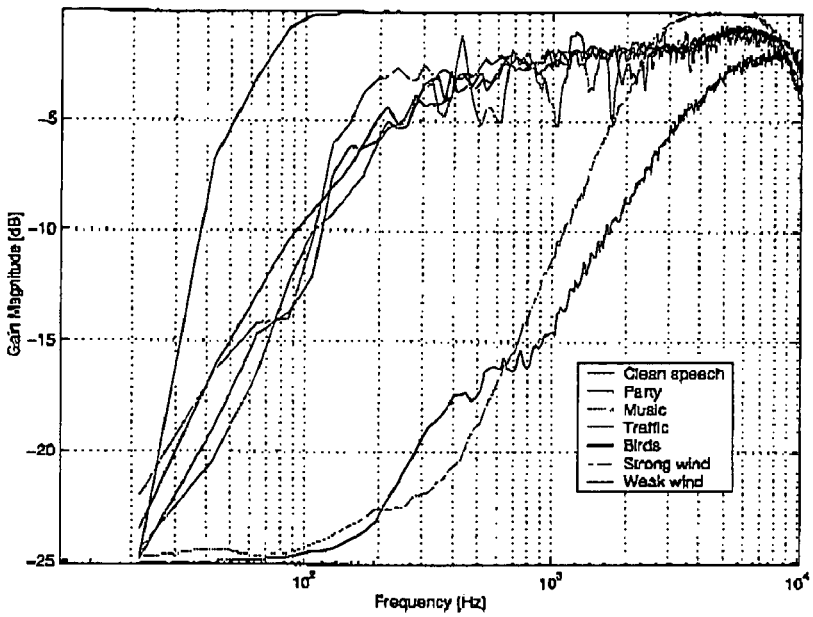
Figure 4.9: Gain for different sounds, such as clean speech, party environment, traffic, birds singing, music and two different wind strengths. Other sounds than wind get not or only to a small amount attenuatd above about 200Hz, what is exactly what was expected.

| SNR | Speech Power [dB] | Wind Power [dB] |
|---|---|---|
| 20 | -21.86 | -41.86 |
| 10 | -21.86 | -31.86 |
| 0 | -21.86 | -21.86 |
| -5 | -21.86 | -16.86 |
| -10 | -21.86 | -11.86 |
| -15 | -21.84 | -6.86 |

Table 4.1: Average root-mean-square (RMS) levels for the composite signals of speech in wind with different signal-to-noise ratios (SNR).

From Figure 4.9 it can be seen, that the algorithm performs as expected. The wind sounds get attenuated but the other sound types are not or only by a small amount affected by the attenuation.

To get an impression on how the above wind noise canceling algorithm affects the signal spectrum, Figure 4.10 through Figure 4.12 show the input and output spectra as well as the normalized beamformer output, the gain and the maximum value predicted for plane waves, for party environment, traffic noise and wind noise. The output spectra for all these sounds are attenuated at lower frequencies but only the wind noise spectrum is affected by the filtering process over a broader frequency range.

An other interesting point concerning the algorithm's performance is the behavior in the situation where speech is mixed with wind noise. This situation is of particular interest, because applying a high pass filter to the input signal is expected to affect also the low frequency parts of the speech spectrum. Table 4.1 shows the composition of the test signals. Unfortunately the algorithm could only be tested with a female voice, because no two channel recording of clean male speech was available. The difference would mostly be noticeable at low frequencies, but the performance should be almost the same.

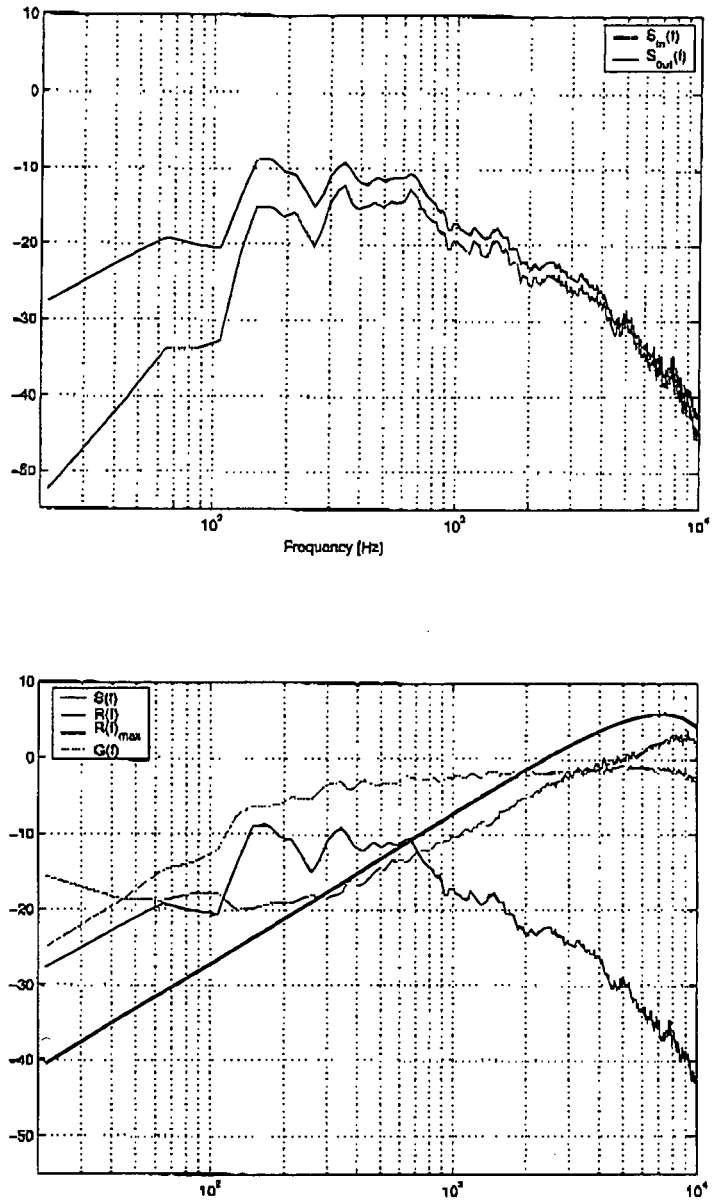
Figure 4.10: *Upper figure:* Input and output spectra for party environment. *Lower figure:* Input spectrum S(f) for party environment and the corresponding wind canceling parameters such as the normalized beamformer output $\frac{C_f}{S}$, the gain and the maximum value for plane waves.

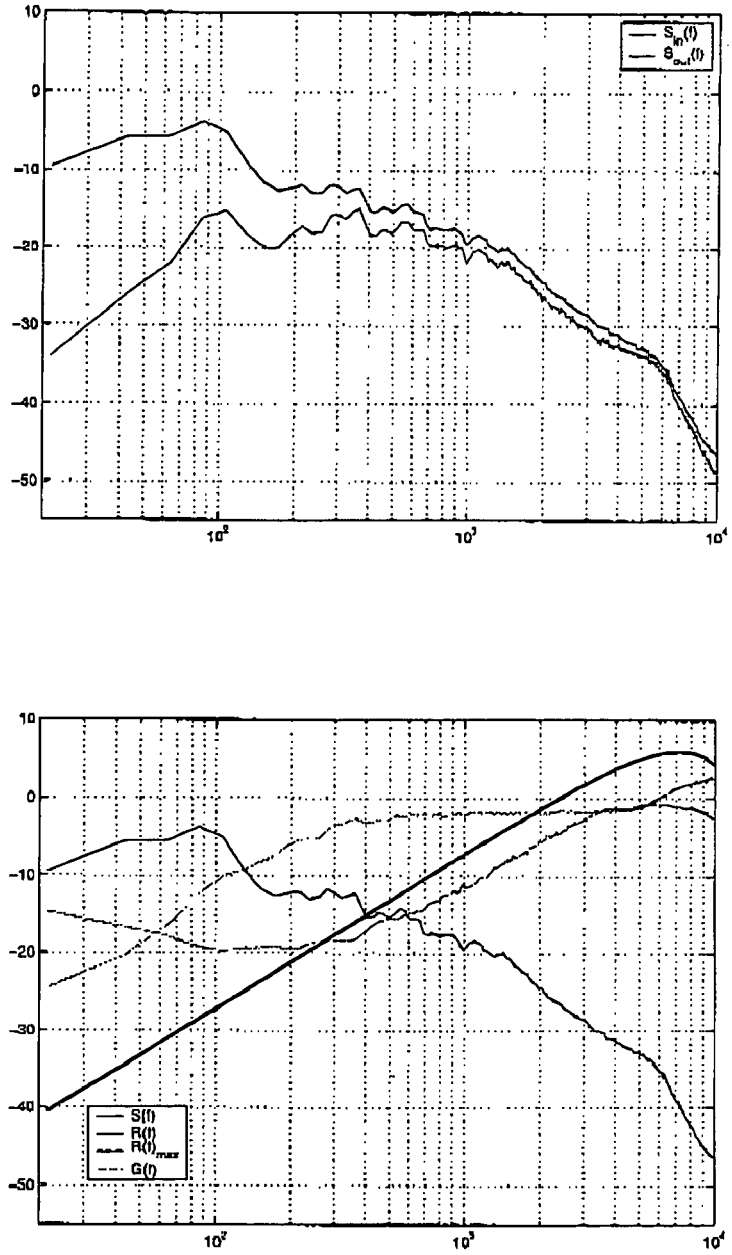
Figure 4.11: *Upper figure:* Input and output spectra for traffic noise. *Lower figure:* Input spectrum S(f)for traffic noise and the corresponding wind canceling parameters such as the normalized beamformer $\frac{Cf}{S}$, the gain and the maximum value for plane waves.

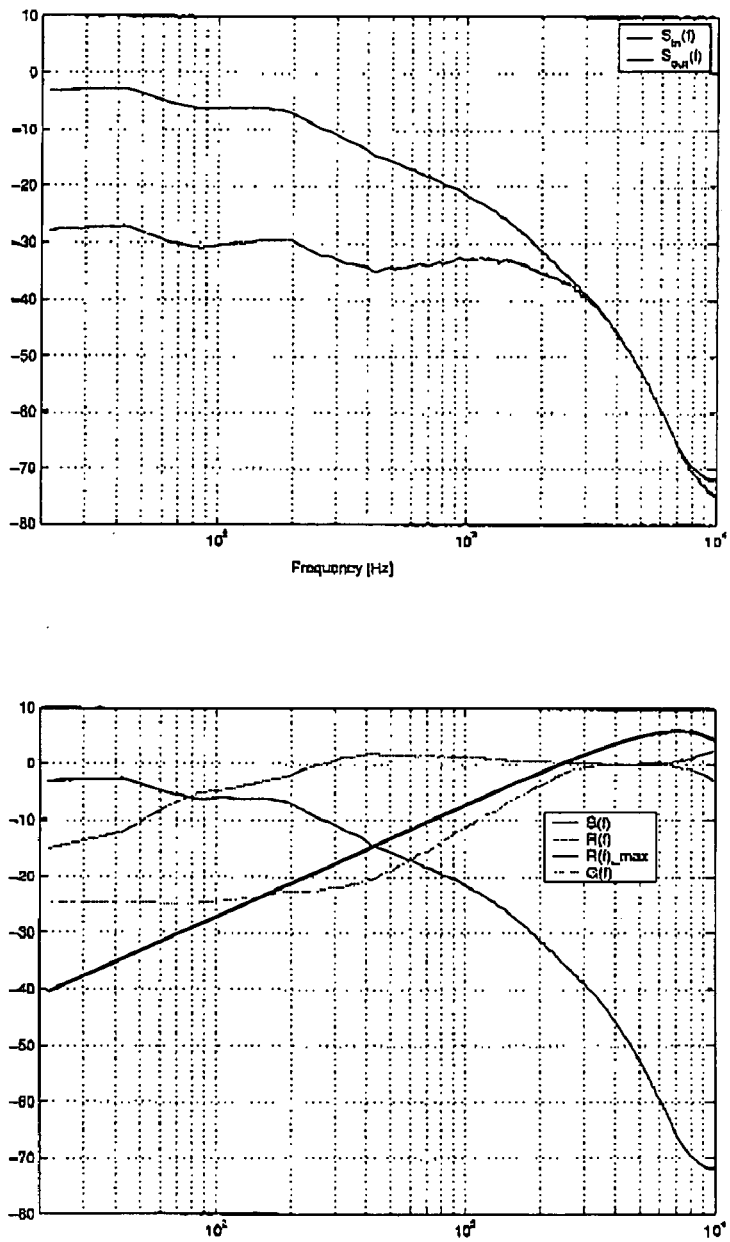
Figure 4.12: *Upper figure:* Input and output spectra for wind noise at 10 m/s from an angle of 0° measured by the two BTE microphones. *Lower figure:* Input spectrum S(f)for wind noise and the corresponding wind canceling parameters such as the normaized beamformer output $\frac{Cf}{S}$, the gain and the maximum value for plane waves.

Figure 4.13 shows the input spectra for the composite signals in Table 4.1. The spectra is an average over multiple signal frames of 1024 samples. With decreasing SNR the spectra of the composite siganls approach the spectrum of the wind noise and the distinct peaks, from the pitch harmonics, disappear more and more. Figure 4.14 shows the graphs of the corresponding wind canceling parameters. In the upper figure the normalized beamformer output for the various SNR is shown. It can be seen, that the ratio for 30dB SNR approximates the threshold still very good, whereas for an SNR of 20dB and lower the ratio gets flatter for decreasing SNR. This is evident because for decreasing SNR the wind noise is getting continuously more dominant over the speech signal. The lower figure of Figure 4.14 shows the resulting gain for the different SNR. The most eye-catching is the peaks found in the spectrum of the gain for SNR of -5dB and beyond. These peaks approximate the peaks resulting from the pitch frequencies in the speech signal. Therefore the output spectrum could be expected to show still some amount of pitch harmonics for SNR above -5dB. On the other hand the input spectrum at an SNR of -15dB does not show clear pitch frequencies but is rather flat, similar to the wind spectra. It is therefore not astonishing, that the output spectrum does not contain distinct pitch frequencies either.

Figure 4.15 shows the spectra after the canceling process for the test signals. It can be seen from this figure, that the algorithm causes an attenuation at very low frequencies already for 20dB SNR. This results in a small change in the timbre of the speech, because of the low frequent harmonic partials missing.

To get a detailed impression on the performance of the algorithm Figure 4.16 shows the input and output spec-

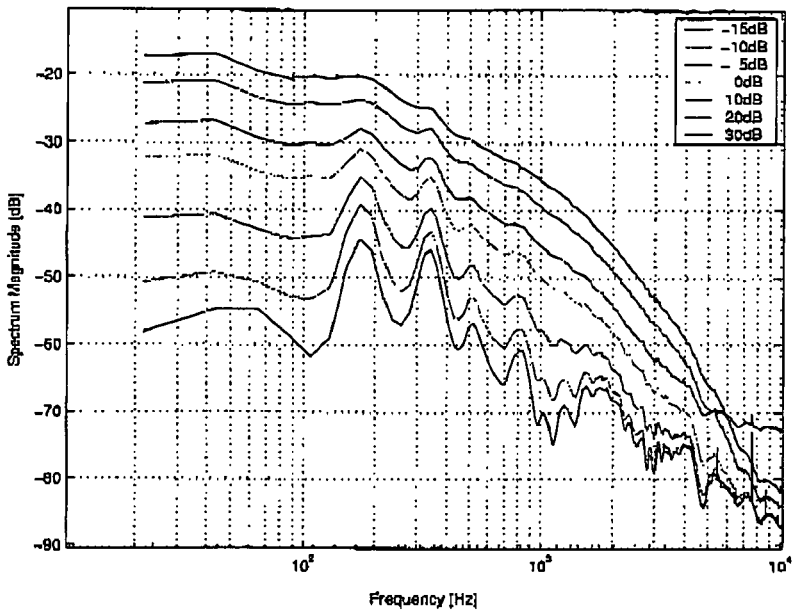

Figure 4.13: Input spectra for speech in wind noise for different SNR ranging from -15dB to +30dB tra as well as the corresponding wind canceling parameters such as the normalized beamformer output $\frac{Cf}{S}$, the gain and the maximum value predicted for plane waves for an SNR value of 0dB. The output spectrum is flattened up to about 1kHz and then is similar to the input spectrum. The pitch frequencies are still present and seem even to be a bit more distinct.

The algorithm shows to attenuate the signal power at low frequencies very well, which was exactly what was expected, but does not help to enhance the speech in wind noise. In other words, the problem of masking by the high magnitude low frequency parts of the wind noise is reduced, but the SNR is not improved very much. This problem will be addressed in Chapter 6 in more detail.

Because of the lack of a suitable measure for sound qualification the performance of the algorithm is best judged by

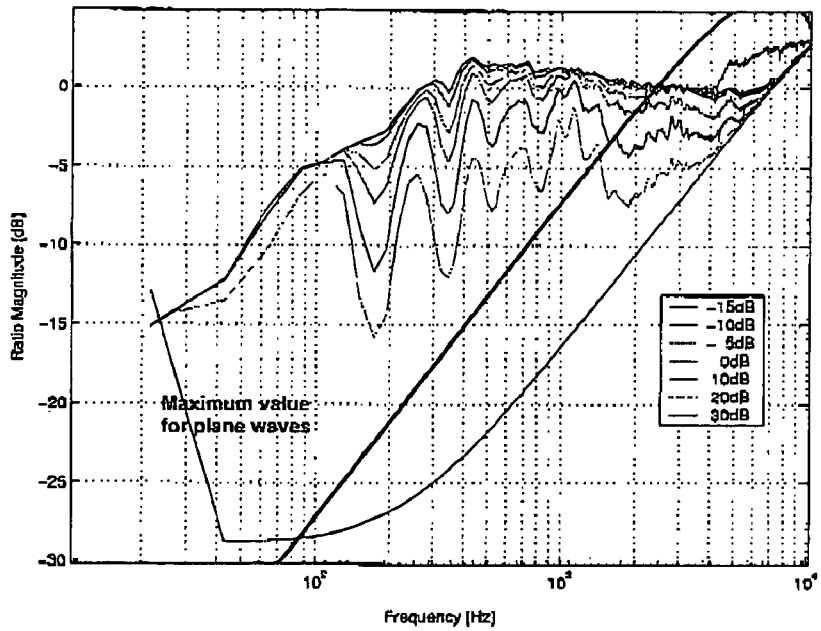
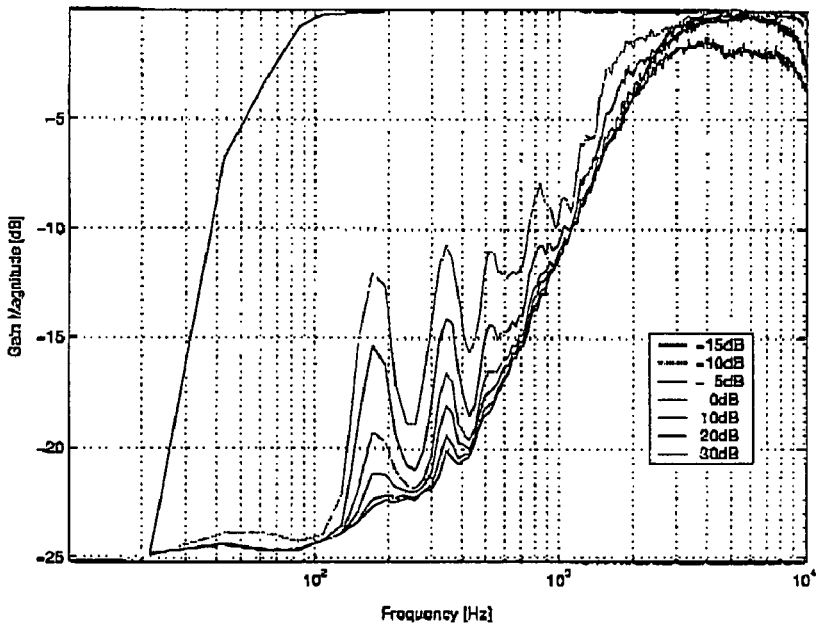
Figure 4.14: *Upper figure:* Ratio $\frac{C_f}{S}$ for speech in wind noise with different SNR from -15dB to +30dB. *Lower figure:* Gain for speech in wind noise with different SNR. The gain is derived from the values in the upper figure.

listening to some sound examples. The output sounds all sound acceptable. In the case where the wind noise level is equal or higher than the speech level the improvement of the signal-to-noise ratio (SNR) would be preferable. It is however difficult to judge the sound quality as a human without hearing instrument. The accompanying CD contains some sound examples, to allow the reader to judge on his own the quality of the processed sounds. It has to be noted though, that the audible effect for a hearing impaired person my be found (and is expected to be) different than for a normal hearing person due to increased upward spread of masking effects. A detailed description of the examples can be found in Appendix B.

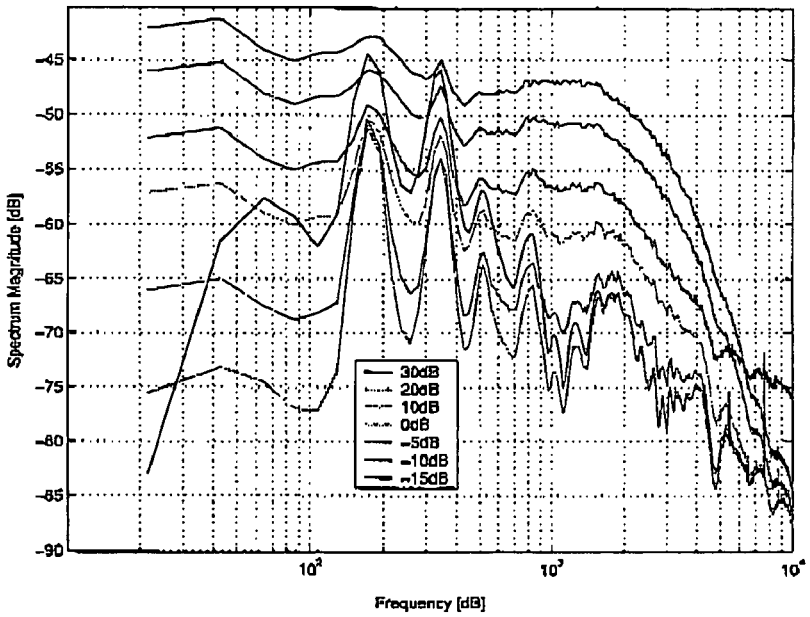

Figure 4.15: Output spectra for speech in wind noise for different SNR ranging from -15dB to +30dB.

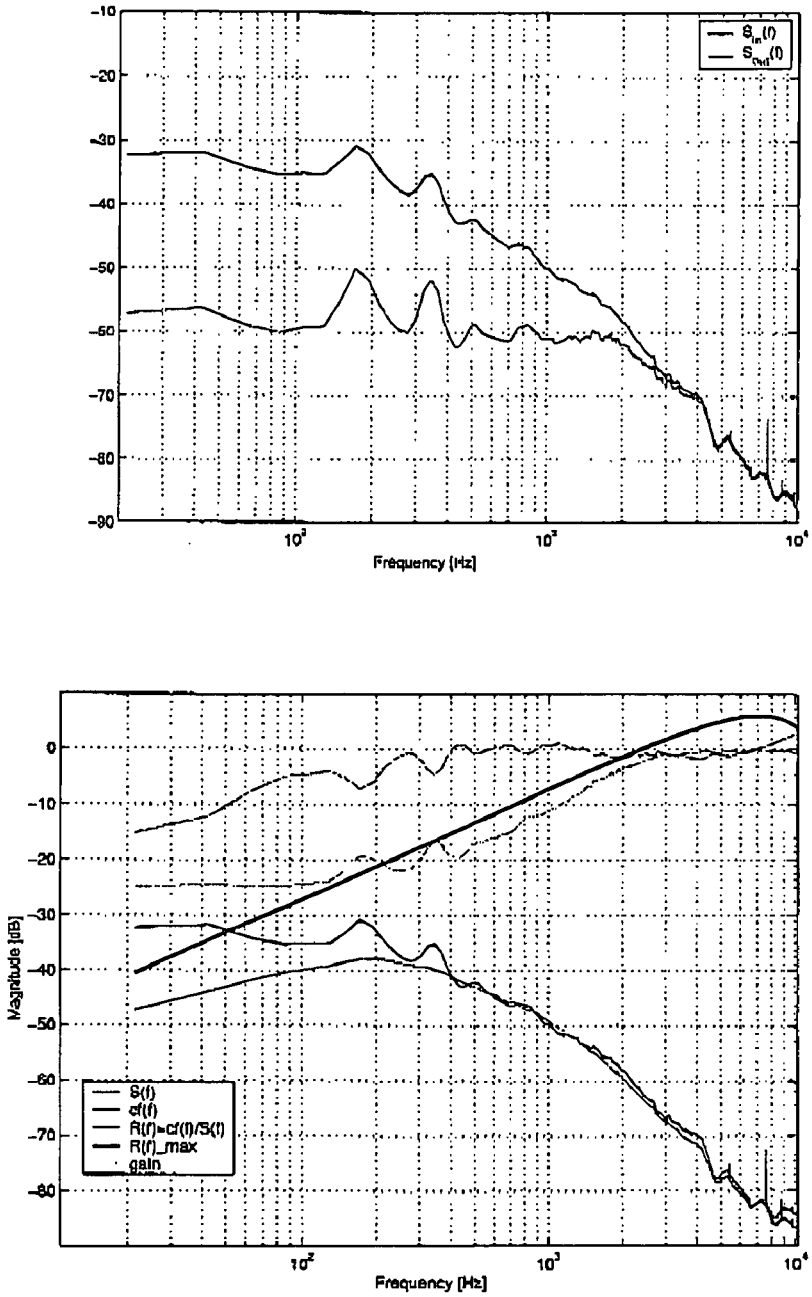
Figure 4.16: *Upper figure:* Input and output spectra for speech in wind noise at an SNR of 0dB. *Lower figure:* Input spectrum S(f) for speech in wind noise and the corresponding wind canceling parameters such as the normalized beamformer output $\frac{Cf}{S}$, the gain and the maximum value for plane waves.

Chapter 5

Single Channel Approach

Not all hearing instruments are equipped with more than one microphone. Therefore there is a need for a system similar in performance to the one with multiple microphones, but relying on only one input signal. The system presented in the previous sections took advantage of the low correlation between two microphones to detect the presence of wind noise. In the case when only one microphone can be used, the detection has to focus on other characteristics of the wind signal. A possible approach will be presented in Section 5.1. The detection of wind noise can then be used to switch on a canceling process, which will be developed in section 5.2. In Section 5.3 the achieved results are presented and discussed.

5.1 Wind Detection Using a Sound Classification Scheme

There exist different approaches to assign sounds into different sound classes. For hearing instruments, the four main classes Speech, Speech in Noise, Noise and Music are differentiated. The main application area of these classifying algorithms is the automatic selection of the best fitting program in modern hearing instruments. The main classes can of course also be subdivided further. A detailed analysis of different sound classification algorithms is given in [10].

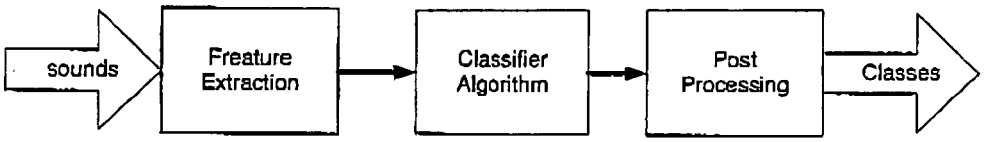

Figure 5.1: General block diagram of a sound classification system

Figure 5.1 shows a general block diagram of a sound classification system. From the sound data a number of characteristic features are calculated and then classified by inspecting the feature values and comparing them against some patterns for the known classes. An additional post processing block may correct possible false classifications and avoid too frequent class changes, that would, for example, provoke many unpleasant program changes in a hearing aid.

Starting with an existing rule based classifier, additional rules were developed to allow the detection of wind noise. The new class Wind Noise should be a subclass of Noise. A rule based classifier works, as its name suggests, on different rules that divide the sounds into the specified classes. This approach is very suitable for implementation in hearing aids because of its low memory and processing cycle consumption. The finding and adjustment of the rules has to be done manually, because there is no self training of the algorithm.

The first step in classification is the extraction of the features. In Table 5.1 the extracted features are listed together with a short description of their meanings. For a more detailed description of the features and their extraction please refer to [10] or [11].

| Family of features | Feature | Description |
|---|---|---|
| Amplitude Modulation | Width | Information about breaks in the signal (pauses) |
| Spectrum | CGMean<br><br>CGFS<br>CGCV | General information if signal is low- or high-frequent<br>Detection of vibrato/jitter |
| Onset | OnsetComMean | Low-frequency components may have a different rise time than high-frequency components |
| Harmonicity | Tonality<br>Pitch Variance | Presence of pitch, harmonics and the variance of pitch |
| SNR | SNRMeanSpBands1<br><br>SNRMeanSpBands2<br>SNRVarSpBands | Information about presence of Noise and Speech |
| Level | MeanRMSLevel | General information if signal is silent or loud |

Table 5.1: Features extracted by classifier algorithm.

Before adding a new rule, the classifier was run with the existing ones for the main classes shown in Figure 5.2 in black. As it is not very surprising most of the wind records were classified as noise. On the other hand some of the wind noise sounds were classified as speech signals.

The new rules for wind noise then were established based on the observation of the features described in Table 5.1 . Taking a detailed look at the different features the spectral and the harmonicity features seem the most selecting ones for wind noise. The CGFS, turned out to be extremely low for wind noise. So a first rule was defined, which should classify all sounds with very low CGFS into the wind noise class. The rule was set up and fitted as described in [12].

Even though the results with the above rule were surprisingly good an additional rule was added to select also those

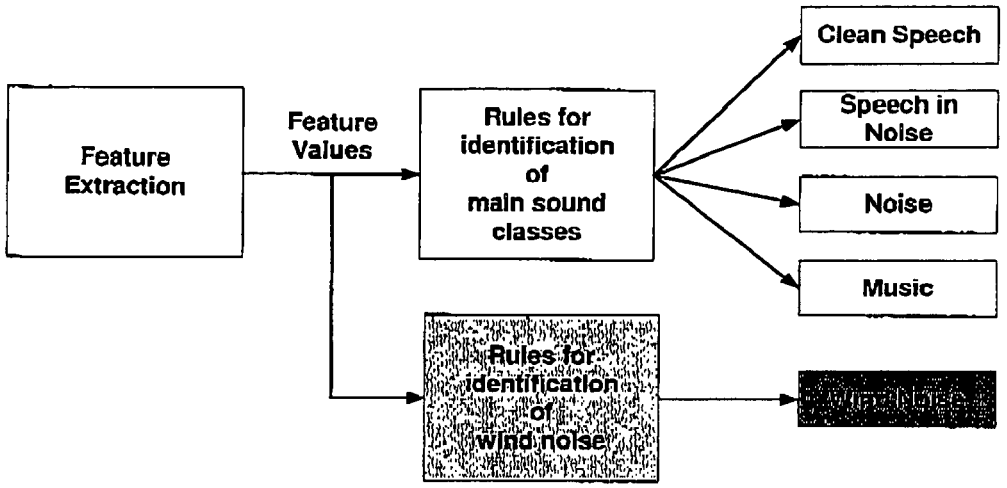

Figure 5.2: Rule-based sound classification.

wind noise sounds with high tonality. For this purpose the CGMean feature was taken to implement a rule selecting sounds of all classes that are characterized with a very low CGMean. The usage of the CGMean feature could eventually lead to a problem for other sounds, especially other noises, with very low CGMean values. This problem has to be investigated closer to prevent false classifications. Figure 5.2 shows the new added rules in blue and the existing ones in black. An additional condition to the CGFS feature, based on the MeanRMSLevel was also tried out. It did not result in a large difference anymore, because the signals in the test database were recorded under different situations and therefore had varying RMS levels. In a real system this feature probably could be of some help.

The knowledge of the sound category of an arriving acoustic signal can now be used to switch on a suitable processing. For wind noise this would be a wind canceling block. A possible approach based on linear prediction will be delineated in the following section.

5.2 Wind Canceling Based on a Linear Predictor

Classical methods for adaptive noise canceling typically require at least two inputs. Where for example the main input is the signal corrupted by noise, and the second one serves as a reference of noise. As mentioned before not all hearing instruments are provided with more than one input signal. In literature there exist mainly two single-input noise reduction schemes [13]: Spectral subtraction and adaptive prediction. The first method has the drawback that the spectrum of the noise has to be estimated during non speech periods. Therefore a single-microphone wind noise canceling based on adaptive linear prediction has been investigated.

5.2.1 Linear Predictor

Figure 5.3 shows the block diagram of an adaptive linear prediction system. The input signal $x(k)$ is assumed to be composed of the speech signal $s(k)$ and an additive uncorrelated noise signal $n(k)$.

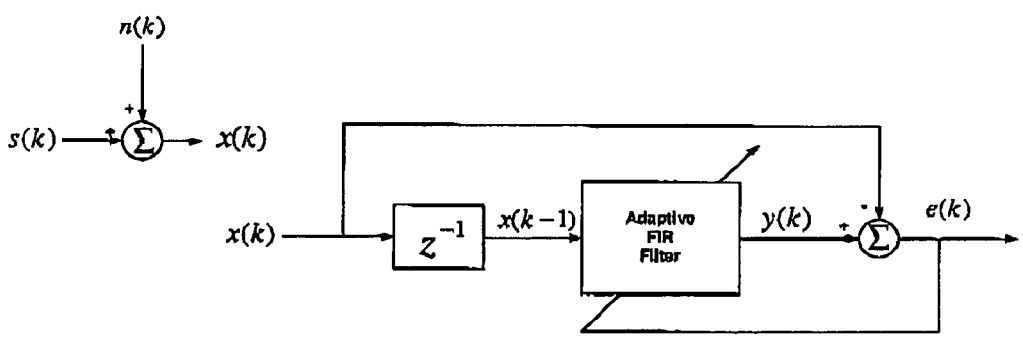

Figure 5.3: Linear predictor for wind noise canceling

The linear predictor uses the fact, that the successive samples of a speech signal are not totally independent. The actual sample y(k) is predicted by a linear combination of N previous samples, that is $$y(k) = \sum_{i=0}^{N-1} w_{i+1}(k)x(k-1-i) \tag{5.1}$$

The prediction error e(k) is given by the difference between x(k) and the predicted signal y(t):

$$\begin{aligned} e(k) &= x(k) - y(k) = x(k) - \sum_{i=0}^{N-1} w_{i+1}(k)x(k-1-i) \\ &= x(k) - (w_1x(k-1) + w_2x(k-2)\ldots + w_Nx(k-N)) \end{aligned} \tag{5.2}$$

Writing equation 5.2 using vectors, the error signal can be written with simple dot products:

$$e(k) = x(k) - \underline{x}^t[k-1]\underline{w}[k] \tag{5.3}$$

with $$\underline{w}[k] = \underline{w} = [w_1[k], w_2[k], \ldots, w_N[k]] \tag{5.4}$$

$$\underline{x}[k-1] = [x[k-1], x[k-2], \ldots, x[k-N]]. \tag{5.5}$$

The filter coefficients are periodically calculated for each block of N samples. This way the filter adapts to the average characteristics of the signal. The adaption of the filter is done by minimizing the squared error. Because speech is a nondeterministic signal the mean-squared error(MSE) is minimized instead of the squared error signal $e^2(k)$ [14]:

$$\begin{aligned} E\{e^2[k]\} &= E\{x^2(k)\} - 2\underline{w}^tE\{x(k)\underline{x}[k-1]\} + \underline{w}^tE\{\underline{x}[k-1]\underline{x}^t[k-10]\}\underline{w} \\ &= \sigma_x - 2\underline{p}\underline{w} + \underline{w}^t\mathbf{R}\underline{w} \end{aligned} \tag{5.6}$$

where p and R are defined as follows:

$$\mathbf{R} = E\{x(k)\underline{x}[k-1]\} = \begin{pmatrix} r(0) & r(1) & \dots & r(N-1) \\ r(-1) & r(0) & \dots & r(N-2) \\ \vdots & \vdots & \ddots & \vdots \\ r(-N+1) & r(-N+2) & \dots & r(0) \end{pmatrix}$$

$$\underline{p} = E\{x(k)\underline{x}[k-1]\} = \begin{pmatrix} E\{x(k)x(k-1)\} \\ E\{x(k)x(k-2)\} \\ E\{x(k)x(k-3)\} \\ \vdots \\ E\{x(k)x(N)\} \end{pmatrix} = \begin{pmatrix} r(1) \\ r(2) \\ r(3) \\ \vdots \\ r(N) \end{pmatrix}$$

and $r(i) = E\{x(k)x(k-i)\}$ is the auto correlation at the delay i. The auto correlation function is symmetric $r(i) = r(-i)$ and real. The auto correlation matrix $\mathbf{R}$ represents the statistics of the input signal $x(k)$ and the cross correlation vector $\underline{p}$ describes the correlation between the delayed and the undelayed input signal or the correlation of successive samples of the input signal.

The optimum filter coefficients are given by the Wiener-Hopf-Equation [14]

$$\underline{w}^{\circ} = \mathbf{R}^{-1}\underline{p} \quad . \tag{5.7}$$

From equation 5.7 it can be seen, that the optimum filter coefficients depend on the auto correlation function of the input signal $x(k)$.

The connection between the prediction error and the speech signal gets clear if the error signal e(k) is transformed into the Z-domain:

$$E(z) = X(z)(1-w_1z^{-1}-w_2z^{-2}-\dots-a_nz^{-n}) = X(z)H_a(z) \quad . \tag{5.8}$$

The filter $H_a(z)$ is also called analyzing filter and the inverse filter $$H_s(z) = \frac{1}{H_a(z)} \tag{5.9}$$

is called the synthesis filter. The synthesis filter $H_s(z)$ describes the envelope of the spectrum of the input signal $x(k)$. Depending on the order of the filter N the approximation of the envelope is more or less exact. The error signal $E(z)$ results from the filtering of $X(z)$ with the inverse synthesis filter(the analysis filter $H_a(z)$). Since the synthesis filter $H_s(z)$ on his part characterizes the envelope of the input spectrum, the spectrum of the prediction error will therefore have a nearly flat envelope, which means the signal is nearly white. With the appropriate filter length the filter $H_a(z)$ filters the wind noise but does not attenuate the target signal too much.

5.2.2 Selection of the Filter Order

Depending on the aim of the linear predictor the output signal is the predicted signal y(k) or the error signal e(k). In many of the linear predictors found in literature y(k) is selected as output signal. The filter order then is selected such as to approximate the signal spectrum as good as possible, so that the signal y(k) is a good approximation of the desired signal. The filter order has therefore to be chosen as high as possible. In the present application the aim of the linear predictor is to remove the wind noise from the noisy input signal. The error signal is chosen as the systems output and the output of the adaptive filter y(k) should contain as much of the wind noise signal as possible. The filter order therefore has to be chosen such that the wind noise could be predicted as good as possible but enough low to prevent too much prediction of the desired speech signal.

To get an idea of the necessary filter order an LPC analysis using the Matlab command `a = lpc(signal,p)` was carried out for all wind noise recordings for different filter orders. For each run the RMS of the error signal $e(k)$ was calculated. Figure 5.4 shows the RMS of the error versus the filter order for each wind recording. The RMS for each filter order is an average over all wind noise recordings. It gets evident, that with filter orders of 3 and beyond the RMS of the error signal can be minimized only a little further.

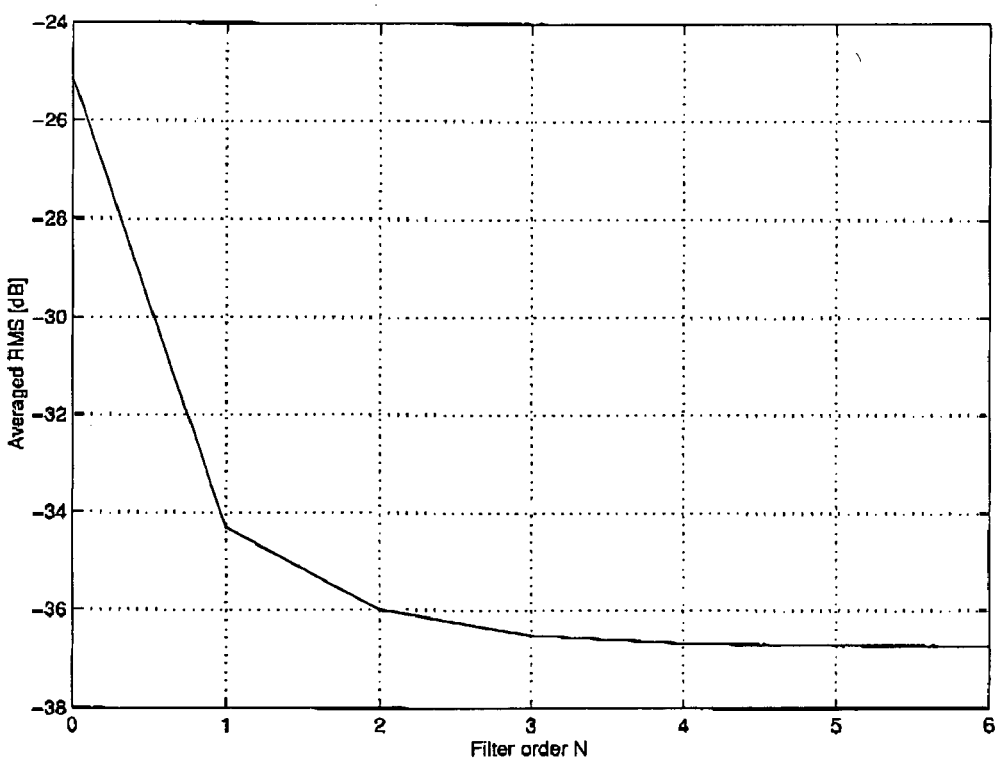

Figure 5.4: RMS values versus the the filter order. The RMS value for each filter order is an average over all files.

Figure 5.5 shows the spectrum of the error signal E(z)

for different filter orders N. The input signal x(k) is composed of clean speech in wind noise with an SNR of +10dB. It can also be seen from this figure, that filter orders beyond 4 do not whiten the error spectrum any further. On the contrary the formant frequencies get attenuated more with increasing filter order, because the linear predictor is capable of predicting more of the speech signal too.

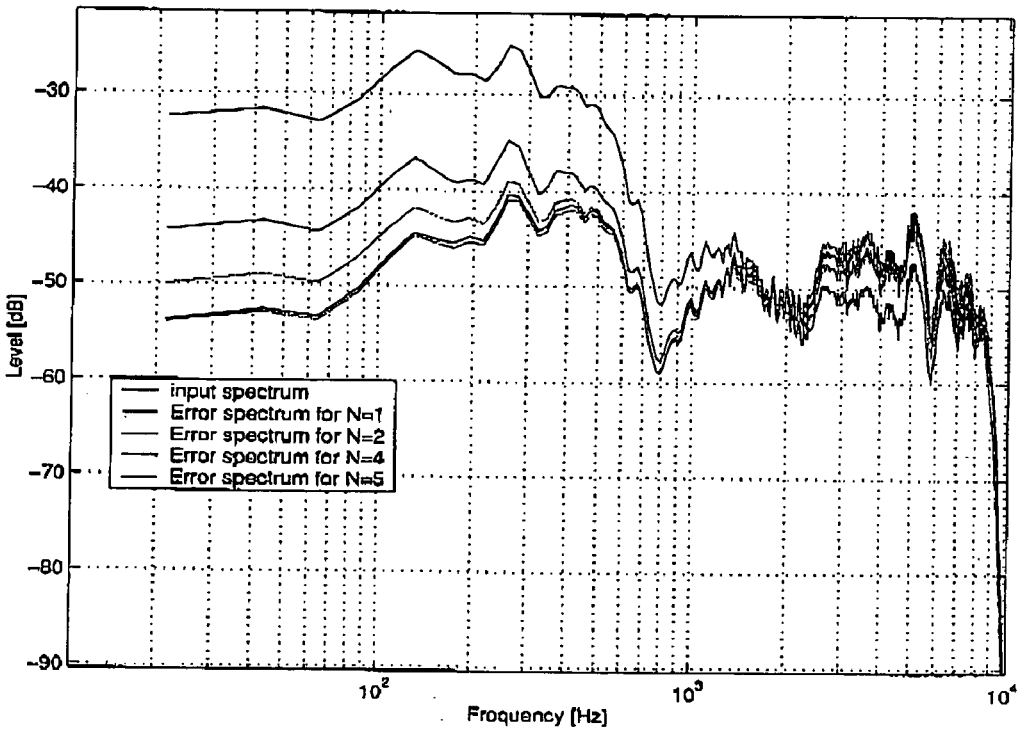

Figure 5.5: Input spectrum and error spectrum for a composed signal (speech in wind noise) with 10dB SNR for different filter orders. N is the filter order and the number of coefficients of the linear predictor is then N+1. It can be seen that filter orders beyond 4 do not show better results.

Based on the previous analysis the filter order was set to 2, which is a good compromise between strong attenuation of wind noise and a good preservation of the formant peaks.

5.2.3 Step Size and Adaption Time

The linear predictor is updated using an normalized LMS algorithm [14]. The updating formula is $$\begin{aligned} \underline{w}(n+1) &= \underline{w}(n) + \mu e \underline{x} \\ &= \underline{w}(n) + \frac{\beta}{\gamma + N P_{in}} e \underline{x} \end{aligned} \tag{5.10}$$

where $\mu$ is called the step size, $\beta$ and $\gamma$ are positive constants and $P_{in}$ is the mean input power. The step size does have an influence on the stability and the convergence of the algorithm. The adaption or convergence time is defined as $$\tau_{LMS} = \frac{1}{2\mu(\text{mean} \quad \text{input} \quad \text{power})} = \frac{1}{\frac{2\beta}{\gamma + N \cdot P_{in}} P_{in}} \approx \frac{N}{2\beta}. \tag{5.11}$$

The LMS algorithm can track changes in the signal statistic faster for bigger step sizes. At first sight one is therefore tempted to chose a large step size to let the algorithm quickly adapt to a new situation. This choice however has the drawback that the algorithm can also follow changes in the speech signal hidden in wind noise. This results in a course of the filter coefficients shown in Figure 5.6. For an addaption time of $\tau_{LMS} \approx \frac{1}{0.001} = 10^3$ samples or about 45 ms the filter coefficient values show many fluctuations, which do correspond exactly to the changes of the statistics of the speech signal. These frequent fluctuations can be heard as unpleasant volume changes in the output signal. If the adaption step size is chosen small, or $\beta$ small which is the same, the filter does not adapt to all changes in the speech signal, resulting in a more comfortable hearing situation. It is evident that the adaption time on the other hand can not be too slow, otherwise there will be no adaption of the filter in a changing environment. The fastest change in a windy situation probably would be the rotation of the head or some gust of wind, which are expected to have an estimated duration of some hundreds of milliseconds. Figure 5.7 shows the course of the filter coefficients of a second order filter with $\beta = 0.0001$. The adaption time is now $\tau_{LMS} \approx \frac{1}{\beta} = 10^4$ samples, which for a sampling frequency $fs = 22050$Hz is about 450 ms.

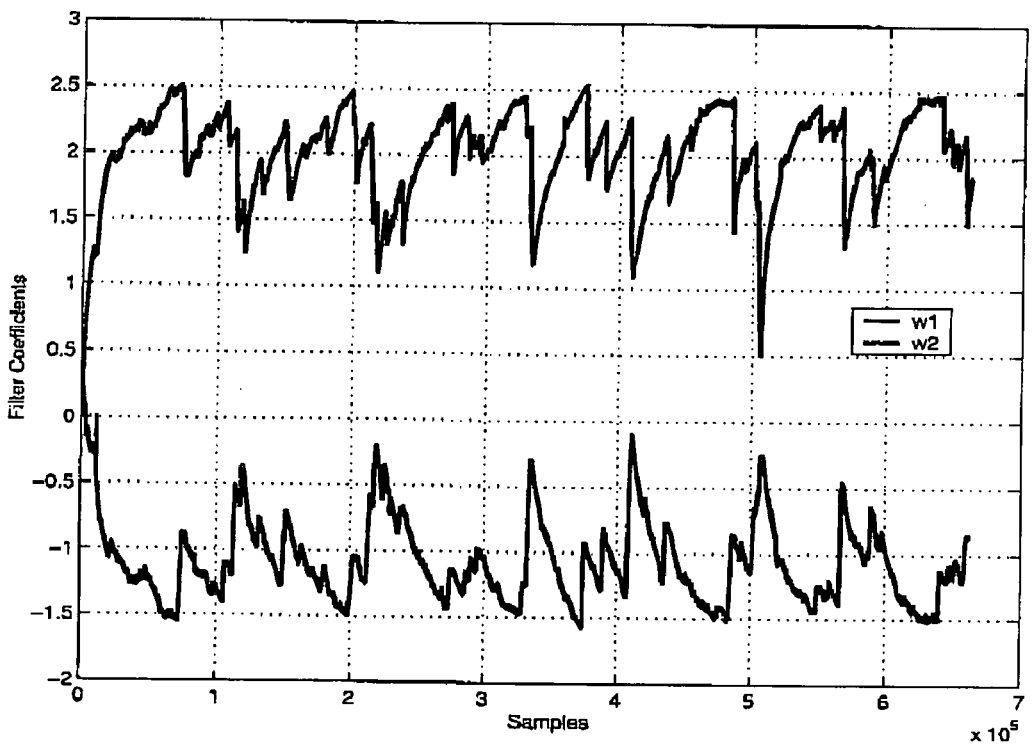

Figure 5.6: Filter coefficients for a second order filter with $\beta = 0.001$ and $\tau_{LMS} \approx \frac{1}{\beta} = 10^3$ samples, which for a sampling frequency of $fs = 22050$Hz is about 45 ms.

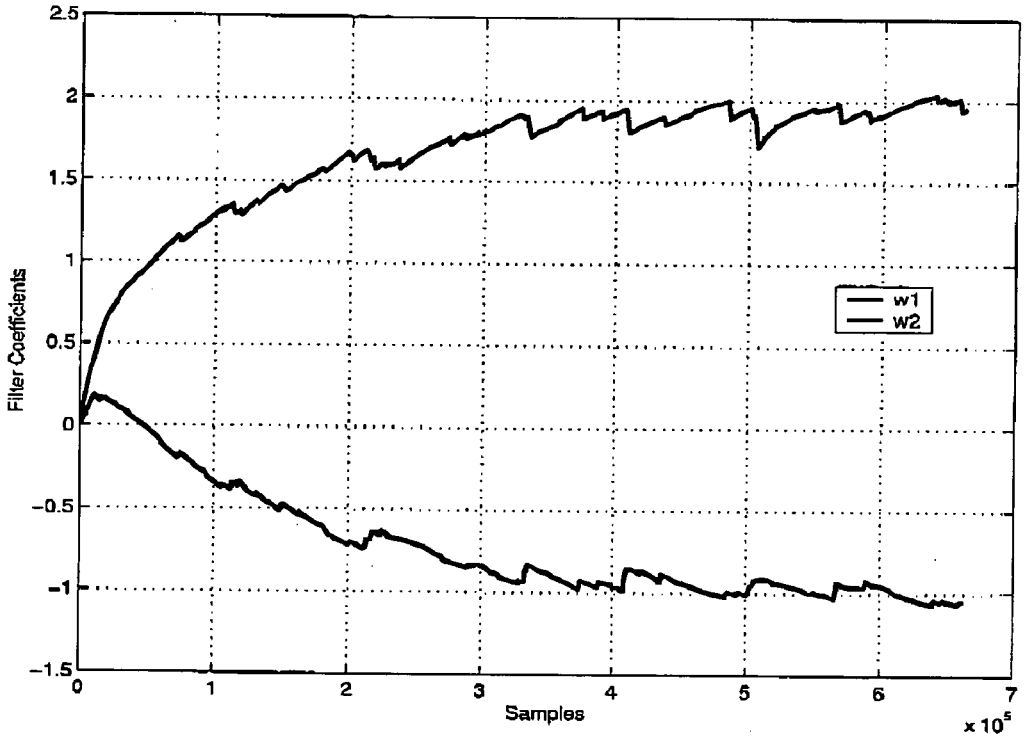
Figure 5.7: Curve for filter coefficients for for a second order filter with $\beta = 0.0001$ and $\tau_{LMS} \approx \frac{1}{\beta} = 10^4$ samples corresponding to 450 ms for a sampling frequency of $fs = 22050$Hz

5.3 Results for Single Microphone Approach

In this section the results for the single microphone wind noise canceling system will be presented and discussed. As the system consists of two separate parts, the detection and the cancelation results for each block will be evaluated separately.

5.3.1 Wind Noise Detection

As proposed in Section 5.1 the detection block for the single microphone system is based on a rule based sound classification algorithm. The result for the different development steps of the extension of the sound classification algorithm will be shown in the following. In each test sounds of all different sound classes, including the wind noise records, were fed into the classification algorithm. A confusion matrix was established out of which the number of correctly (Ncorrect) recognized and the number of falsly (Nfalse) classified sounds are extracted and then the hits and false alarm percentages are calculated as follows:

$$\text{Hits} = \frac{\text{Ncorrect}}{\text{Ntotal}} \qquad \text{Ntotal: all sound files (533 files)}$$

$$\text{False alarm} = \frac{\text{Nfalse}}{\text{Ntotal}-\text{Nklass}} \qquad \text{Nklass: total number of files in the class}$$

As mentioned in Section 5.1 the existing rules allowed to distinguish between four main groups of sounds: Speech, Speech in Noise, Noise and Music. The confusion matrix in Table 5.2 shows the classification results for the existing rules. As expected, most of the wind noise sounds are filed into the Noise class (228) and only a few are classified as speech (14) or speech in noise (4). The hit and false alarm rates are not very interesting for this case and are therefore not listed.

| Classified as → Sound class ↓ | Speech | Speech in Noise | Noise | Music | Wind |
|---|---|---|---|---|---|
| Speech | 61 | 2 | 0 | 2 | 0 |
| Speech in Noise | 6 | 64 | 9 | 2 | 0 |
| Noise | 0 | 4 | 82 | 1 | 0 |
| Music | 2 | 1 | 6 | 64 | 0 |
| Wind | 14 | 4 | 228 | 0 | 0 |

Table 5.2: Confusion matrix for the initial settings without the additional rule for wind noise classification.

Using the first rule for wind noise detection based on the CGFS feature resulted in the confusion matrix shown in Table 5.3. Most of the wind noise sounds (224) are already classified correctly. Table 5.4 shows the corresponding hit and false alarm rates. The hit rate of 91% gained with the addition of one single rule is surprisingly good but on the other hand still 14 wind noise recordings are classified as clean speech signals which certainly is not ideal.

| Classified as → Sound class ↓ | Speech | Speech in Noise | Noise | Music | Wind |
|---|---|---|---|---|---|
| Speech | 61 | 2 | 0 | 2 | 0 |
| Speech in Noise | 6 | 66 | 7 | 2 | 0 |
| Noise | 0 | 4 | 81 | 1 | 1 |
| Music | 3 | 1 | 4 | 65 | 0 |
| Wind | 14 | 4 | 4 | 0 | 224 |

Table 5.3: Confusion matrix for wind noise classification using the first classification rule With the addition of the second rule based on the CG-Mean feature the confusion matrix in Table 5.5 is attained. It can be seen that with this final setting of the classification algorithm, 240 of 246 wind noise sounds are filed correctly and only a few are classified into other classes. The final hit rate of 98% and false alarm rate of 0% should be high enough to allow a reliable wind noise detection.

| Class | Nklass | Ncorrect | Hits | Nfalse | False alarm |
|---|---|---|---|---|---|
| Speech | 65 | 61 | 0.94 | 23 | 0.05 |
| Speech in Noise | 81 | 66 | 0.81 | 11 | 0.02 |
| Noise | 87 | 81 | 0.93 | 15 | 0.03 |
| Music | 73 | 65 | 0.89 | 5 | 0.01 |
| Wind | 246 | 224 | 0.91 | 1 | 0 |

Table 5.4: Results for classifier with first rule for wind noise classification.

The overal results for the classification are summarized in Table 5.6 and are visualized in Figure 5.8.

| Classified as → Sound class ↓ | Speech | Speech in Noise | Noise | Music | Wind |
|---|---|---|---|---|---|
| Speech | 61 | 2 | 0 | 2 | 0 |
| Speech in Noise | 6 | 66 | 7 | 2 | 0 |
| Noise | 0 | 4 | 81 | 1 | 1 |
| Music | 3 | 1 | 4 | 65 | 0 |
| Wind | 1 | 1 | 4 | 0 | 240 |

Table 5.5: Confusion matrix wind noise classification using the first and second classification rule.

5.3.2 Wind Canceling

The linear predictor presented in Section 5.2 performs as an adaptive high pass filter. This behavior is a result from the selected filter order and the characteristics of wind noise.

| Class | Nklass | Ncorrect | Hits | Nfalse | False alarm |
|---|---|---|---|---|---|
| Speech | 65 | 61 | 0.94 | 10 | 0.02 |
| Speech in Noise | 81 | 66 | 0.81 | 8 | 0.02 |
| Noise | 87 | 81 | 0.93 | 15 | 0.03 |
| Music | 73 | 65 | 0.89 | 5 | 0.01 |
| Wind | 246 | 240 | 0.98 | 1 | 0 |

Table 5.6: Final results for wind noise classification.

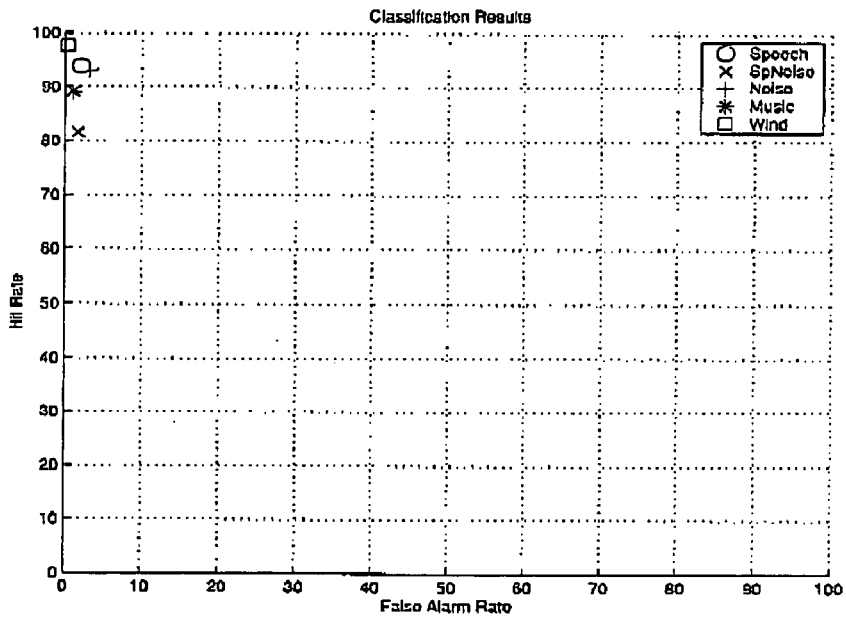

Figure 5.8: ROC-Graph showing the results for the final settings of the classifier rules for wind detection.

As shown in Chapter 2 wind noise has a high correlation at low frequencies but the correlation diminishes with increasing frequency. For the linear predictor this means that the low frequent parts of the wind noise spectrum can be predicted, but the higher frequencies not anymore.

Figure 5.9 shows the input and the output spectrum for speech in wind noise for different SNR. In the output spectra the low frequency part of the signal is mostly whitened, means flat, whereas the high frequency part is affected only little.

The high pass characteristic and the adaption to the actual wind situation and the signal spectrum can be observed in Figure 5.10, where the signal spectra for speech in wind noise with three different SNR are plotted together with the analysis filter $H_a(z)$. It can be seen that the frequency response of the filter does indeed have the shape of a high

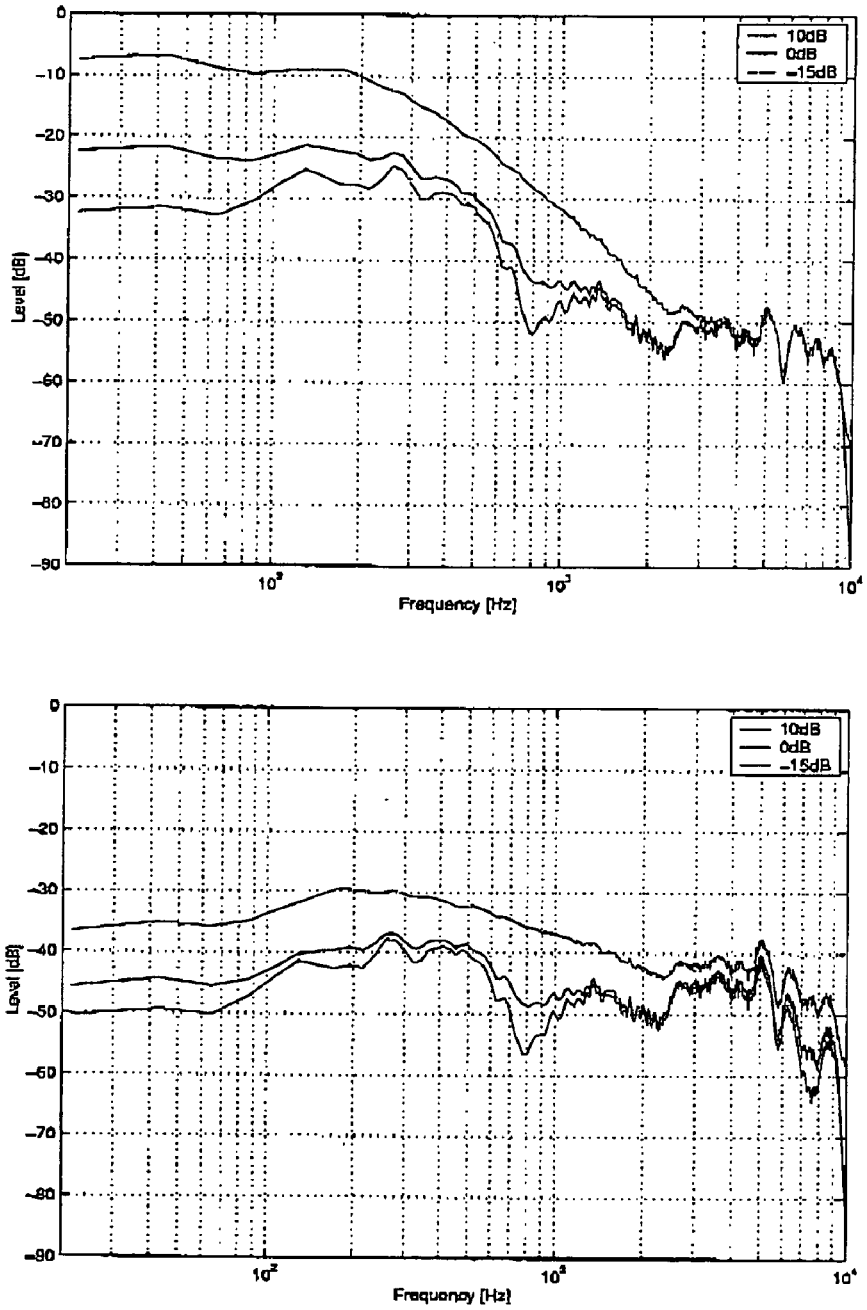
Figure 5.9: *Upper figure:* Input spectrum for speech in wind noise for three different SNR: +10dB, 0dB and -15dB. *Lower figure:* Output spectrum for single microphone algorithm for different SNR. The lower frequencies are flattened but the high frequencies are not affected by the filter.

pass filter and the maximum attenuation at low frequencies as well as the cut-off frequency changes with the situation.

Figure 5.11 shows the analysis filter and the synthesis filter for different wind speeds. It can be seen that the analysis filter does adapt the maximum attenuation and the cut-off frequency to the actual wind speed. The maximum attenuation at the low frequencies however is not found for the highest wind speed, but for the lowest one, which is not exactly what would be expected. This adaption could result from the individual shapes of the autocorrelation function on which the adaption process is based on.

If the output spectra of these wind noise signals in Figure 5.12 are inspected it can be seen, that all the spectra get attenuated and the linear predictor tries to whiten the spectrum. For the highest wind speed this works pretty well whereas the spectrum of the lowest wind speed is only whitened at very low frequencies.

Figure 5.13 shows the analysis and the synthesis filter for different incidence angles for a wind speed of 5 m/s. Again the filter does adapt to the actual wind situation, but the highest attenuation at low frequencies is not resulting for the direction with the highest wind noise level.

The linear predictor allows to reduce the average RMS value of the wind noise sounds by about 15dB - 20dB and the low frequency parts get attenuated even up to about 40dB. The resulting output sound levels are considerably lower than the input levels. In the presence of speech in a windy situation the algorithm achieves acceptable result. Due to the moderate loudness of wind noise the hearing situation is a lot more comfortable. As for the system with multiple microphones the problem of masking by the loud low frequency components of the wind noise is reduced, but the SNR is changed only by a small amount or is even not

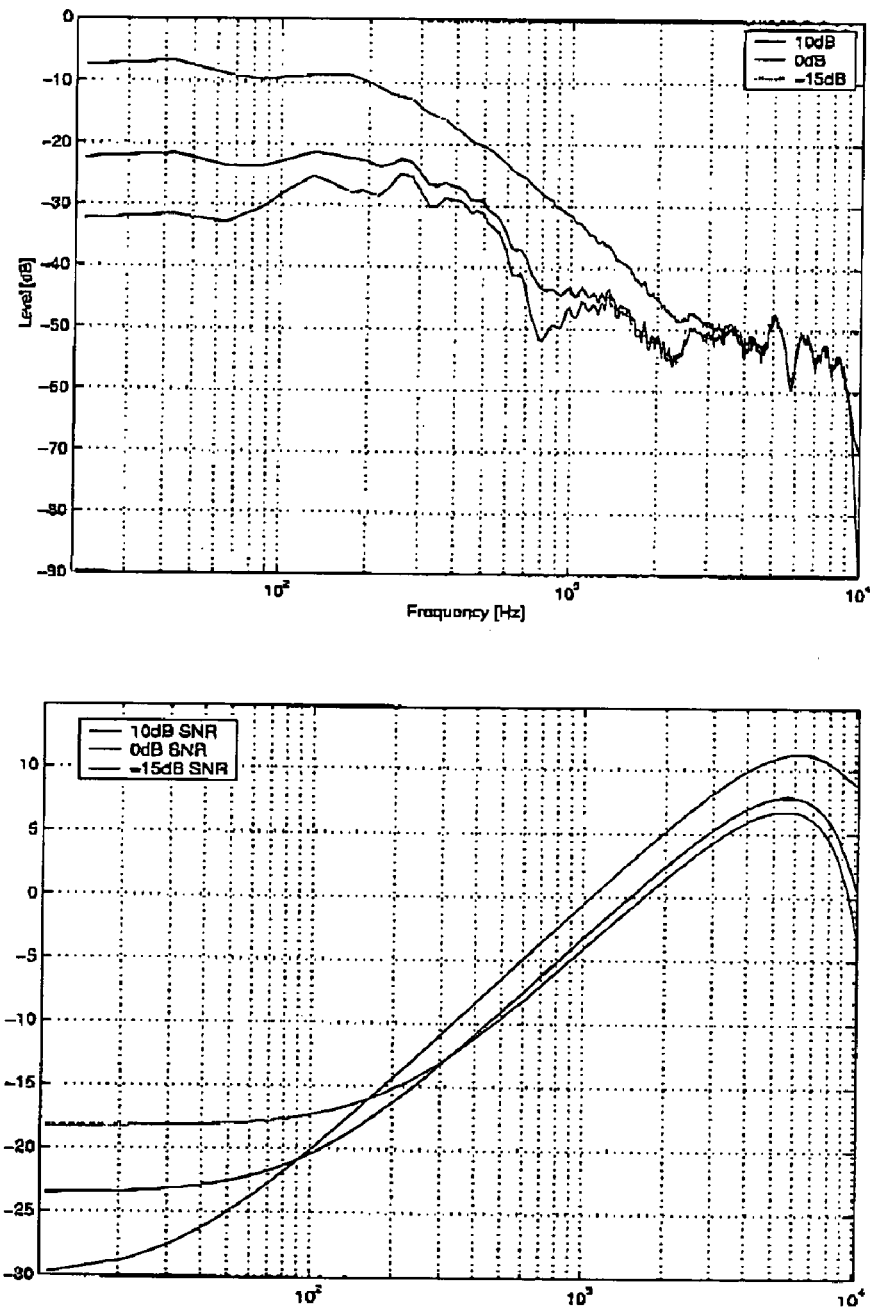
Figure 5.10: *Upper figure:* Spectra of speech in wind noise for three different SNR: +10dB, 0dB and -15dB. *Lower figure:* Analysis filter $H_a(z)$ for the above signals. It can be seen that the filter adapts correctly to the actual situation. The signal with the lower SNR values get attenuated stronger.

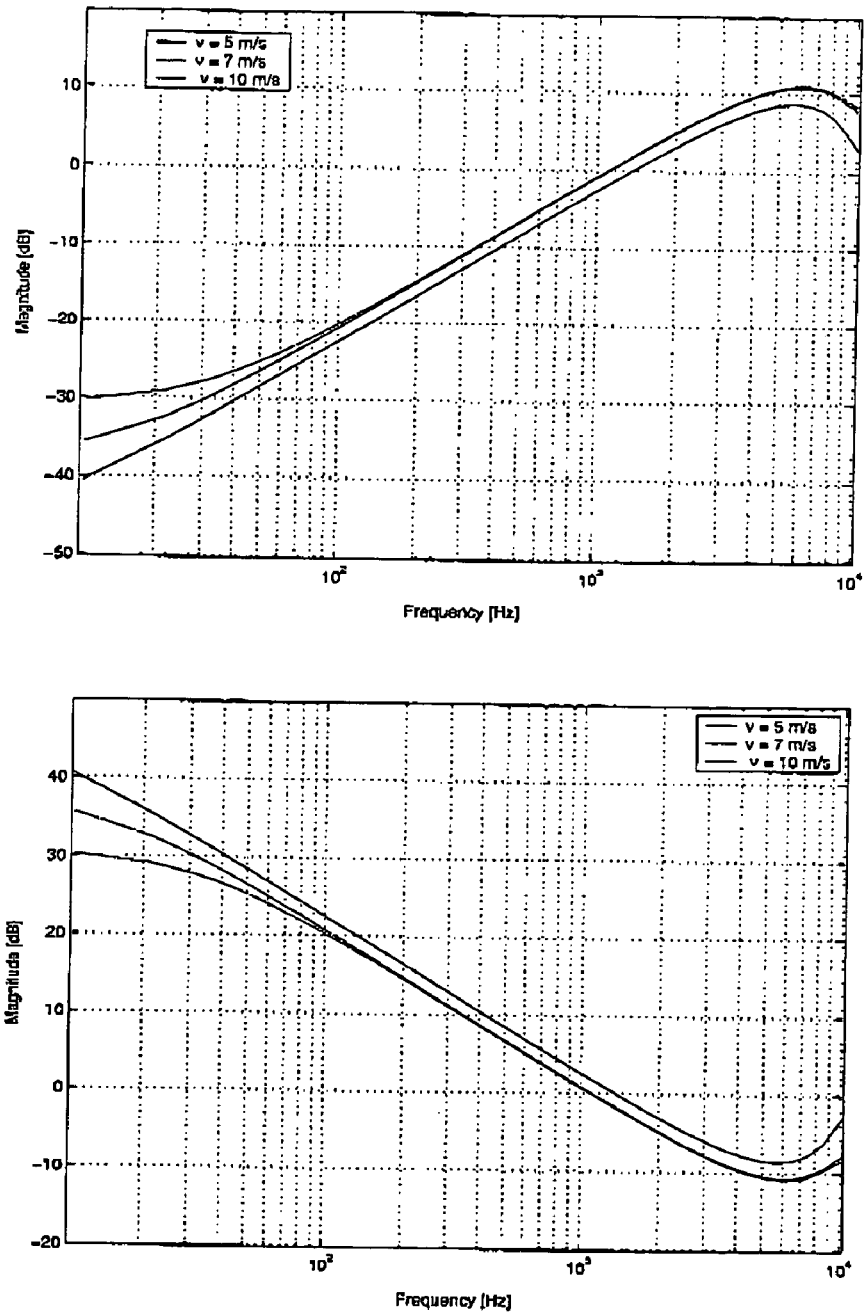
Figure 5.11: *Upper figure:* Analysis Filter $H_a(z)$ for different wind speeds at an angle of incidence of 0°. *Lower figure:* Corresponding synthesis filter $H_s(z)$. The Synthesis filter does approximate the signal spectrum, however the order of the spectra is mixed up. The weakest wind has the highest magnitude for the synthesis filter.

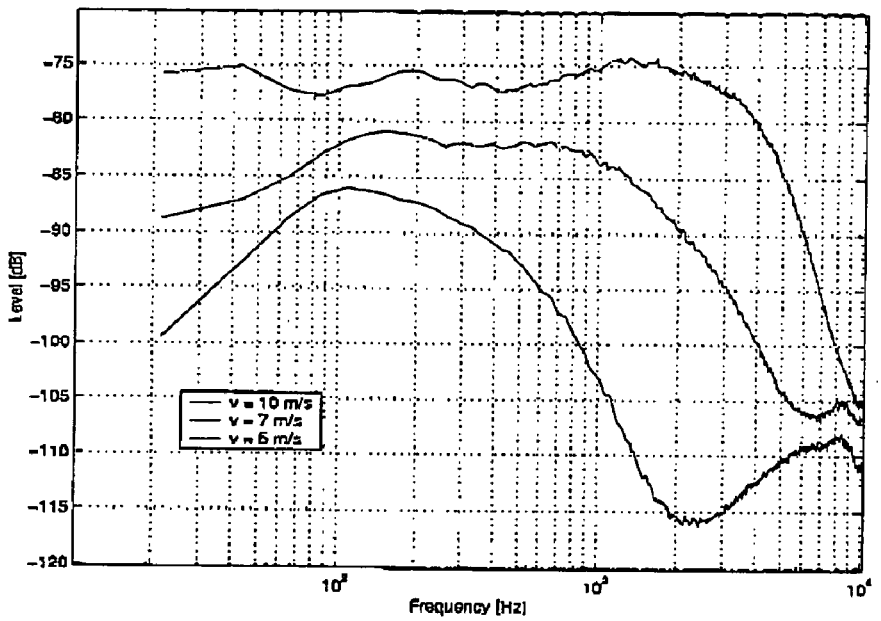

Figure 5.12: Input and output spectra for the single microphone cancelation algorithm for three different wind speeds: 5 m/s, 7 m/s and 10 m/s.

affected. For very low and negative SNR values the speech is also attenuated at low frequencies as can be seen in Figure 5.14. The strong attenuation of the low frequencies result in slightly different timbre of the sound. Therefore the reconstruction and enhancement of the pitch harmonic frequencies of speech would be desirable to improve the SNR. Chapter 6 will cover the problem of speech enhancement in more detail.

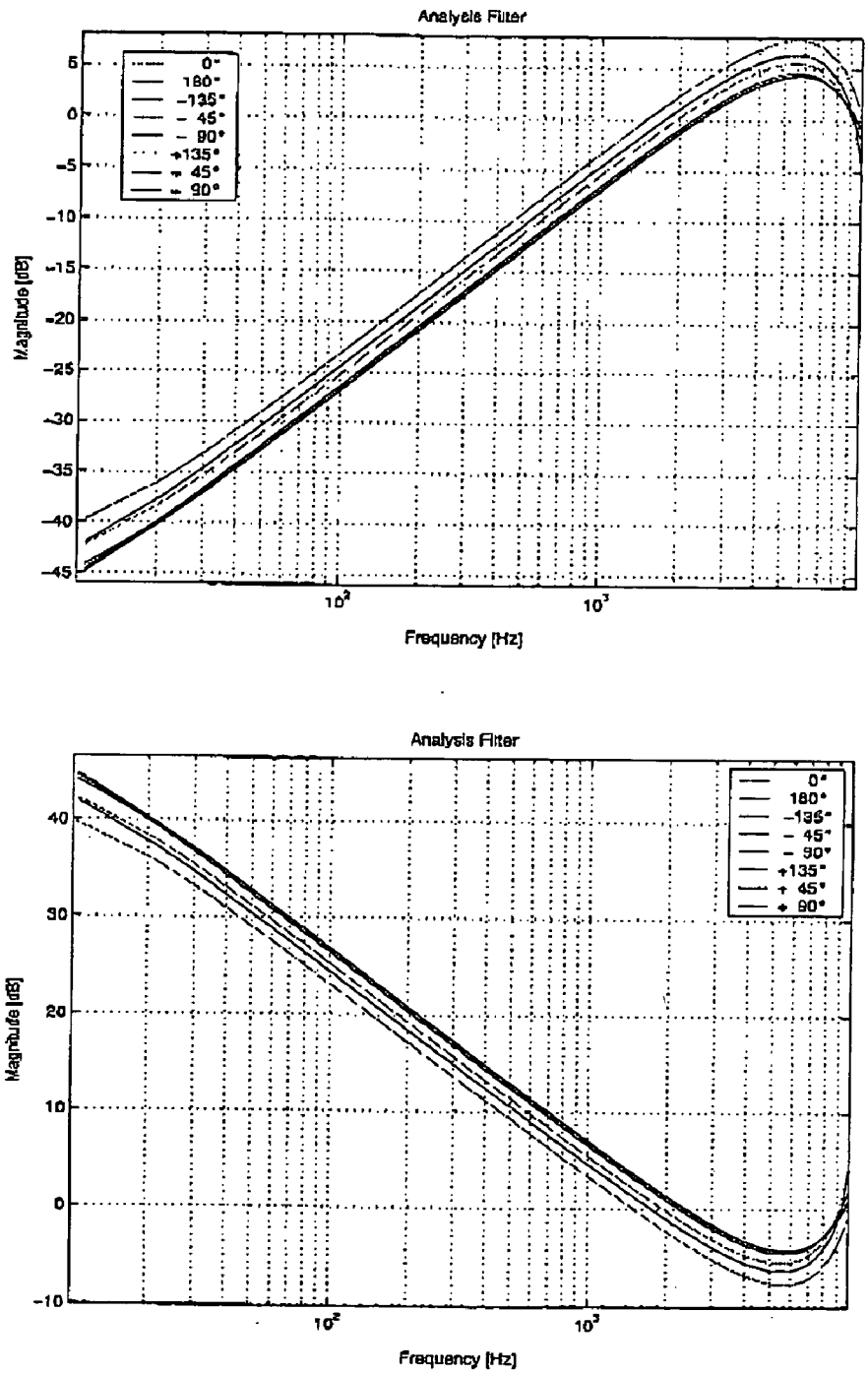
Figure 5.13: *Upper figure:* Analysis Filter $H_a(z)$ for different angles of incidence of wind noise at 5 m/s. *Lower figure:* Corresponding synthesis filter $H_s(z)$. The Synthesis filter does approximate the signal spectrum, however the order of the spectra is mixed up. The weakest wind direction has the highest magnitude for the synthesis filter.

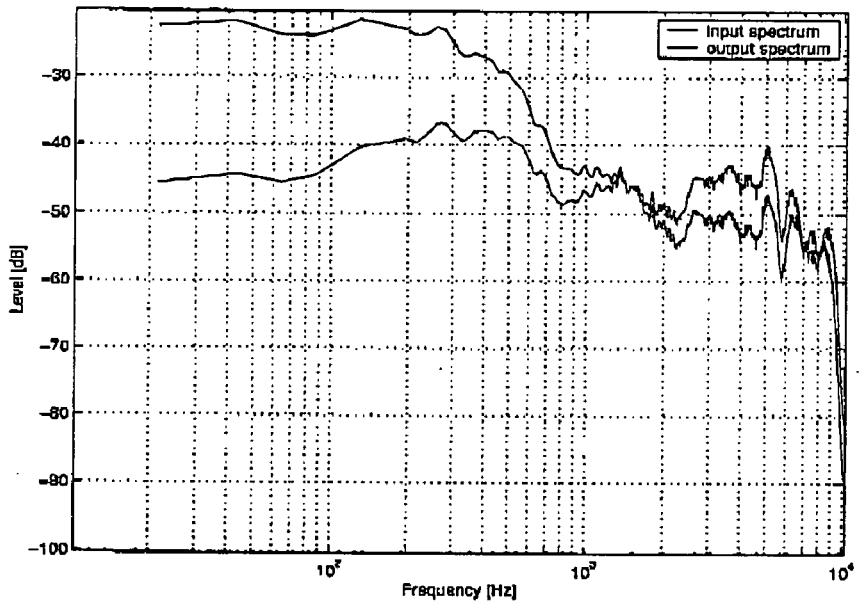
Figure 5.14: Input and output spectra for the single microphone cancelation algorithm for speech in wind noise at an SNR of 0dB.

Chapter 6

Intelligibility of Speech in Wind Noise

With the wind noise canceling algorithms presented in the previous chapters it was possible to reduce the problem of masking. The high magnitude low frequent parts of wind noise get attenuated, which reduces their masking effect on the higher frequency parts and therefore the masking of speech. Unfortunately some of the low frequent parts of speech were also attenuated. Therefore the signal-to-noise ratio (SNR) was not increased. The aim of the following investigations is to find a solution how to restore some of the suppressed low frequency parts of a target signal after either one of the wind noise canceling filters.

6.1 Introduction

The human hearing system is able to separate a target signal, such as speech, from a noisy background and thus performs an automatic signal-to-noise ratio (SNR) improvement. This ability is possible because speech is a highly redundant signal. Even if a part is masked by noise, other parts of the speech contain sufficient information to make the speech more or less intelligible. For people with a hearing loss there is less redundancy in the speech signal since part of the speech is either not audible or is severely distorted because of the hearing loss [2]. Additionally the hearing aid itself reduces the binaural-based ability of sound separation. Having a model of how a human is able to separate a speech source from the background noise can help to find algorithms to increase intelligibility of speech. Auditory Scene Analysis (ASA) shows that the strong harmonicity during voiced parts of speech is one of the most important characteristic used by the human hearing system to identify speech as a source [15]. Thus, the enhancement of the harmonicity should improve the intelligibility of speech in background noise.

Most of the sounds in nature do not consist of a single tone but of signals with different harmonic partials. The human hearing system perceives a single sound with a clear pitch equal to the fundamental frequency, even if the fundamental is missing. Additionally there is a characteristic timbre for each sound defined by the magnitude ratio of the different harmonic partials. If no pitch can be established the signal is not periodic but noisy. The enhancement and reconstruction of the harmonic partials could therefore improve the identification of speech in background noise.

In literature different attempts were made to come up with good solutions, such as pitch filtering or formant tracking algorithms. In Section 6.2 a method based on pitch filtering will be delineated in short together with its advantages and drawbacks. In Section 6.3 a new algorithm will be developed based on frequency creation using nonlinear elements, also known as intermodulation.

6.2 Pitch Detection and Filtering

One way to enhance the speech harmonics is to use a comb filter, whose spectral peaks are placed right at the frequencies of the harmonic partials. The pitch filtering operation can be described in time domain by $$y(k) = \sum_{i=-N/2}^{N/2} a_i x(k + iP) \tag{6.1}$$

where $x(k)$ is the input signal, $y(k)$ the filtered output, N is the filter length, P is the pitch period and $a_i$ are the corresponding filter coefficients. The transfer function of this comb filter would be $$H_p(z) = z^{-p} \sum_{i=-N/2}^{N/2} a_i z^{-i} \tag{6.2}$$

The simplest version of this FIR type pitch filter has fixed filter coefficients $a_i$. The filter coefficients can then be set such that the envelope of the frequency response is according to the desired enhancement. Typically this would be high gain at low frequencies and little gain at high frequencies. Applied to the wind noise canceling problem the filter coefficients could be chosen such that the envelope of $H_p(z)$ is exactly the inverse of the preceding high pass filter in either one of the solutions. The updating of the filter coefficients has nevertheless to be done based on a pitch detection algorithm. There exist many different attempts for pitch detection. Unfortunately the majority of the algorithms do consume too much computational power because they are based on a complex model of pitch perception and the robustness of pitch detection in a too noisy environment is also very critical. Figure 6.1 shows the block diagram of a possible pitch filtering algorithm.

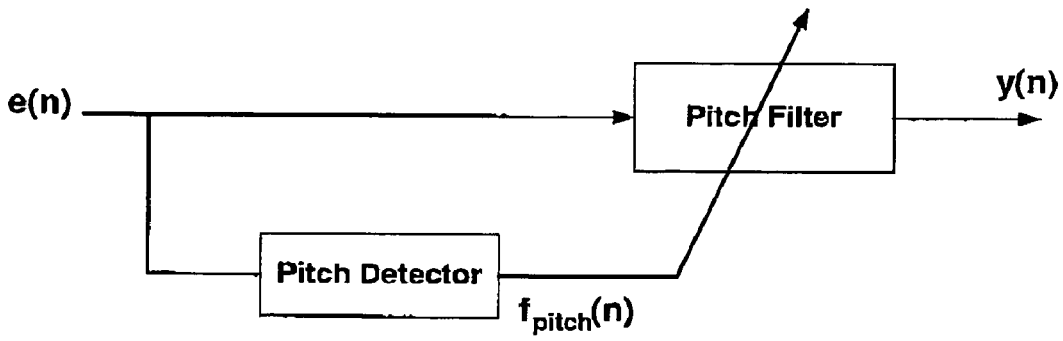

Figure 6.1: Block diagram of a pitch filtering algorithm. First the actual pitch has to be detected by a pitch detector and then a pitch filter can be applied to the signal to enhance and reconstruct the harmonic partials Additionally a voiced/unvoiced detection which turns the filter off during unvoiced and silent parts of the signal is recommended. The unvoiced signals then have to be attenuated separately to circumvent an unnatural emphasis for unvoiced parts relative to voiced sounds. Naturally the comb filter can be made adaptive, allowing the coefficients to be set based on the signal. This way the usage of a separate pitch detection is unnecessary and the exact pitch estimation is not crucial for the filter performance. A detailed analysis of different pitch detectors and pitch filters is given in [15]. The adaptive solution would probably be suited best for the use in the wind noise canceling system, however the exact performance and parameter settings for the use in a wind noise canceling systems were not investigated any closer because of the very severe constraints on precision, robustness and speed of pitch detection required for successful pitch filtering. Instead, the focus was laid on the solution presented in Section 6.3 because of the probably lower complexity and computational effort.

6.3 Nonlinear Filtering

The new algorithm proposed in this section uses nonlinear filtering to reconstruct the low frequency components suppressed during the wind noise cancelation process. The usage of nonlinear elements to create new frequencies is well known in the area of radio frequency technology. Nonlinear systems are characterized by the fact that their output signal contains frequency components which are not present in the input signal. To describe the input-output relationship of a non linear element, a polynomial representation such as $$y(k) = g(x) = c_0 + c_1 x(k) + c_2 x^2(k) + \ldots + c_n x^n(k) \quad (6.3)$$

is often used, where x(k) is the input signal and y(k) the output of the nonlinear system. After the transformation to the frequency domain the spectrum of the output signal $y(k)$ given as, $$\begin{aligned} Y(z) &= c_0 2\pi\delta(z) + c_1 X(z) + c_2 X(z) * X(z) \\ &+ \ldots + c_n X(z) * \ldots * X(z) \quad . \end{aligned} \quad (6.4)$$

It can be seen that the output spectrum in fact contains new frequency components. For many technical applications this is an undesired effect denoted as nonlinear distortions. In connection with the wind noise canceling it can however be used to reconstruct the missing harmonic frequency parts of speech, which get suppressed too much by the canceling filters.

6.3.1 System Overview

Figure 6.2 shows the block diagram of the enhancement system using a nonlinear element. First a bandpass filter is employed to select a part of the speech signal frequencies. This frequency band should ideally contain remaining harmonic frequencies with a reasonable signal-to-noise (SNR) ratio. The exact location of the bandpass filter will be discussed later on. The output of the filter is then processed through a nonlinear element, this can be any element with a nonlinear characteristic. Choosing this element one has to consider the transfer function as well as the computational power of the operation. Investigated elements are $|.|$ or $x^n$. Both elements produce more or less the same results but the first one has the advantage that the magnitude ratios of the harmonic partials remain the same. The output signal of the nonlinear element then contains the fundamental pitch frequency and all other harmonics. As there are also some non speech or non periodic frequencies in the selected band the output signal of the non linear element also contains harmonics of these frequencies which results in some undesired nonlinear distortions. However, if the SNR in the selected band is reasonably high these distortions will be small. The low pass filter following the intermodulation process selects then the desired low frequency parts. The fpllowing gain block then applies an additional gain to these low frequency components. Ideally the gain is exactly the inverse of the noise canceling filter. That is high gain for low frequency components and low gain for the high frequencies.

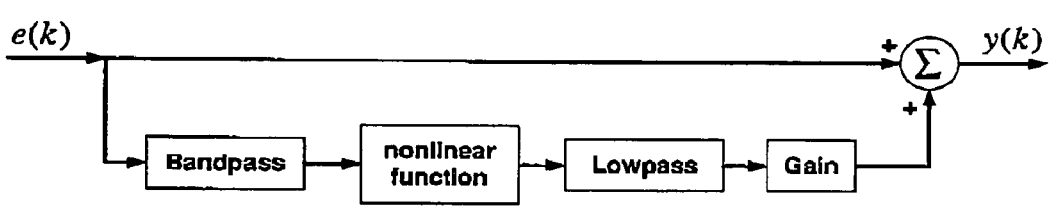

Figure 6.2: Block diagram of enhancement system using a nonlinear element.

6.3.2 Parameter Selection

As mentioned before, the selection of the filter parameters for the band pass and the low pass filter in Figure 6.2, especially for the bandpass filter, is important for the performance of the system. All filters were designed as FIR filters. This has the advantage of possible ideal compensation of the groupdelay of these filters with a simple $z^{-\tau}$ element. On the other hand these FIR filters do come with high filter orders and therefore with a certain delay, that has to be compensated. For a later real time implementation the use of shorter IIR filters is probably recommendable despite the possible phase distortions. The aim of the bandpass filtering is to select a part of the signal frequencies which are expected to reconstruct the fundamental frequencies and the harmonics removed by the wind noise canceling filters. To get a first idea on where the most important frequencies for speech, the formants, lie, and if they are visible in the signal spectrum even for very low and negative SNR, some investigations on the formant frequencies were made.

Frequency regions where the harmonic partials show a higher amplitude than the rest of the surrounding frequencies are called formant frequencies. They point to resonances in the vocal tract. Table 6.1 gives an overview over the fundamental and the formant frequencies for male and female voices. These formant frequencies however can differ very much for different speakers and languages. Figure 6.3 shows the formant triangle where the locations of the first and second formant for the German vowels a, e, i, o, u are shown graphically.

In reality the locations are not exact dots but are smeared over a larger area. However it can be seen, that the range of formants differs a lot, which makes it more difficult to select

| | |
|---|---|
| Fundamental $F_0$: | |
| male: | 100 - 400 Hz |
| female: | 200 - 800 Hz |
| 1. Formant $F_1$: | 300 - 3000 Hz |
| 2. Formant $F_2$: | 600 - 2500 Hz |
| 3. Formant $F_3$: | 1500 - 2500 Hz |
Table 6.1: Fundamental and formant frequencies for male and female voices.
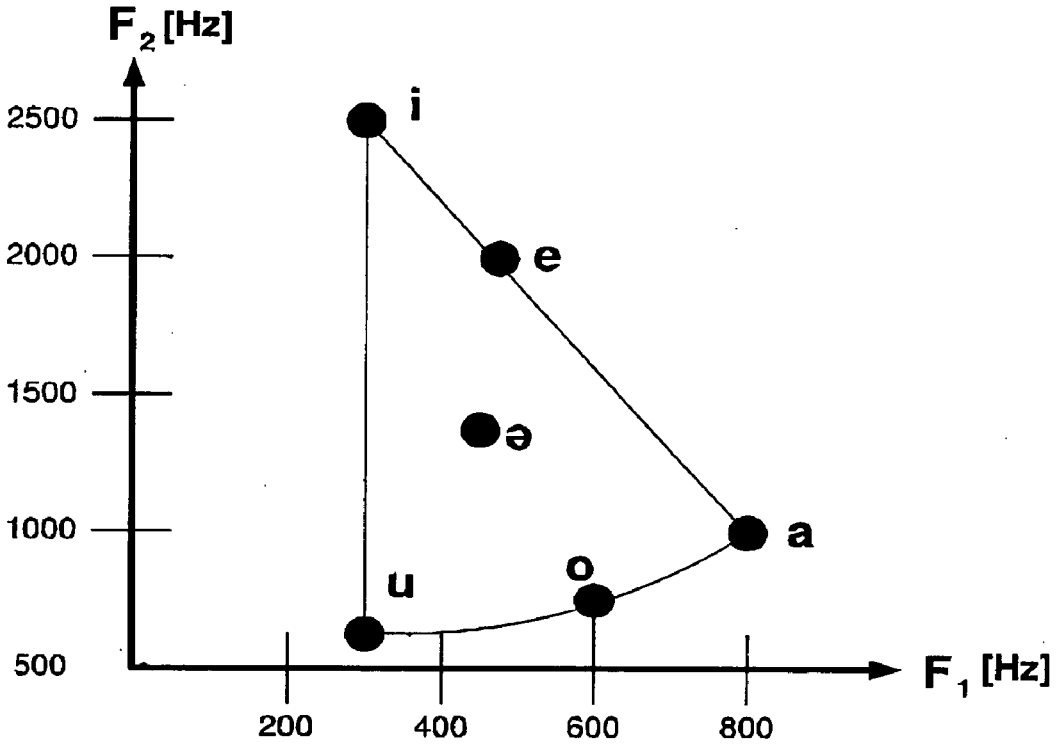
Figure 6.3: The formant triangle shows the approximate location of the first two formant frequencies for the German vowels, a, e, i, o and u. In reality the locations are not exact dots but are smeared over a larger area.

appropriate cut-off frequencies for the bandpass filter. An additional problem is the signal-to-noise ratio. For higher ratios there should be no problem to detect the formant frequencies in the spectrum. The enhancement of speech however is most interesting in situations where the SNR is still very low or even negative. In such situations it could be difficult to locate the desired formant frequencies. To get an idea how tricky the situation really is, a 3D spectrogram was calculated for signals with speech in wind noise at different SNR. Figure 6.4 shows the 3D spectrogram for clean speech and speech in noise for an SNR of -10dB. Each time frame is the mean value of 3 time frames of 256 samples. The time frame is chosen such that the time resolution is good enough to see the single phonemes and high enough to have a reasonable resolution in frequency. It can be seen that for an SNR of -10dB the single frequency peaks are not visible as clear as for the clean speech, because the dell at about 1kHz is filled up with wind noise. Nevertheless, at least some of the formants can be spotted by eye even in bad SNR conditions.

A more sophisticated possibility to select the best suitable bandpass region would be to measure the SNR in different bands of the signal spectrum and then select the one with the highest SNR value. This method was however not tried out till now, but the bandpass filter was set fixed in the range of 1 to 2 kHz with a stop band suppression of -60dB. The low pass filter was then set to select all frequencies lower than about 800 Hz, which corresponds more or less to the frequency range of the attenuation by the canceling filter.

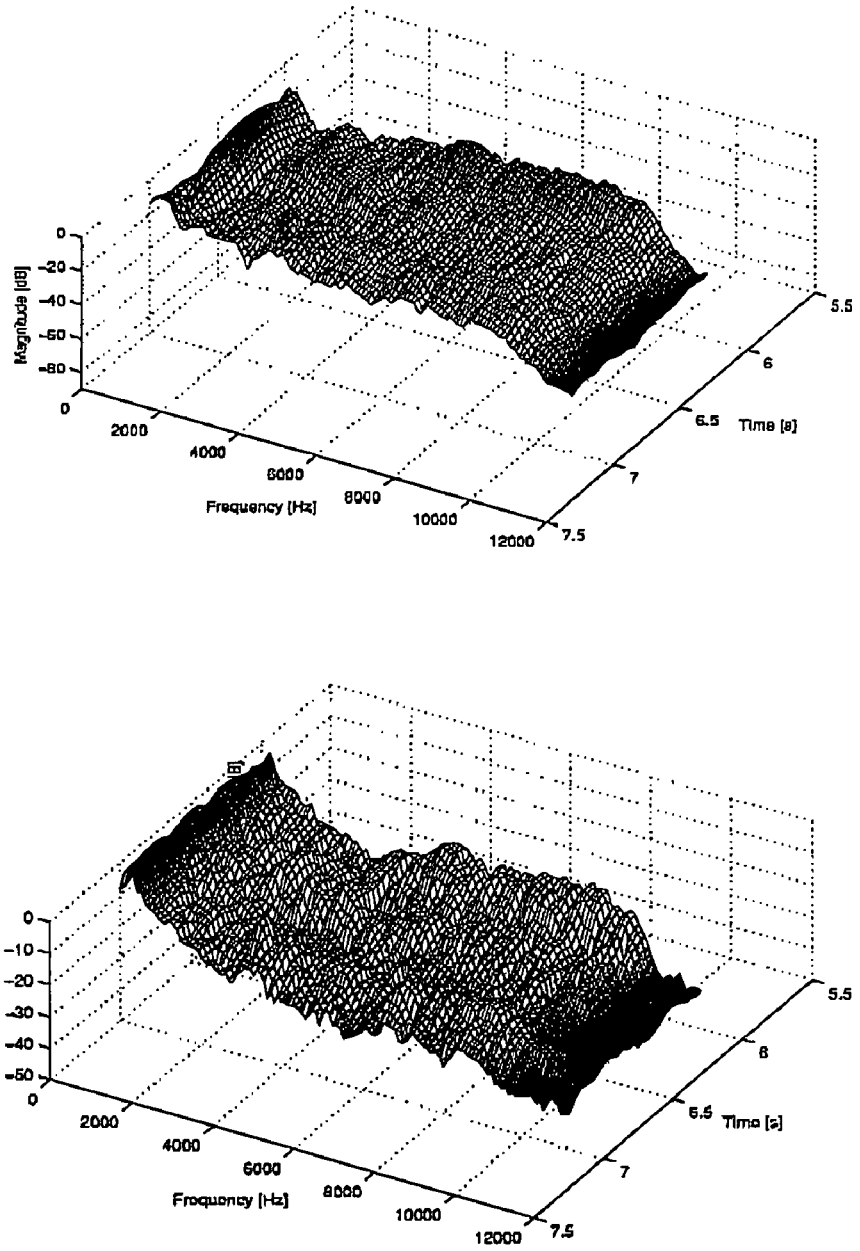
Figure 6.4: *Upper figure:* 3D spectrogram for clean speech. *Lower figure:* 3D spectrogram for speech in wind noise at -10dB SNR. The dell at about 1kHz seen in the upper figure is filled up with wind noise.

6.3.3 Voiced Unvoiced Detection

First experiments showed that the intermodulation frequencies originating from non periodic or non voiced signal parts resulted in unpleasant distortions. Hence an additional block was added which allows to distinguish between voiced and unvoiced parts of the speech signal. The decision block is based on the frame wise computation of the autocorrelation function.

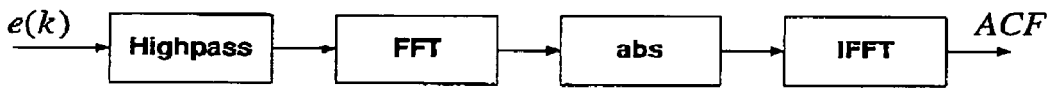

Figure 6.5: Computation of the auto correlation function.

The approximate ACF is computed by applying the inverse Fourier transformation (IFFT) on the amplitude spectrum of the signal (ACF and power spectrum build a Fourier transformation pair) [10]. Figure 6.5 shows the block diagram of the ACF computation. The high pass filter at the beginning of the ACF computation in Figure 6.5 shall remove the DC part and the frequencies below the resolution of the ACF, which in turn is determined by the frame length.

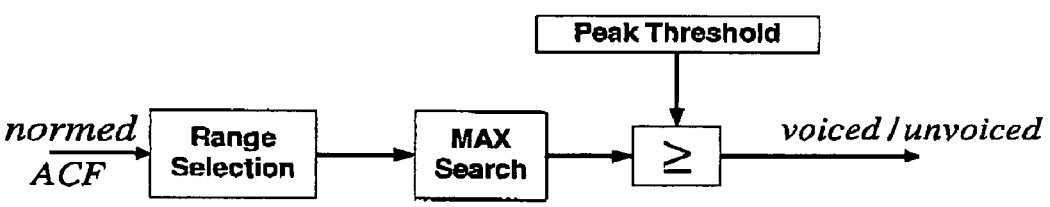

Figure 6.6: Decision between voiced and unvoiced signal frames using the autocorrelation function.

Figure 6.6 shows the decision between voiced and unvoiced frames. The periodicity of the signal can be determined by searching for a relative maximum of the normalized ACF in a certain frequency range. If the found maximum is beyond a certain threshold the frame is said to be voiced, otherwise it is marked unvoiced. Additionally the maximum power of the signal is inspected by comparing the overall maximum of the unnormalized ACF with a threshold. If the signal power exceeds this threshold there is a real signal present otherwise the signal part is said to be silent. This decision reduces false voiced/unvoiced decisions in the case the silent parts would be periodic.

To avoid too frequent and abrupt transitions between voiced and unvoiced segments of the signal an averaging block was introduced. This way the enhancement block is switched on and off in a soft way, which results in a more comfortable hearing situation.

6.4 Results

In the following the results achieved by the enhancement system shall be analyzed in detail. Figure 6.7 shows the silence detection for clean speech (lower plot) and speech in wind noise for an SNR of 0dB (upper plot). The overall maximum of the ACF is compared with a power threshold. The decision is shown together with the time domain signal. The threshold is set such that the wind noise in the speech pause does result also in silence detection.

Figure 6.8 shows the decision step on the periodicity of the signal. The lower plot shows the situation for clean speech and the upper plot shows the values for speech in noise with 0dB SNR. If the maximum of the ACF in the selected search range exceeds the threshold the signal part is said to be voiced. It can be seen, that the decision is clearer if there is no wind present.

Figure 6.9 shows the time signal and the according words

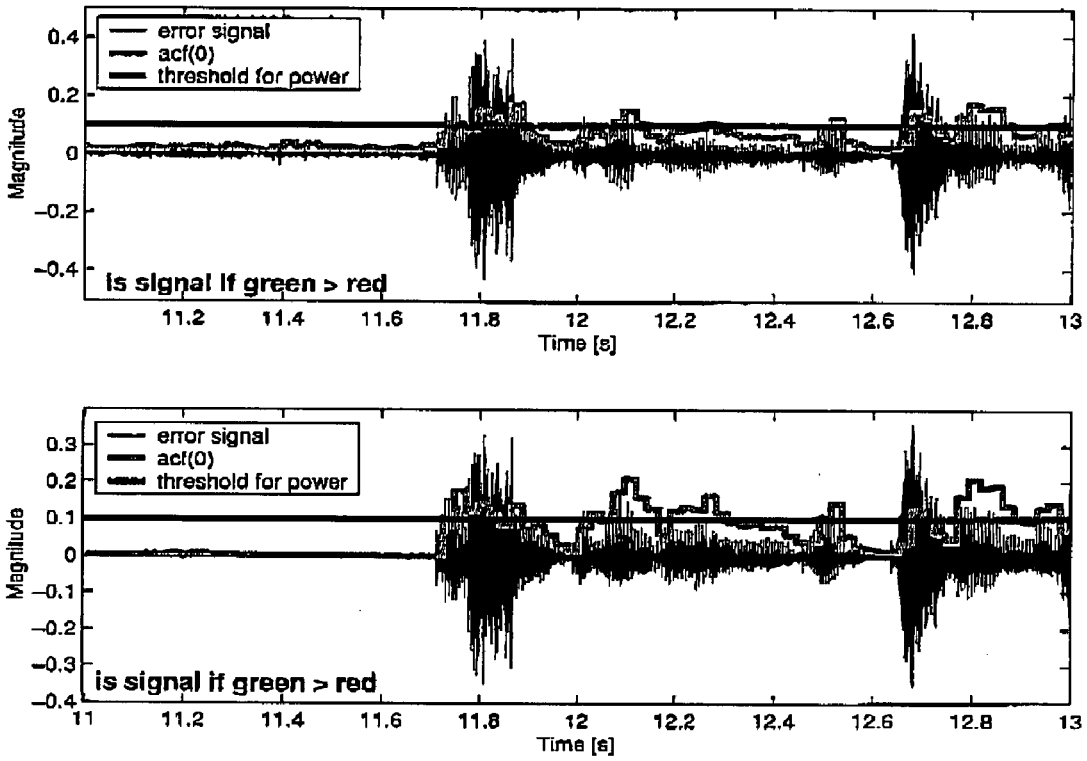
Figure 6.7: *Upper figure:* Time signal for speech in wind noise at 0dB SNR together with the maximum value of the ACF . The threshold decides on whether the present frame is silence or not. If the maximum of the ACF is below the threshold there is no significant signal power present. *Lower figure:* Time signal for clean speech together with the maximum value of the ACF.

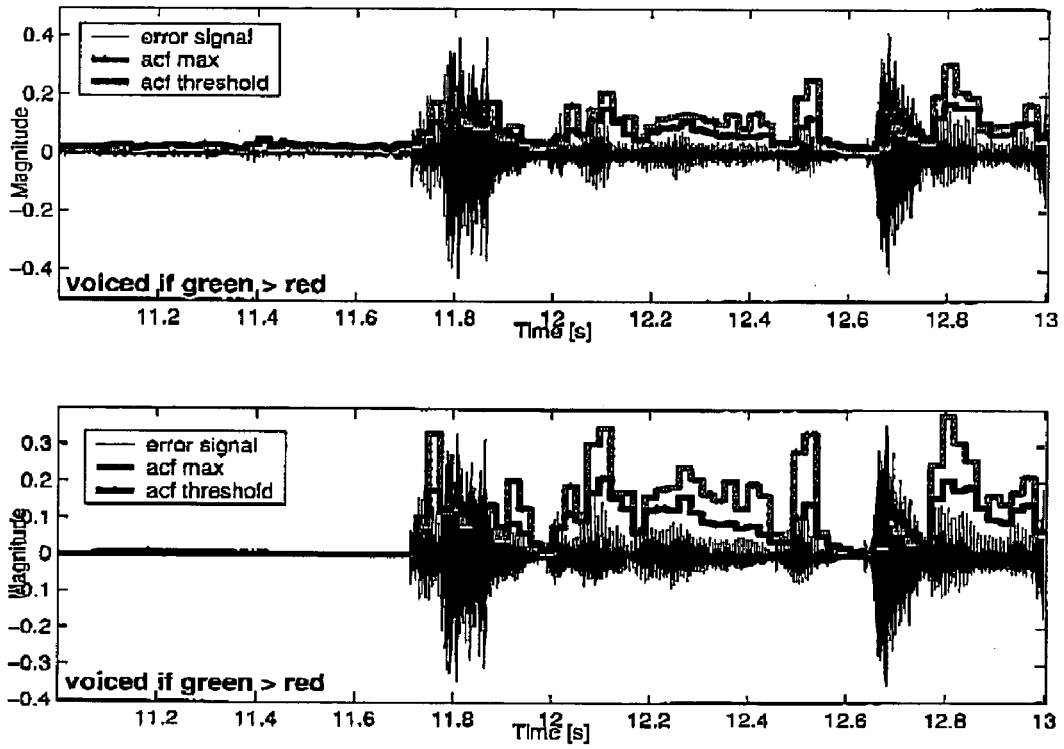
Figure 6.8: *Upper figure:* Time signal for speech in wind noise at 0dB SNR together with the found ACF maximum in the selected frequency range . If this maximum is below the threshold the signal is marked to be unvoiced . *Lower figure:* Time signal for clean speech togheter with the found ACF maximum.

together with the voiced-unvoiced signal for the sentence "Es sieht ein lohnwirksames ...". It can be seen, that even for speech in wind with an SNR of 0dB (lower figure) the decision is more or less correct. This voiced-unvoiced decision is then used to switch on the enhancement process for voiced parts of the speech wheras for unvoiced parts no enhancement will be applied. If this toggle is done with a sharp switch a cracking sound can be heard in the output signals. Therefore the switching is done in a soft way by smoothing the voiced-unvoiced signal as shown in Figure 6.9. By choosing an appropriate time constant for the smoothing block too frequent changes and possible false decisions can also be reduced.

To get a better understanding how the algorithm does affect the signal spectrum Figure 6.10 shows the spectrogram of the input and the outupt signal of the enhancement block together with the corresponding input time signal. In the spectrogram of the input signal one can see that the low frequency components are missing over the whole time range. In the spectrogram of the output signal in the lower plot of Figure 6.10 it can be seen that for the voiced signal parts the low frequency components are reconstructed whereas for the unvoiced parts nothing changed.

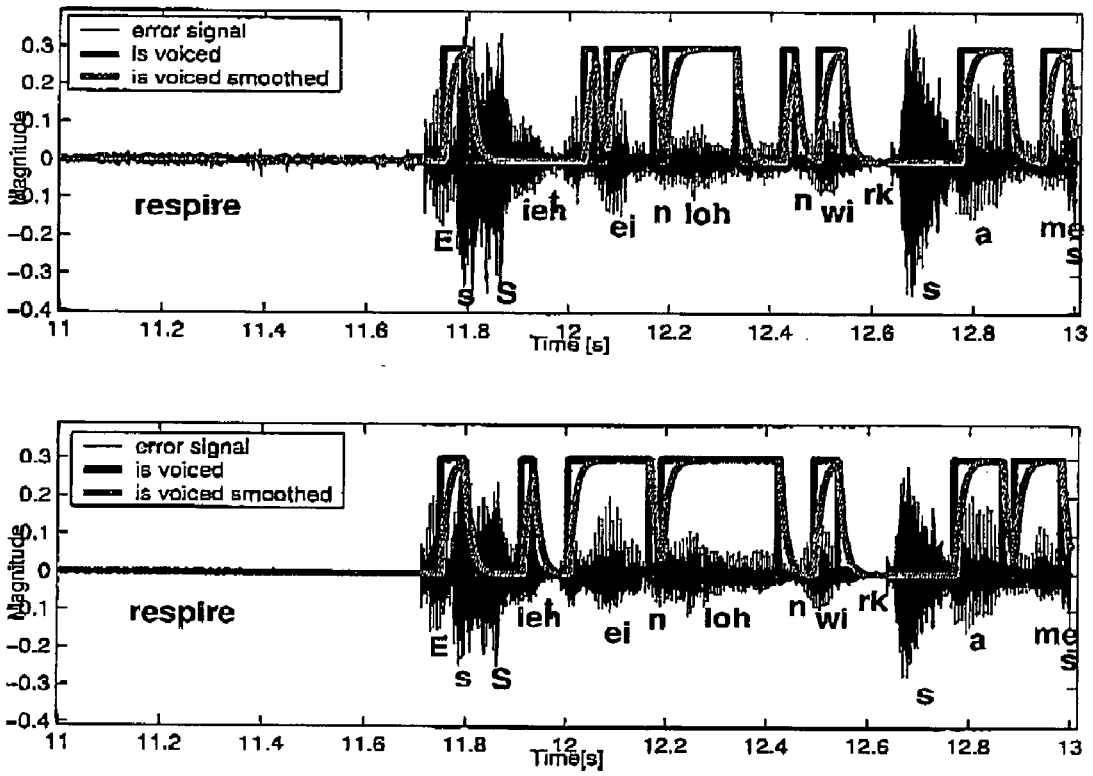
Figure 6.9: Input signal with the voiced unvoiced decision signal. If the signal is 0 the part is said to be unvoiced. The decision additionally is smoothed to avoid the cracking sound heard in the output signal if there is a sharp switching and the too frequent switching between voiced and unvoiced.

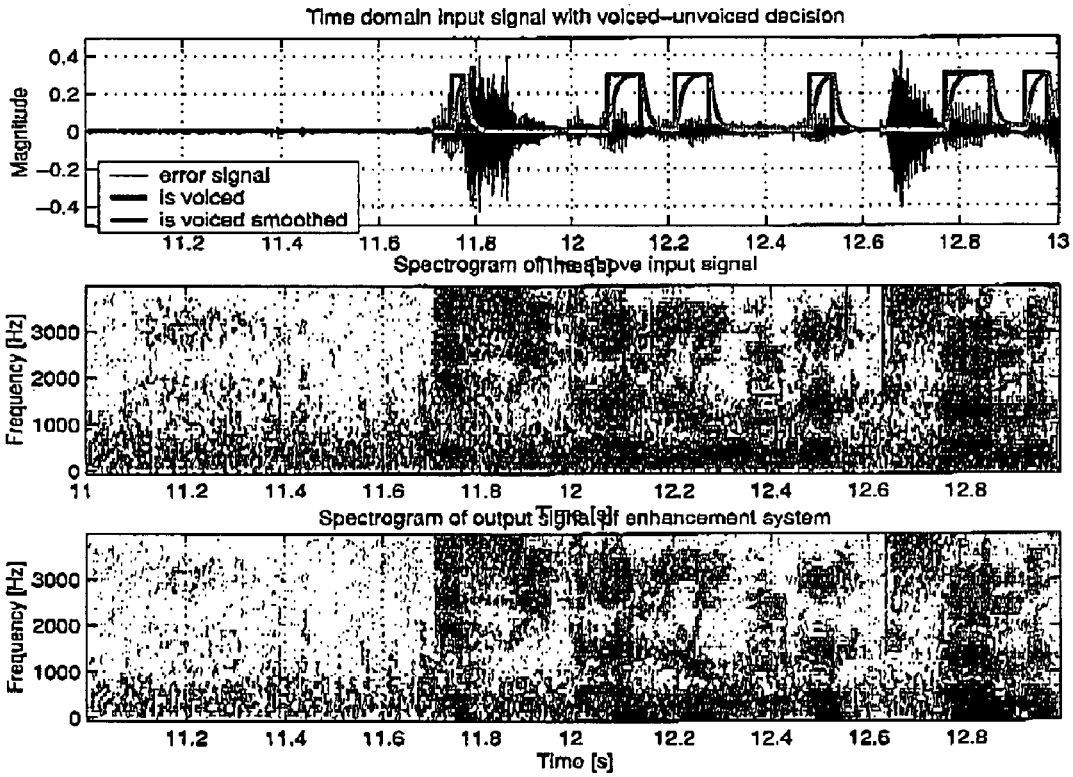

Figure 6.10: *Upper figure: Input time signal for speech in wind noise at 0 dB SNR together with the voiced-unvoiced decison. Middle figure:* Spectrogram of the above input input signal. The low frequencies are missing over the whole time range *Lower figure:* Spectogram of the output signal of the enhancement block. It can be seen that for voiced parts of the speech the low frequencies are reconstructed.

Chapter 7

Conclusions

The phenomenon of wind noise in hearing aids and its cancelation were investigated in detail. In a first step the generation and the characteristics of wind noise was analyzed. The analysis was based on existing wind noise recordings for two different hearing aid types, a behind-the-ear (BTE) and in-the-ear (ITE), with different settings for wind speed, direction of arrival of the wind and hair cut. The analysis agrees mostly with existing researchs, except for the difference in wind noise sensitivity of different hearing instrument types, which can be attributed to different measuring methods.

After studying of the state of the art wind reduction solutions, new methods for wind noise detection and canceling were developed. Two different approaches were investigated, one based on the usage of multiple microphones, and the other relying only on one single input signal. The wind noise canceling algorithms are based on different characteristics of wind noise, such as the low frequent spectrum and the low correlation between two microphone signals of a hearing aid.

The algorithms were each run with different sound examples including also mixed sound of speech and wind with different SNR values. Both algorithms showed to behave as expected. The first aim to improve listening comfort could be accomplished even for bad SNR conditions. The algorithms were judged by simply listening to the output signals, because there does not exist a suitable objective measure for sound qualification.

As the intelligibility of speech, especially for low or negative SNR values, was acceptable but not excellent, an additional block for the enhancement of speech in the processed signals of both algorithms was investigated. The solutions found in literature showed to be not very reliable in bad SNR conditions or too complex for the use with the limited computational power in hearing instruments. A new and very simple algorithm using nonlinear elements was developed. The improvement of the intelligibility of speech reached with the actual settings however was not overwhelming. Some further development steps for the improvement of the intelligibility of speech would possibly lead to even better results.

Further it would be necessary to perform a reliable test with additional wind noise measurements including actual situations with speech in wind noise. A test with hearing aid users on the performance of the different algorithms and especially on the intelligibility of the processed speech in wind noise would help to definitively decide on the performance of the developments made in this study.

Appendix A

Wind Noise Records

Appendix B

Sound Examples

Bibliography

[1] A.E May, L.J Upfold, J.A Battaglia
*The advantages and disadvantages of ITC, ITE and BTE hearing aids: diary and interview reports from elderly users*
British Journal of Audiology 1990;24;301-309

[2] H. Levitt
*Noise reduction in hearing aids: An overview*
Journal of Rehabilitation Research and Development, Vol. 38 No.1,January/February 2001

[3] H. Dillon, I.Roe, R.Katsch
*Wind Noise in Hearing Aids: Mechanisms and Measurements*
National Acoustic Laboratories Australia
January 13, 1999

[4] James A. Fay and N.Sonwalker
*A Fluid Mechanics Hypercourse*
www.mas.ncl.ac.uk/s̄books/nish.mit.edu/2006/Textbook
1991 Massachusets Institute of Technology

[5] F.K. Kneubühl
*Repetitorium der Physik*
Teubner Studienbücher Physik, 1994

[6] Saeed V. Vaseghi
*Advanced Signal Processing and Digital Noise Reduc-*

*tion*
Wiley Teubner,1996

[7] L. Grenner, U.Abrahamsson, B. Jernberg, S.Lindblad
*A comparaison of wind noise in four hearing instruments*
Scand Audiol 2000;29:171-174

[8] Siemens Audiologische Technik GmbH
*Patentschrift DE 100 45 197 C 1*

[9] Gary W.Elko
*A Simple Adaptive First-Order Differential Microphone*
Acoustics and Speech Research Department Bell Labs, Lucent Technologies
Murray Hill, NJ

[10] Michael Ch. Büchler
*Algorithms for Sound Classification in Hearing Instruments*
Diss. ETH no 14498

[11] Silvia Allegro
*Palio DSP, Classifier, technical description (internal document)*
Phonak AG, Stäfa, Switzerland

[12] Christian Lotto
*Research Report, Rule Based Classifier (internal document)*
Phonak AG, Stäfa,Switzerland

[13] Dr. David Almagor
*Enhancement of Noisy Speech Signals by Low-Cost, Adaptive Methods*

National Semiconductor Corporation, DSP Technology Group

[14] G.Moschytz, M.Hofbauer
*Adaptive Filter*
Springer-Verlag 2002

[15] M.Liechti
*Bionic Speech Enhancement by Means of Pitch-Synchronous Filtering*
Diploma Thesis, laboratory of Audiovisual Communications,EPF Lausanne, Switzerland

[16] Christian Lotto
*Wind Noise Recordings (internal document)*
Phonak AG, Stäfa, Switzerland 2002

The invention claimed is:

1. A method for manufacturing an acoustical device, comprising the steps of providing in a device casing an acoustical/electrical input converter arrangement with an electric output;

providing an audio signal processing unit for establishing audio signal processing of the device according to individual needs and/or purpose of the device, having an input and an output;

providing at least one electrical/mechanical output converter with an input;

providing a filter arrangement with an adjustable high-pass characteristic, with a control input for said characteristic, an input and an output;

establishing the following operational connections:

between said output of said input converter arrangement and said input of said filter arrangement, between said output of said filter arrangement and said control input, between said output of said filter arrangement and said input of said processing unit, between said output of said processing unit and said input of said at least one output converter.

2. The acoustical device produced by the method of claim 1.

3. The method of claim 1, further comprising the step of establishing said operational connection of said output of said filter arrangement and said control input via a statistic evaluating unit.

4. The acoustical device produced by the method of claim 3.

5. The method of claim 3, further comprising the steps of providing said statistic evaluating unit, determining the amount of energy of a signal at said output of said filter arrangement, and adjusting said adjustable high-pass characteristic for minimizing said energy.

6. The acoustical device produced by the method of claim 5.

7. The method of claim 1, further comprising realizing said filter arrangement with a predictor unit by operationally connecting to said output of said input converter a unit with a predictor unit in the following structure:

an adjustable low-pass filter with an input operationally connected to said output of said input converter arrangement and with an output operationally connected to one input of a comparing unit;

operationally connecting said output of said input converter arrangement substantially unfiltered with respect to frequency to a second input of said comparing unit;

operationally connecting an output of said comparing unit to a control input of said low-pass filter for adjusting a characteristic of said low-pass filter, said control input of said low-pass filter being said control input of said filter arrangement and said output of said comparing unit being said output of said filter arrangement.

8. The acoustical device produced by the method of claim 7.

9. The method of one of claims 1, 3, 5, 7, further comprising providing in said casing an analog to digital conversion unit and operationally connecting the input of said analog to digital conversion unit to said output of said input converter arrangement, operationally connecting the output of said analog to digital converter unit to the input of said filter arrangement and providing said filter arrangement as a digital filter arrangement.

10. The acoustical device produced by the method of claim 9.

* * * * *